US010746361B2

(12) United States Patent
Park et al.

(10) Patent No.: US 10,746,361 B2
(45) Date of Patent: Aug. 18, 2020

(54) MODULAR BROADBAND LIGHT SOURCE WITH LAMP INSERT AND METHODS OF USE

(71) Applicant: Newport Corporation, Irvine, CA (US)

(72) Inventors: John Park, Irvine, CA (US); Rob Buczala, Bozeman, MT (US)

(73) Assignee: Newport Corporation, Irvine, CA (US)

( * ) Notice: Subject to any disclaimer, the term of this patent is extended or adjusted under 35 U.S.C. 154(b) by 0 days.

(21) Appl. No.: 16/468,557

(22) PCT Filed: Jan. 15, 2018

(86) PCT No.: PCT/US2018/013741
§ 371 (c)(1),
(2) Date: Jun. 11, 2019

(87) PCT Pub. No.: WO2018/132800
PCT Pub. Date: Jul. 19, 2018

(65) Prior Publication Data

US 2019/0353314 A1 Nov. 21, 2019

Related U.S. Application Data

(60) Provisional application No. 62/446,731, filed on Jan. 16, 2017, provisional application No. 62/564,995, filed on Sep. 28, 2017.

(51) Int. Cl.
*H05B 31/04* (2006.01)
*H05B 31/24* (2006.01)
(Continued)

(52) U.S. Cl.
CPC ..... *F21S 8/006* (2013.01); *F21V 15/01* (2013.01); *F21V 23/0457* (2013.01); *H05B 47/00* (2020.01); *H05B 47/19* (2020.01)

(58) Field of Classification Search
None
See application file for complete search history.

(56) References Cited

U.S. PATENT DOCUMENTS

2002/0047546 A1* 4/2002 Kayser ..... H05B 41/36 315/117
2002/0167255 A1 11/2002 Roberts
(Continued)

FOREIGN PATENT DOCUMENTS

JP 4918709 B2 4/2012
KR 1020150103078 A 9/2015

OTHER PUBLICATIONS

Asahi Spectra product datasheet: MAX-303—Xenon Light Source 300W Monochromatic Light with Filters, p. 3, Dec. 12, 2015.

*Primary Examiner* — Henry Luong
(74) *Attorney, Agent, or Firm* — Edward Scott Trask

(57) ABSTRACT

The present application discloses a modular broadband light source and includes at least one lamp housing defining at least one lamp body receiver having at least one outlet port formed on the lamp housing, at least one lamp body insert positionable within the body insert receiver and configured to detachably couple to the lamp housing, at least one thermal managing assembly coupled to the lamp body insert and defining a lamp receiving area, at least one Xenon arc lamp positionable in the lamp receiving area and in communication with the outlet port on the lamp housing, at least one processor device coupled to at least one of the at least one lamp housing, the at least one lamp body insert and the at least one Xenon arc lamp.

18 Claims, 48 Drawing Sheets

(51) Int. Cl.

| | |
|---|---|
| ***H05B 47/10*** | (2020.01) |
| ***F21S 8/00*** | (2006.01) |
| ***F21V 15/01*** | (2006.01) |
| ***F21V 23/04*** | (2006.01) |
| ***H05B 47/00*** | (2020.01) |
| ***H05B 47/19*** | (2020.01) |

(56) References Cited

U.S. PATENT DOCUMENTS

| | | | | |
|---|---|---|---|---|
| 2003/0137248 | A1 | 7/2003 | Bell | |
| 2010/0283369 | A1 | 11/2010 | Chen | |
| 2016/0370567 | A1* | 12/2016 | Constantinou | F21V 29/59 |
| 2017/0198898 | A1* | 7/2017 | Ro | H05B 33/0803 |

* cited by examiner 510
138
110
160
470
230
208
301
306
302
310
300
314
305
200
210
218
214
370
308
372
358
356
350
353
352
162
130
139
206
202
X
Y
Z

10

200

10

10

1010

1020

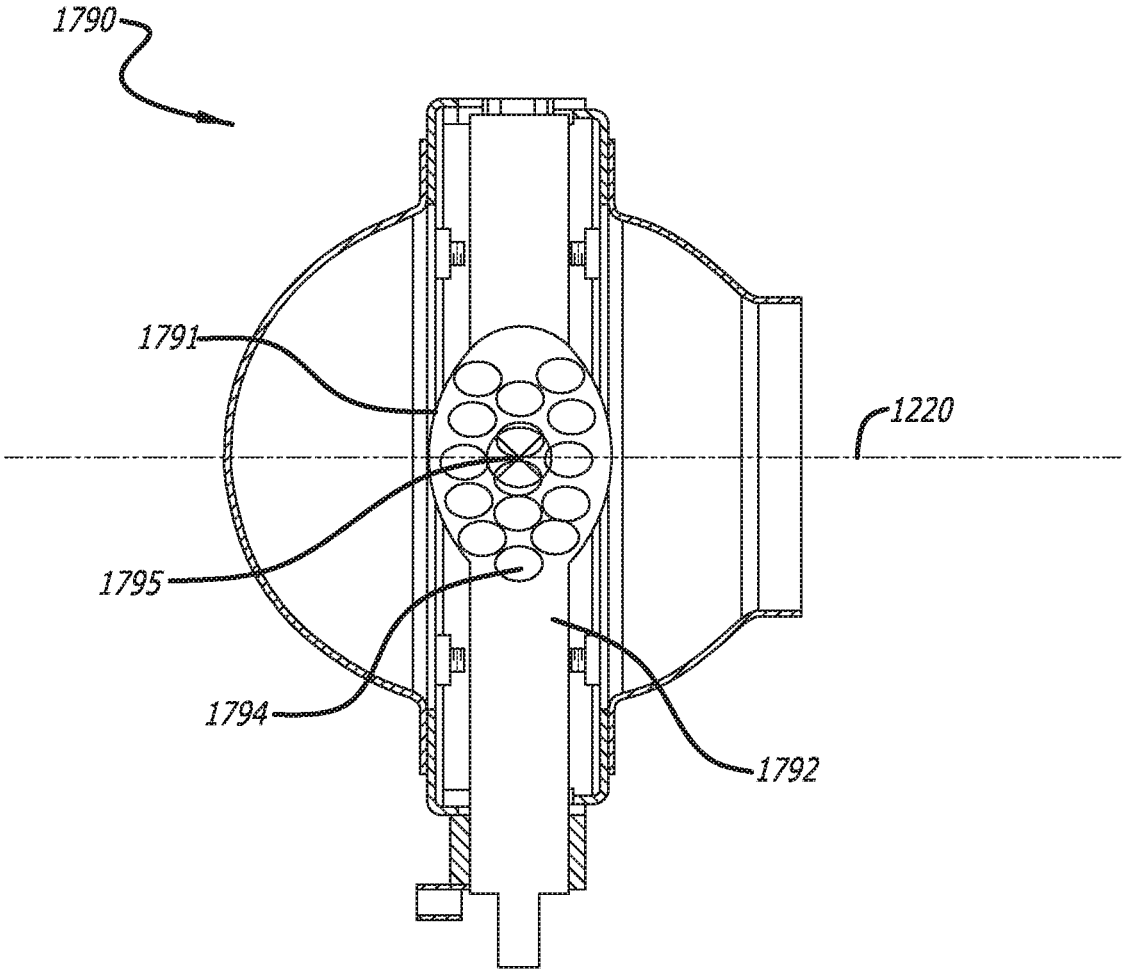
FIG. 36
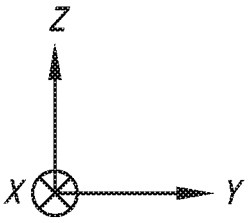

1010

1010

MODULAR BROADBAND LIGHT SOURCE WITH LAMP INSERT AND METHODS OF USE

CROSS-REFERENCE TO RELATED APPLICATIONS

The present application claims priority to Patent Cooperation Treaty Patent Application No. PCT/US2018/013741, filed on Jan. 15, 2018, entitled "Modular Broadband Light Source with Lamp Insert and Methods of Use, which claims priority to U.S. Provisional Application Ser. No. 62/446,731 filed on Jan. 16, 2017, entitled "Modular Broadband Light Source with Lamp Insert and Methods of Use," and U.S. Provisional Appl. Ser. No. 62/564,995 filed on Sep. 28, 2017 entitled "Modular Broadband Light Source with Lamp Insert and Methods of Use", the contents all of which are hereby incorporated by reference in their entirety herein.

BACKGROUND

Broadband, incoherent or low-coherence light sources are presently used in a wide variety of applications. One common application is renewable energy research such as photovoltaic testing and characterization, where these broadband sources operate as solar simulators configured to replicate the broad spectral output emitted by the Sun. In addition, solar simulators are also used to test sunscreens, protective coatings, and eyewear. Other applications for these devices are absorption and fluorescence spectral scanning.

Many of these light sources utilize Xenon arc lamps, Mercury arc lamps, Xenon-Mercury arc lamps, Deuterium arc lamps and other broadband sources, depending on the end use application. While the use of arc lamps as broadband sources has proven useful, a number of shortcomings have been identified. For example, the operating lifetime of these arc lamps is limited, thereby requiring replacement of the arc lamp on a regular basis. Installation of new arc lamps into the lighting system can be both difficult and time consuming. Also, arc lamp failure can happen without warning, making anticipation of replacement difficult.

In light of the foregoing, there is an ongoing need for a modular arc lamp insert with a cumulative lamp run-time tracker and pre-aligned optics that is easily replaceable.

SUMMARY

The present application is directed to a modular broadband light source used in a variety of experiments and equipment. In one embodiment, the present application discloses a broadband light source and includes at least one lamp housing having at least one body insert receiver therein, the lamp housing having at least one outlet port formed thereon. At least one lamp body insert may be configured to be positionable within the body insert receiver, with the lamp body insert configured to detachably couple to the lamp housing. At least one thermal managing assembly may be coupled to the lamp body insert and define a lamp receiving area in optical communication with the outlet port that is formed on the housing. At least one Xenon arc lamp may be positionable within the lamp receiving area in communication with the outlet port on the lamp housing. At least one processor device may be coupled to the lamp housing, the lamp body insert or the Xenon arc lamp. The processor device may be configured to measure at least one cumulative run time of Xenon arc lamp. At least one heat dissipation device and at least one lamp sensor device may be in communication with the Xenon arc lamp. At least one interface connector may be in communication with Xenon arc lamp, the heat dissipation device and the lamp sensor device. Alternatively, the arc lamp that may be positioned in the lamp receiving area could be a number of types of arc lamp, namely Mercury-Xenon arc lamps, Mercury arc lamps, Deuterium arc lamps, Carbon arc lamps, Krypton arc lamps and Sodium arc lamps, among others.

In another embodiment, the present application discloses a modular light source that includes at least one lamp housing defining at least one lamp body insert receiver, with the lamp housing having at least one outlet port formed thereon. At least one lamp body insert may be configured to be positionable within the body insert receiver, with the lamp body insert configured to detachably couple to the lamp housing. At least one thermal managing assembly may be coupled to the at least one lamp body insert, defining at least one lamp receiving area. At least one lamp may be positionable within the lamp receiving area in optical communication with the outlet port of the lamp housing. The lamp body insert may further comprise at least one interface connector in communication with at least one heat dissipation device and at least one lamp sensor device and the lamp via at least one interface cable, wherein the interface cable may be configured to supply electrical power to the lamp. Exemplary lamps that may be positioned in the lamp receiving area are arc lamps, incandescent lamps, LED lamps, superluminescent LED lamps and laser diodes. The modular light source further comprises at least one processor device that may be coupled to either the lamp housing or the lamp body insert, and configured with at least one information display.

In another embodiment, the present application discloses a broadband light source module, comprising at least one lamp body insert with at least one thermal managing assembly defining at least one lamp receiving area therein. The thermal managing assembly may be configured with at least one protective fixture that may define at least one protective fixture outlet port. At least one broadband lamp may be positionable in the lamp receiving area and in optical communication with the protective fixture outlet port. The lamp body insert may further include at least one interface connector in communication with at least one heat dissipation device, at least one lamp sensor device, and the broadband lamp via at least one interface cable, wherein the interface cable may be configured to supply electrical power to the broadband lamp.

Other features and benefits of the embodiments of the novel modular broadband light source with a lamp body insert as disclosed will become apparent from a consideration of the following detailed description.

BRIEF DESCRIPTION OF THE DRAWINGS

Various embodiments of a modular broadband light source with a lamp body insert will be explained by the accompanying drawings, wherein:

FIGS. 35 and 36 show section views of alternative embodiments of thermal managing reflector bodies with light emitting diodes;

DETAILED DESCRIPTION

Figure 1B:
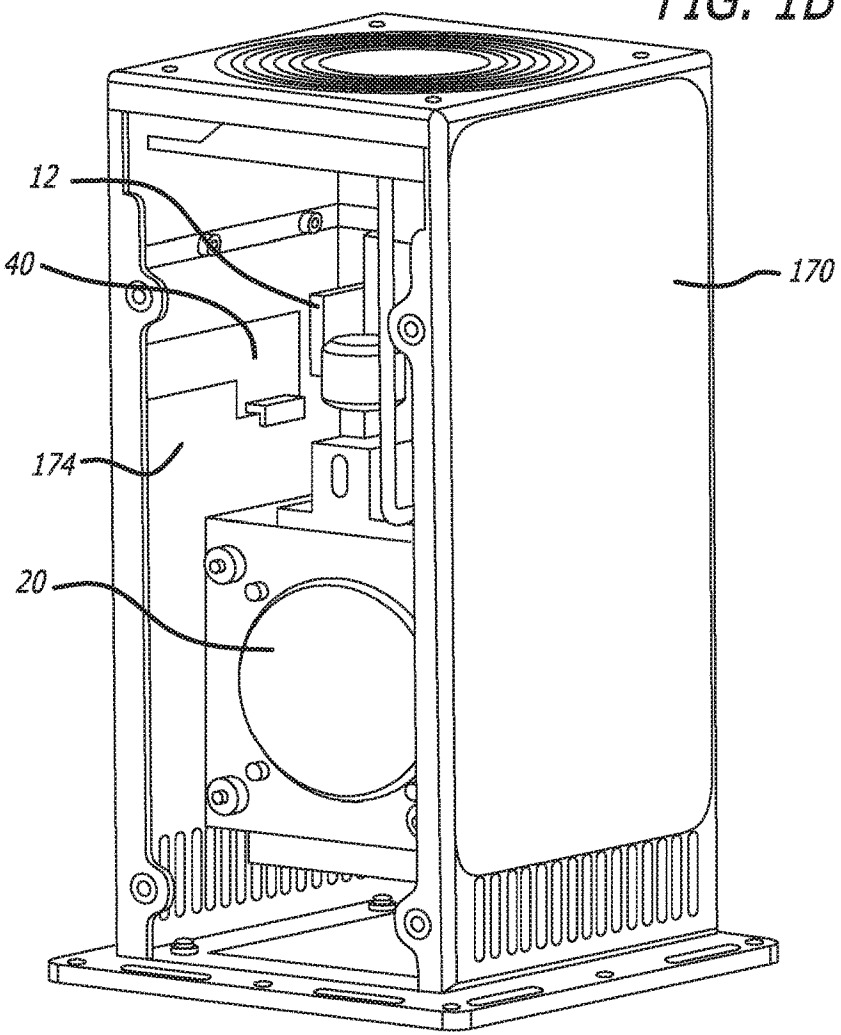
FIGS. 1A and 1B show elevated perspective views of an embodiment of a broadband light source.
Figure 1A:
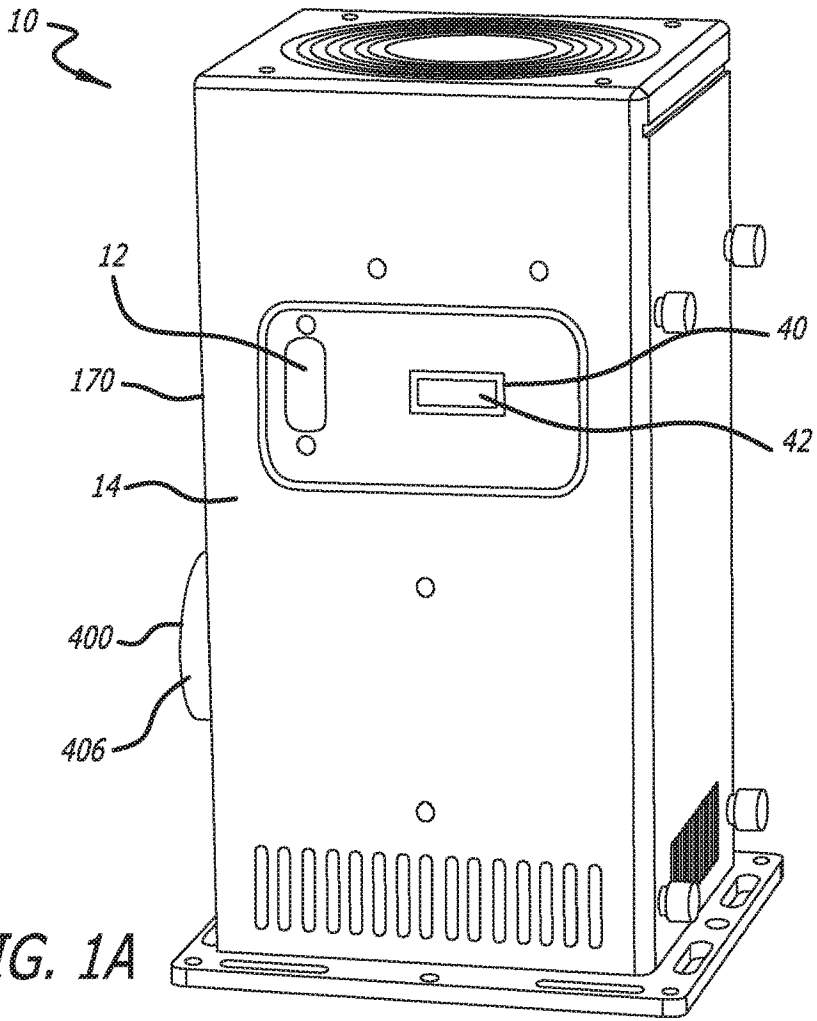
Figure 2:
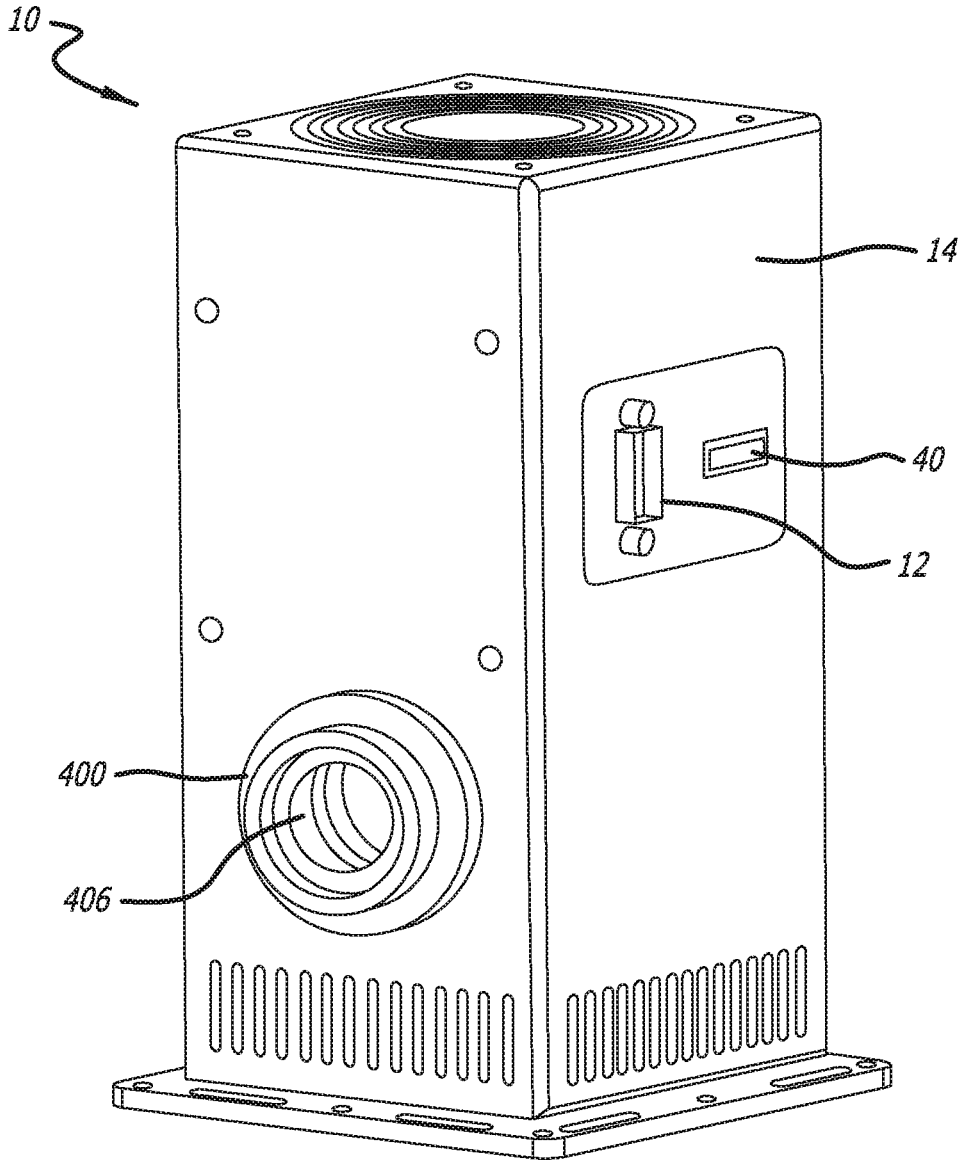
FIG. 2 shows an elevated perspective view of an embodiment of a broadband light source wherein an optical system, a control connector and a processor device are shown attached to a lamp housing.

FIGS. 1A, 1B and 2 show various views of an embodiment of novel modular broadband light source 10. As shown, the modular broadband light source 10 includes at least one lamp body insert 20 positioned within at least one lamp housing 170. The lamp housing 170 may include at least one optical system 400 coupled thereto or in communication therewith. In the illustrated embodiment, a single lamp body insert 20 is positioned within or otherwise coupled to the lamp housing 170. Optionally, any number of lamp body inserts 20 may be positioned within or otherwise coupled to the lamp housing 170. Further, any number of optical systems 400 may be positioned within or otherwise coupled to the lamp housing 170. Further, in the illustrated embodiment, the optical system 400 includes at least one outlet port 406, although those skilled in the art will appreciate that the optical system 400 may include any number of outlet ports 406. Further, the lamp housing 170 may include at least one control connector 12 thereon or in communication therewith. Optionally, any number of control connectors 12 may be positioned on the lamp housing 170. Exemplary control connectors 12 include, for example, plugs, conduit connectors, electrical buses and the like. As such, the control connector 12 may be configured to receive power, current, voltage, and/or control commands from an external control source (not shown). Optionally, the modular broadband light source 10 may be configured to communicate with at least one external control unit wirelessly.

In addition, at least one user interface device, display, and/or processor 40 may positioned on at least one housing panel 14. In the one embodiment, the processor 40 may be shown in the upper half of the housing panel 14. Optionally, the processor 40 may be located anywhere on the housing panel 14 or on any of the other panels of the lamp housing 170. In one embodiment, the processor 40 is configured to measure the cumulative run time of the modular broadband light source 10. As such, the processor device 40 may include at least one information display or user interface 42. In another embodiment, the information display 42 shows the optical power emitted by the lamp 470. In another embodiment, the information display 42 shows the operating temperature of the lamp 470. In another embodiment, the information display 42 shows the output radiation wavelength spectrum of the lamp 470. Optionally, the processor 40 may include one or more connectors configured to couple the processor device 40 to at least one external processor, power supply, network, sensor, adjoining lamp, analyzing device, controller, and the like. In another embodiment, the processor device 40 may be configured to communicate with at least one external processor, controller, and/or network wirelessly.

Figure 3:
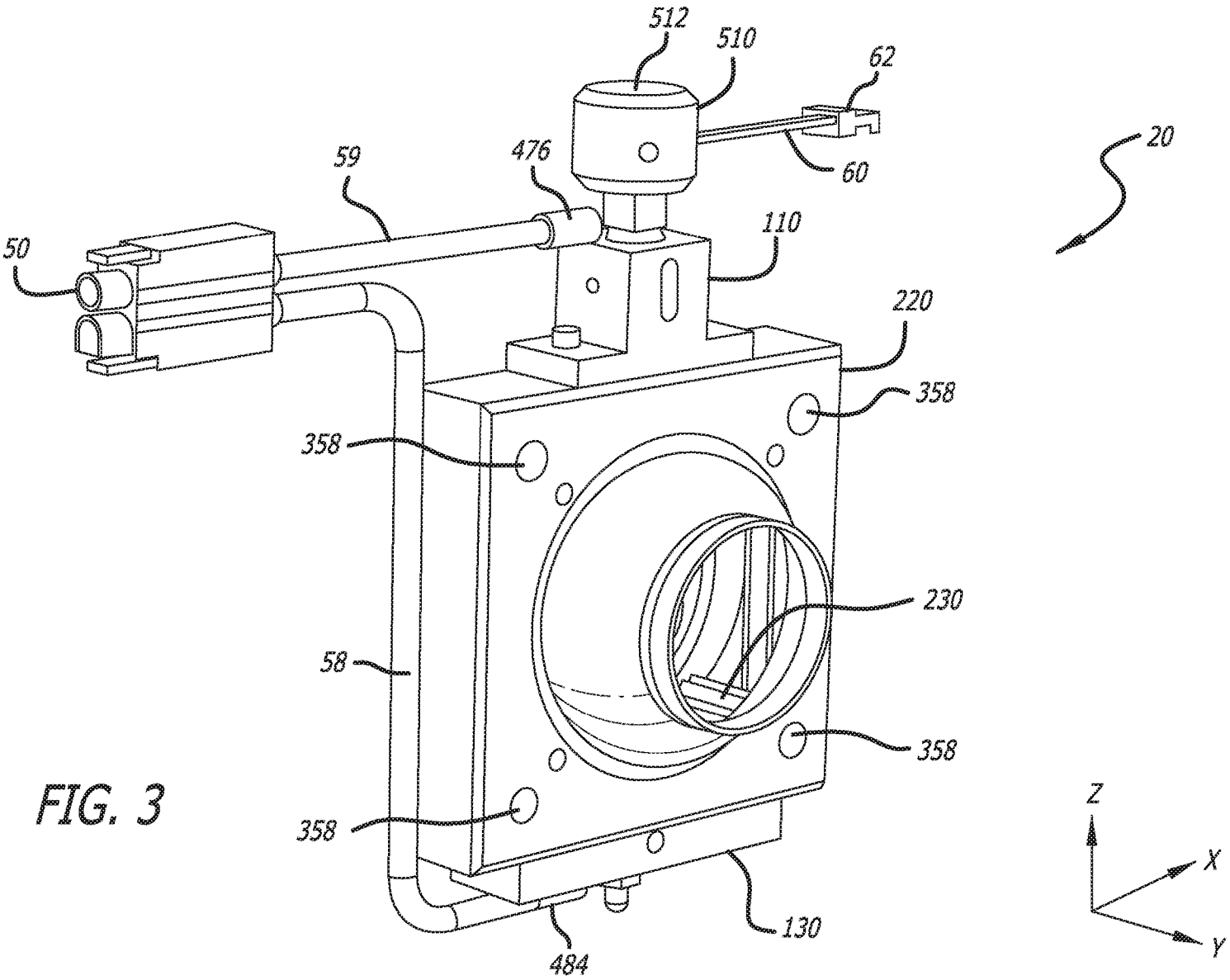
FIG. 3 shows a perspective view of an embodiment of a lamp body insert.
Figure 4B:
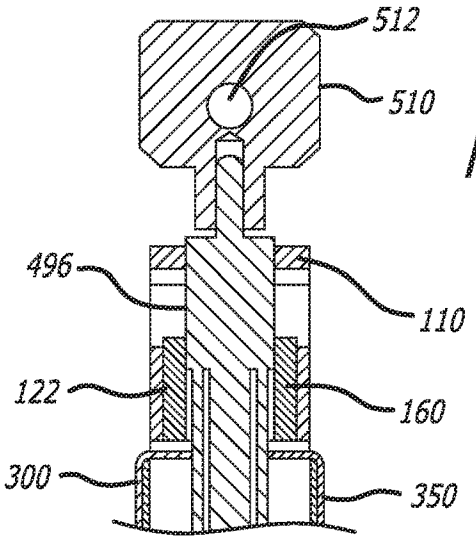
FIGS. 4A-4C show cross-section views of an embodiment of a lamp body insert.
Figure 4C:
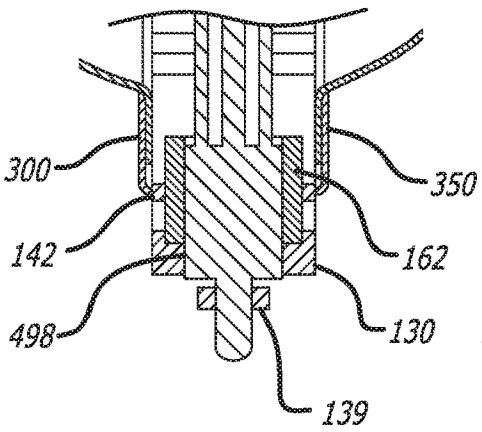
Figure 4A:
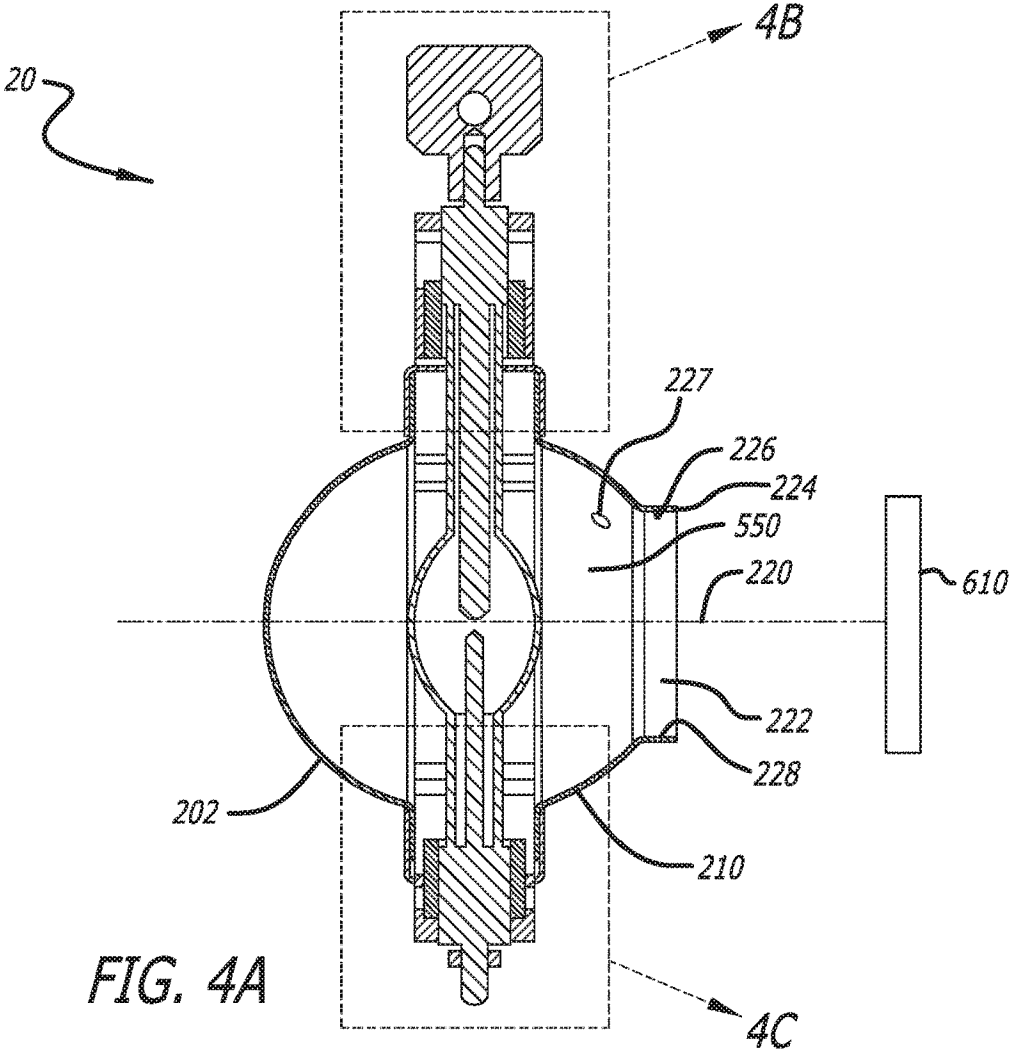
Figure 13:
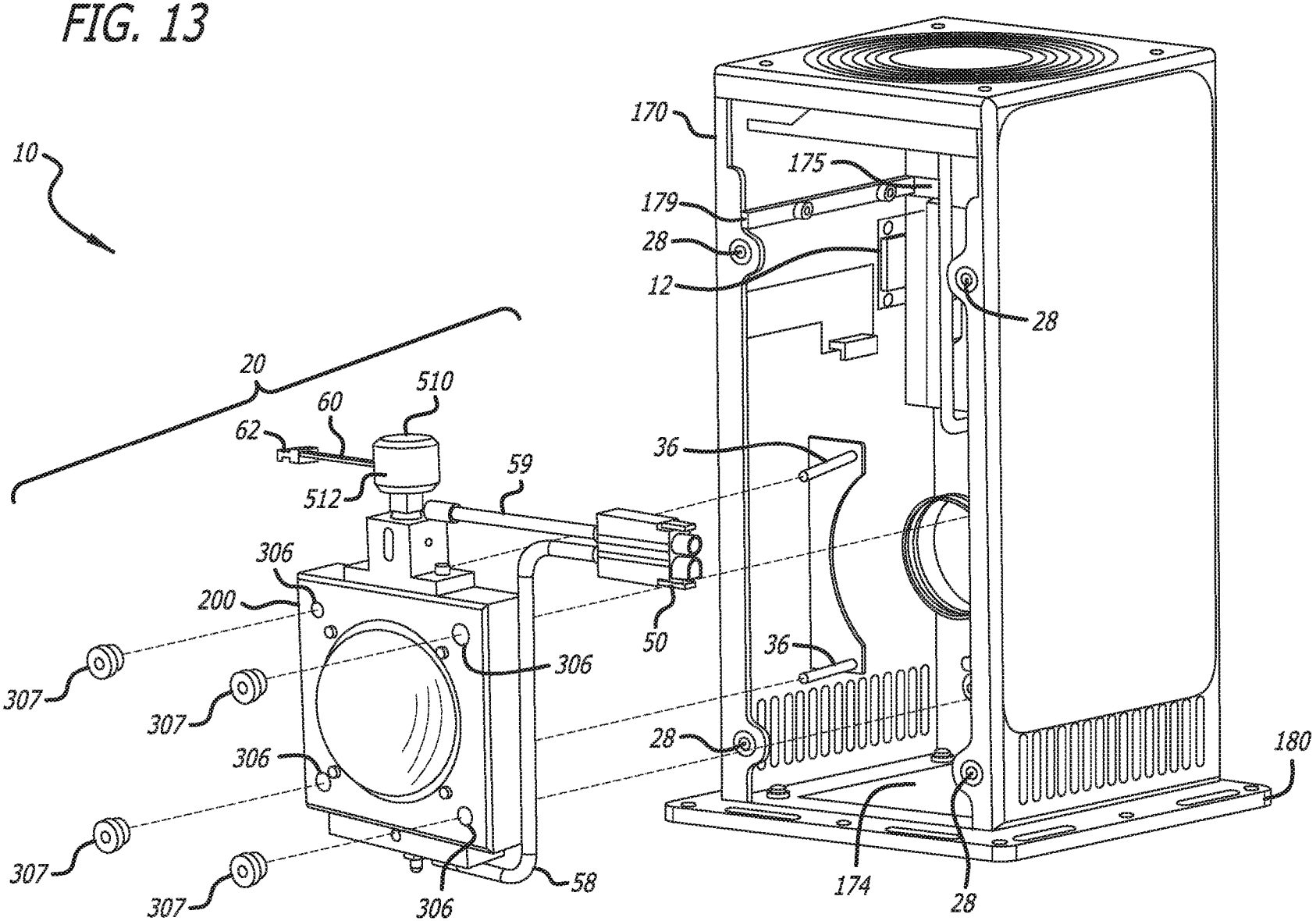
FIG. 13 shows an exploded perspective view of an embodiment of a lamp body insert and lamp housing.
Figure 14:
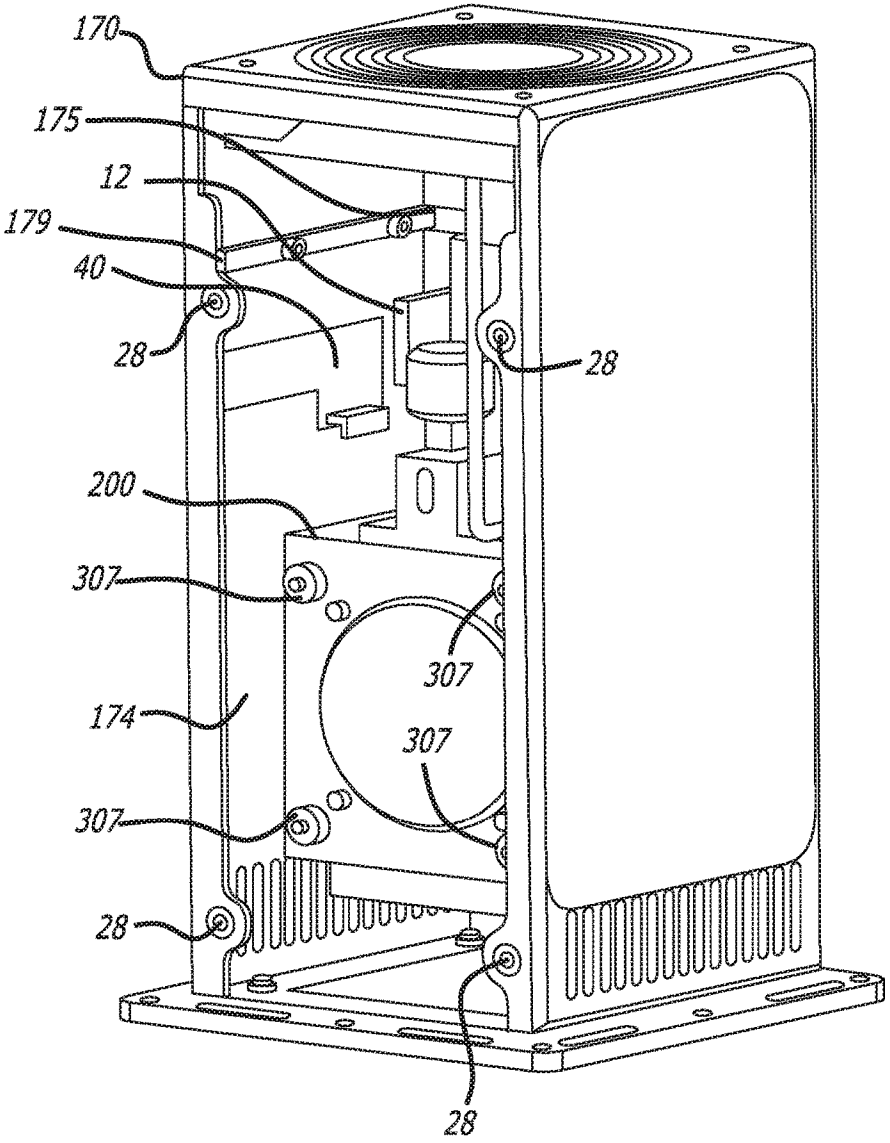
FIG. 14 shows a perspective view of an embodiment of a lamp body insert and lamp housing.
Figure 15:
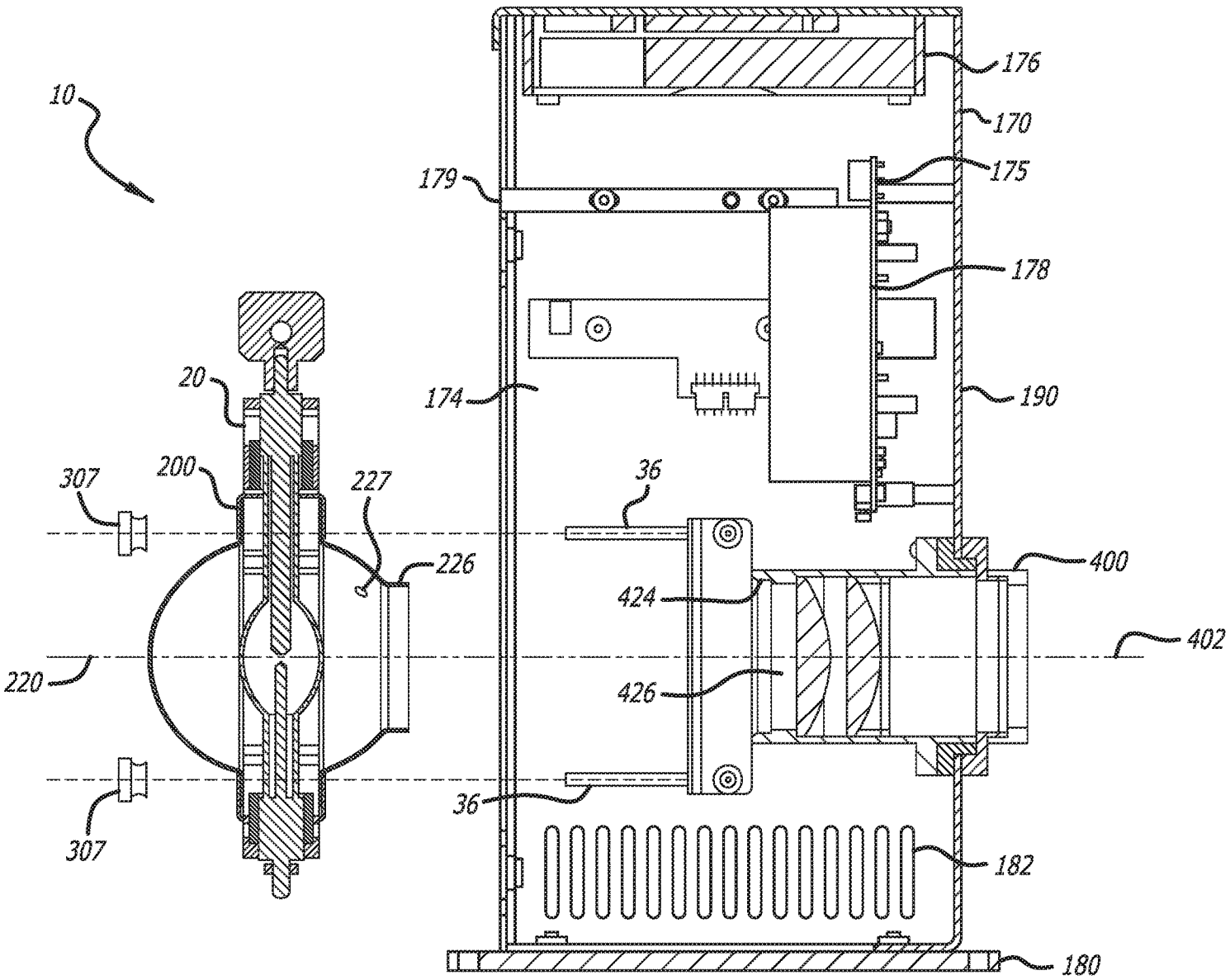
FIG. 15 shows an exploded section view of an embodiment of a lamp body insert and lamp housing.

FIGS. 3-8 show various views of the various components positioned on or otherwise coupled to an embodiment of a lamp body insert 20 for use with the modular broadband light source 10 shown in FIGS. 1A and 1B. Optionally, the lamp body insert 20 may be used with any variety of modular broadband light sources. As shown in FIG. 3, in one embodiment, the lamp body insert 20 includes at least one thermal managing assembly 200 configured to be coupled to the lamp housing 170 (See FIGS. 3, 13, 14, 15 and 18). For example, in the illustrated embodiment, the lamp body insert 20 may be detachably coupled to the lamp housing 170 with one or more insert fasteners 307 configured to engage at least one mounting member 36 fixed to or formed on the lamp housing 170 (See FIGS. 13-15). In the illustrated embodiment, the insert fasteners 307 are threaded fasteners. In another embodiment, the insert fasteners 307 need not be threaded fasteners. Optionally, the insert fasteners 307 can be bolts, quarter-turn fasteners, friction-fit devices, magnetic couplers, and the like.

FIGS. 3-8 and 13-15 show various views of the components positioned on or otherwise coupled to an embodiment of the lamp body insert 20 for use with the modular broadband light source 10 disclosed herein. As shown, one or more alignment members 36 may formed on or positioned in the body insert receiver 174. In one embodiment, the alignment members 36 are configured to engage at least a portion of the lamp body insert 20 (see FIGS. 13-15). More specifically, the ports 306 and 358 of the thermal managing assembly are configured to engage the alignment members 36 in the body insert receiver 174. More specifically, in one embodiment, the alignment members 36 are configured to ensure that at least a portion of the lamp 470 positioned within the thermal managing assembly 200 of the lamp body insert 20 is co-axially aligned with the optical system 400 coupled to the lamp housing 170 (See FIGS. 13-15 and 18). Optionally, the alignment members 36 may be used to further couple the lamp body insert 20 to the lamp housing 170.

FIG. 3 shows an embodiment of the lamp body insert 20 with at least one interface connector 50 in communication with at least one thermal managing assembly 200. Exemplary interface connectors 50 include, for example, plugs, conduit connectors, electrical buses, and the like. The interface connector may be configured to plug into at least one set of control/drive electronics 178 positioned in the lamp housing 170. As such, the components positioned on the lamp body insert 20 may be configured to receive power, current, voltage, analog, digital, radio frequency, and/or control commands from the lamp housing 170.

FIGS. 3 and 13-15 show various views of various components positioned or otherwise coupled to an embodiment of a lamp body insert 20. As shown in FIGS. 3 and 13-15, in the illustrated embodiment, one or more interface cables 58 and 59 may carry at least one electrical signal between the lamp body insert 20 and the control/drive electronics 178 shown in the lamp housing 170 of the broadband light source 10. The interface cable 58 may also carry at least one electrical signal between the interface connector 50 and at least one second lamp connector 484. The interface cable 59 may carry at least one electrical signal between the interface connector 50 and at least one first lamp connector 476. The power interface cable 59 may also carry at least one electrical signal between the interface connector 50 and at least one lamp sensor device 512. Optionally, at least one interface cable 60 may carry at least one electrical signal between the lamp sensor device and at least one signal connector 62. The signal connector 62 may be plugged into at least one control connector 70 (not shown) that may be installed in or connected to the lamp housing 170. As such, the interface cables 58, 59 and 60 may be configured to carry electrical signals such as power, current, voltage, analog, digital, radio frequency and/or control commands between the interface connector 50, the first lamp connector 476, the second lamp connector 484, and the lamp sensor device 512, and the signal connector 62. Optionally, the power interface cable 59 may carry electrical signals between the interface connector 50 and any other type of electrical device. When the lamp body insert is installed in the body insert receiver 174 in the lamp housing 170, the interface connector 50 may be connected to a mating connector 168 (not shown) located within the body insert receiver 174.

FIGS. 3-8 and 13-15 show various views of various components positioned on or otherwise coupled to an embodiment of a thermal managing assembly 200 with at least one lamp 470 disposed in at least one lamp receiving area 280 cooperatively formed by at least one first cartridge panel 300 and at least one second cartridge panel 350. In the illustrated embodiment, the first cartridge panel 300 may include at least one cartridge panel surface 302 having at least one opening 301 formed therein. At least one flange 310 may extend from the cartridge panel surface 302. At least one fastener port 305 may be formed on the cartridge panel surface 302. Optionally, any number of fastener ports 305 may be formed in the cartridge panel surface 302. As shown, the fastener ports 305 may be configured to receive at least one cartridge panel fastener 314 therein (see FIG. 5), the cartridge panel fasteners 314 being configured to couple at least one first sphere body or protective fixture 202 and the first cartridge panel 300 to at least one coupling bodies 230. At least one fastener passage 306 (see FIG. 3) may be formed in the cartridge panel surface 302 of the first cartridge panel 300. In the illustrated embodiment, four fastener passages 306 are formed in the cartridge panel surface 302. Optionally, any number of fastener passages 306 may be formed in any position in the cartridge panel surface 302. In another embodiment, the first cartridge panel 300 and the first protective fixture 202 may be formed from a single, monolithic piece of metal or other material.

FIGS. 3-8 show various views of various components positioned on or otherwise coupled to an embodiment of a thermal managing assembly 200. In the illustrated embodiment, at least one second cartridge panel 350 may be positioned proximate to at least one first cartridge panel 300 such that the first and second cartridge panels 300 and 350 cooperatively form at least one lamp receiving area 280. The second cartridge panel 350 may include at least one cartridge panel surface 352 having at least one opening 353 formed there through. At least one flange 370 may extend from the cartridge panel surface 352. In the illustrated embodiment, at least one fastener body 356 may be inserted through or may be formed on the cartridge panel surface 352. Optionally, any number of fastener bodies 356 may be inserted through or formed on the cartridge panel surface 352. As shown, the fastener bodies 356 may be configured to receive at least one of the coupling bodies 230. In the illustrated embodiment, the fastener bodies 356 may be captive studs that are fixed to the face 352 of the second cartridge panel 350.

FIGS. 3-8 and 13-15 show various views of various components positioned on or otherwise coupled to an embodiment of a lamp body insert 20. In the illustrated embodiment, at least one first protective fixture 202 is configured with at least one flange 206. One or more fastening ports 208 may be formed in the flange 206. In the illustrated embodiment, the first protective fixture 202 comprises at least one spherical surface 204. In one embodiment, the first protective fixture 202 comprises a spherical reflector. Optionally the first protective fixture 202 is only partially reflective or not reflective. Alternatively, the protective fixture 202 may be elliptical, planar, paraboloid, a parabolic cylinder or similar shape. Those skilled in the art will appreciate that other types of surfaces may be used for the first protective fixture 202. In the illustrated embodiment, the first protective fixture 202 is formed from of aluminum. Optionally, the first protective fixture 202 may be made of brass, bronze, glass, Zerodur or other materials. In another embodiment, the first protective fixture 202 and the first cartridge panel 300 may be formed from a single, monolithic, piece of metal or other material. The first protective fixture 202 may also be coated with gold, silver, thin film coatings, dielectric coatings, oxide coatings and the like.

FIGS. 3-8 and 13-15 show various views of various components positioned on or otherwise coupled to an embodiment of a thermal managing assembly 200. In one embodiment, at least one second sphere body or protective fixture 210 may be coupled to or otherwise positioned proximate to thermal managing assembly 200. The second protective fixture 210 may include at least one flange 214 and at least one surface 212. One or more fastening ports 218 are formed on the flange 214. Optionally, there may be no fastening ports on the flange 214. In the illustrated embodiment a small hole 227 may be located in the second protective fixture 210 (see FIGS. 4A-C, 6 and 13). Alternatively, the hole 227 may be formed in the first protective fixture 202 or in neither protective fixture 202 or 210. In one embodiment, the surface 212 of the second protective fixture 210 comprises a spherical reflector. Optionally, the surface 212 is only partially reflective or not reflective. Alternatively, the second protective fixture 210 may be spherical, elliptical, planar, paraboloid, a parabolic cylinder or similar shape. Those skilled in the art will appreciate that other types of surfaces may be used for the second protective fixture 210. In the illustrated embodiment, the second protective fixture 210 is formed from aluminum. Optionally, the second protective fixture 210 may be made of brass, bronze, glass, Zerodur or other materials. The second protective fixture 210 may also be coated with gold, silver, thin film coatings, dielectric coatings, oxide coatings and the like. The second protective fixture 210 may be formed in any variety of shapes, configurations, transverse dimensions, and may have the same alternative shapes, alternative materials and alternative coatings in any combination. In another embodiment, the second protective fixture 210 and the second cartridge panel 350 may be formed from a single, monolithic piece of metal or other material.

Figure 5:
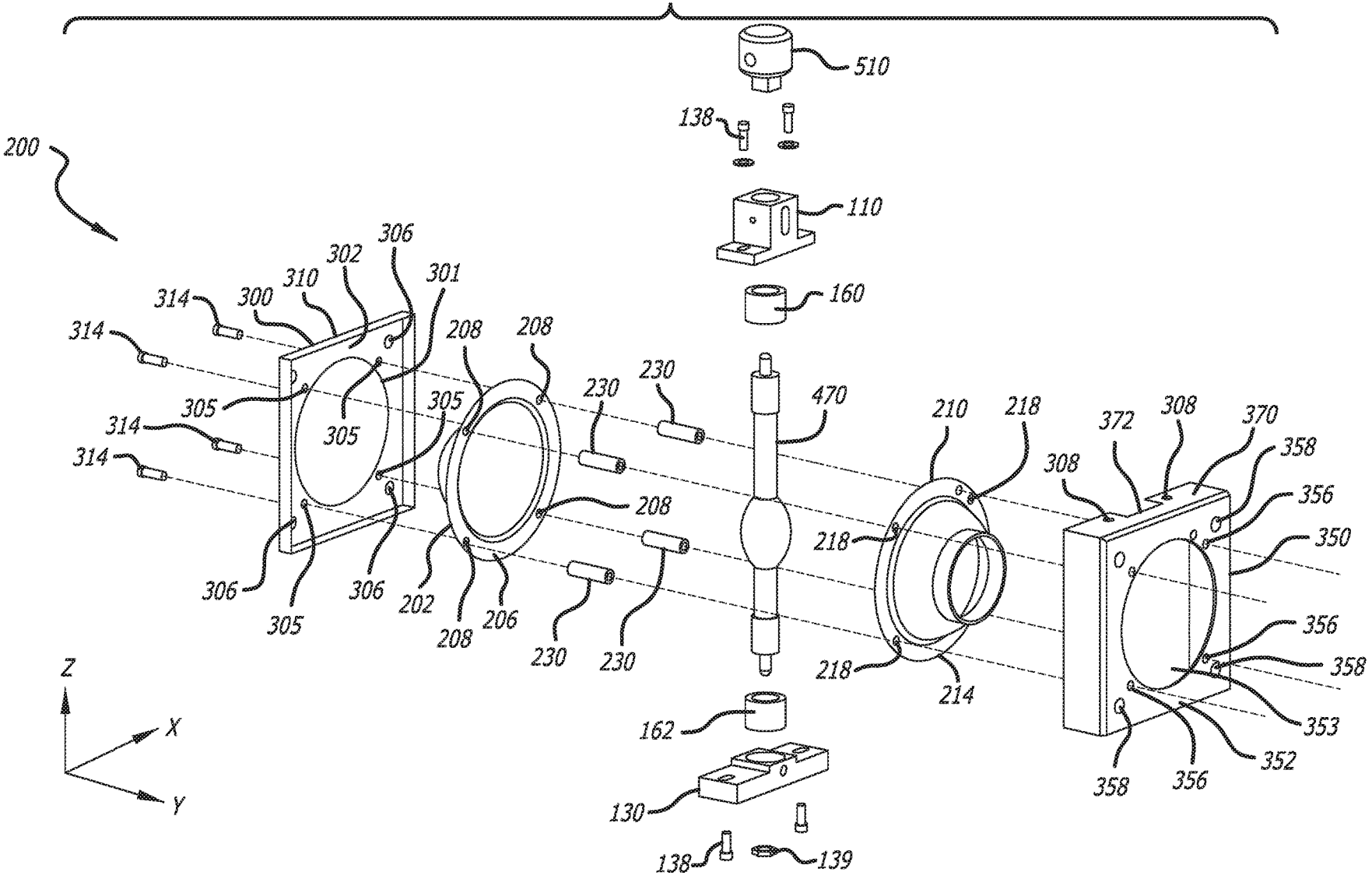
FIG. 5 shows an exploded perspective view of a thermal managing assembly.
Figure 6:
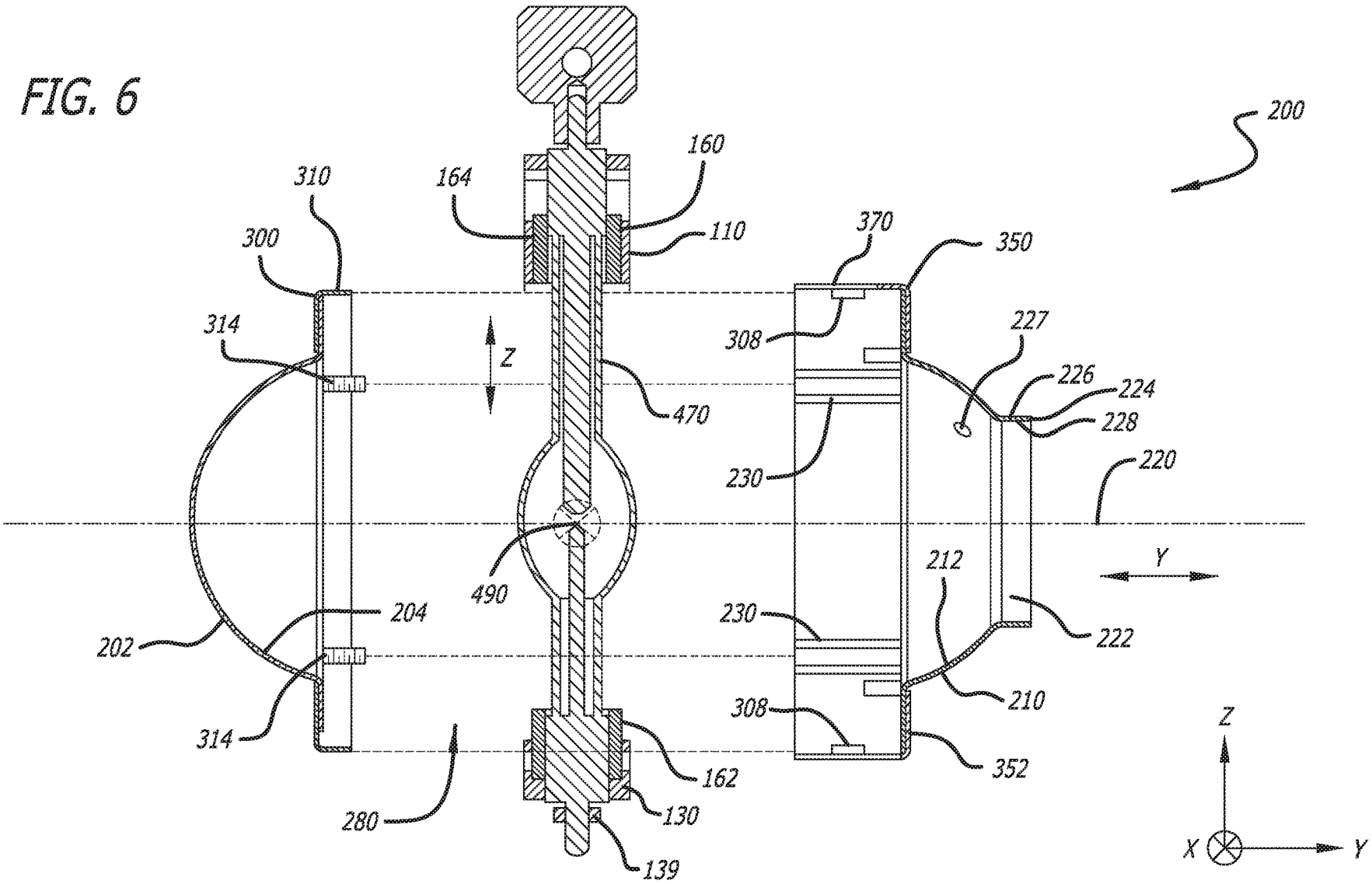
FIG. 6 shows an exploded section view of an embodiment of a thermal managing assembly.
Figure 7:
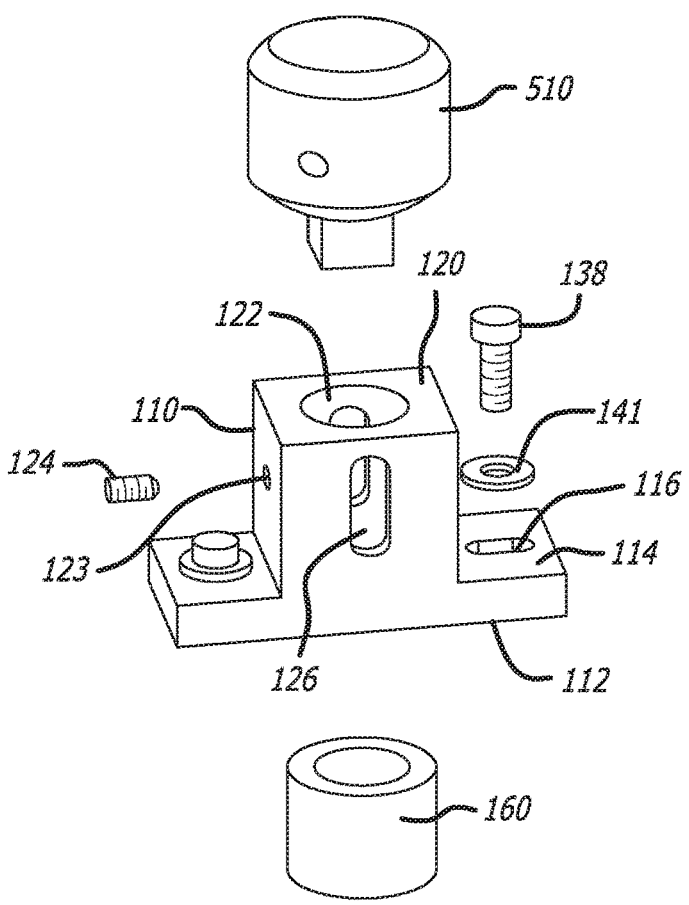
FIG. 7 shows an exploded perspective view of an embodiment of a first lamp mount.
Figure 8:
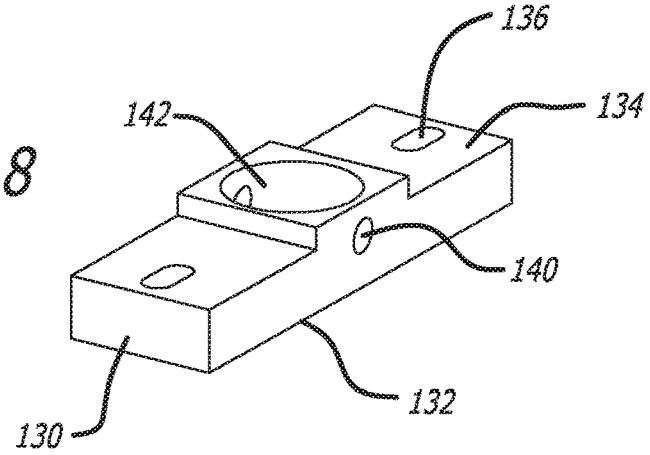
FIG. 8 shows a perspective view of an embodiment of a second lamp mount.
Figure 9B:
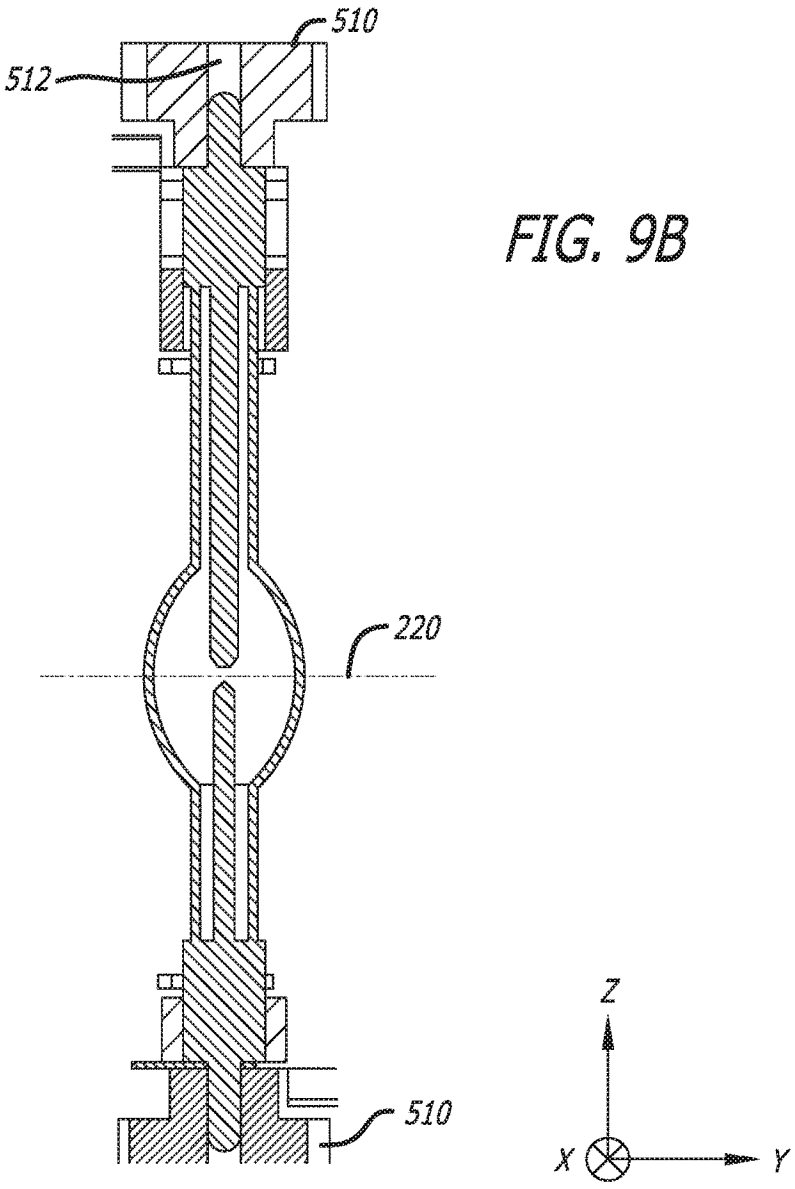
FIGS. 9A and 9B show an elevation view and a section view of an embodiment of an arc lamp assembly.
Figure 9A:
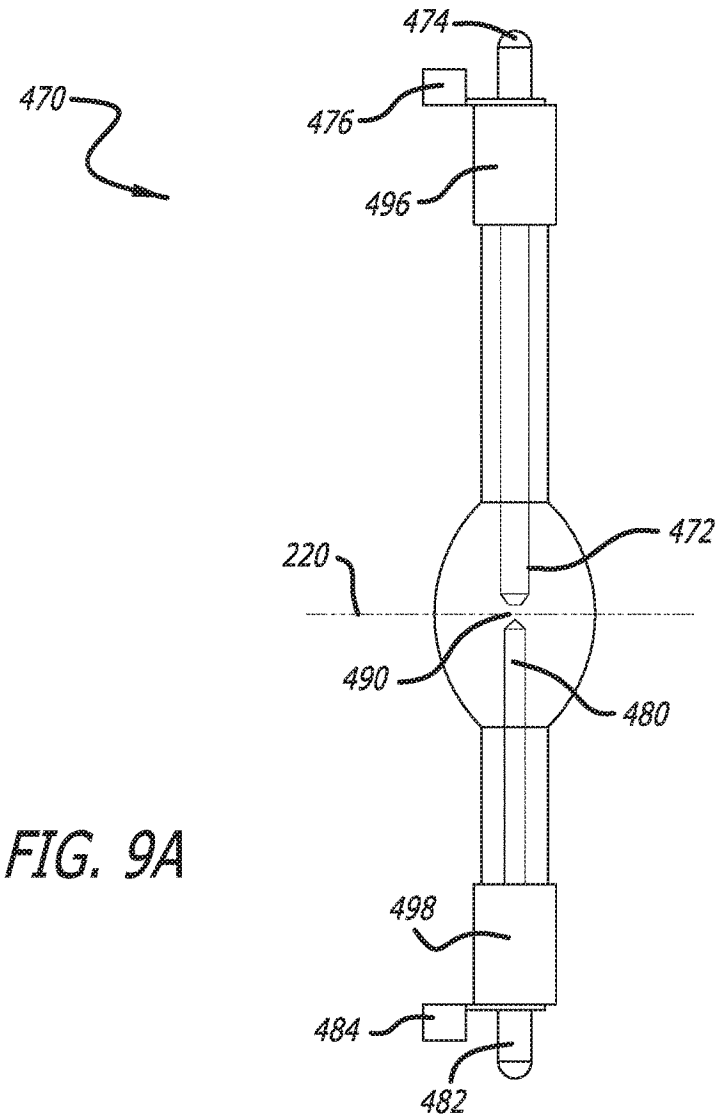

FIGS. 5 and 6 show various views of various components positioned on or otherwise coupled to an embodiment of a thermal managing assembly 200. In one embodiment, at least one cartridge panel fastener 314 may be configured to engage the coupling bodies 230 and couple the second protective fixture 210 to the second cartridge panel 350. In an alternative embodiment, the cartridge panel fasteners 314 may be configured to traverse through the fastener ports 356 formed on the second cartridge panel 350 and be securely retained within the fastener ports 305 formed on the first cartridge panel 300, thereby detachably coupling the second cartridge panel 350 to the first cartridge panel 300. At least one flange 370 having one or more one flange openings or features 372 formed therein may extend from the surface 352. In one embodiment, the flange opening 372 may be configured to receive at least a portion of the lamp assembly 470 therein. At least one fastener passage 358 may be formed in the cartridge panel surface 352 of the second cartridge panel 350. In the illustrated embodiment, four fastener passages 358 are formed in cartridge panel surface 352. Optionally, any number of fastener passages 358 may be formed in any position on cartridge panel surface 352.

FIGS. 5 and 13-15 show various views of various components positioned on or otherwise coupled to an embodiment of a thermal managing assembly 200. In one embodiment, fastener passages 306 may be formed in the first cartridge panel 300 and fastener passages 358 may be formed in the cartridge panel 350 that may be configured to be substantially coaxial to each other, allowing the alignment members 36 to traverse through the fastener passages 306 and 358 thereby coupling the lamp body insert 20 to the housing 170.

FIGS. 3-7 show various views of various components positioned on or otherwise coupled to an embodiment of a lamp body insert 20. In the illustrated embodiment, at least one first lamp mount 110 may be coupled to the flange 370 of the second cartridge panel 350. In the illustrated embodiment, the first lamp mount 110 may include a body 112 having at least one flange 114 formed thereon or coupled thereto. The flange 114 may include at least one fastener passage 116 formed thereon, the fastener passage 116 sized to receive one or more fasteners 138 and washers 141 therein or traversing therethrough. At least one lamp/insulator passage 122 may be formed within the body 112 (FIGS. 4A-C), the lamp passage 122 sized to receive at least a portion of at least one lamp 470 and or insulator 160 therein or traversing therethrough. In one embodiment, one or more fastener passages 123 may be formed in the body 112 and may be configured to receive at least one fastener 124. The fastener 124 may be used to exert a force on the interface surface 496 of the arc lamp 470, fixing it in place relative to the lamp mount 110. The lamp passage 122 may be configured to be positioned proximate to the flange opening 372 wherein at least one lamp 470 positioned within cartridge panel assembly 240 may extend through the lamp receiving area 280 and be coupled to the lamp mount 110. The lamp mounts 110 and 130 may be mounted to the flanges 370 of the second cartridge panel 350 using the fasteners 138 engaged with the coupling bodies 308 disposed or connected to the flange 370. Optionally, the lamp mounts 110 and 130 may be coupled to the flanges 370 of the first cartridge panel 300 without the coupling bodies 308. In the illustrated embodiment, the lamp mount 130 may include at least one lamp body 132 that may be configured with at least one flange surface 134 with at least one passage 136 formed therethrough. In the illustrated embodiment, the passages 136 may be configured to allow the fasteners 138 to be positioned therein and engage the coupling bodies 308 to fasten the lamp mount 130 to the cartridge panel 350. Alternatively, the lamp mount may be fastened to the first cartridge panel 300. In the illustrated embodiment, the lamp mounts 110 and 130 may be made from PTFE (Teflon). Optionally, the lamp mount may be made from dielectric or electrically insulating materials such as ceramic, phenolic, acetyl resin (Delrin), thermoplastic polymers, thermoset polymers, sintered plastics, composite materials and the like. Optionally, the lamp mounts 110 and 130 may be made from copper, brass, bronze, aluminum, steel, stainless steel, other metal alloys, and the like. Those skilled in the art will appreciate that the lamp mounts 110 and 130 may be made from any number of other materials.

FIGS. 4-6 and 15-18 show various views of various components positioned on or otherwise coupled to an embodiment of a lamp body insert 20. In the illustrated embodiment, the second protective fixture 210 may include at least one protective fixture outlet port 222 defined by at least one outlet port flange 224 with a first flange surface 226 and a second flange surface 228. The protective fixture outlet port 222 may define an optical axis 220. The thermal managing assembly 200 may include at least one lamp receiving area 280 formed therein, the lamp receiving area 280 configured to receive at least one lamp 470 therein.

FIGS. 3-9B show various views of various components positioned on or otherwise attached to an embodiment of a thermal managing assembly 200. In the illustrated embodiment, the thermal managing assembly may be configured to enable the adjustment of the lamp center 490 so that it substantially overlaps the optical axis 220 defined by the second protective fixture 210. The positions of the lamp mounts 110 and 130 may be adjusted in at least the X direction via one or more the fasteners 138, resulting in a change in transverse dimension of the lamp center 490 so that it substantially overlaps the protective fixture outlet port 222. The thermal managing assembly 200 may be configured to enable the adjustment of the lamp center 490 in the Z direction. For example, in one embodiment, the lamp center 490 of the thermal managing assembly 200 may be selectively adjusted so that it substantially overlaps the optical axis 220. The lamp 470 may be adjusted in the Z direction before being secured either the lamp mount 110 or the lamp mount 130. In one embodiment, at least one first insulating member 160 and at least one second insulating member 162 may be disposed between interface surfaces 496 and 498, respectively, of the lamp 470 and the lamp passages 122 and 142 of the lamp mounts 110 and 130 respectively. In one embodiment, the insulating members 160 and 162 may be cylindrical sleeves made from a thermally insulating dielectric material, although those skilled in the art will appreciate that the insulating members 160 and 162 may be manufactured in any variety of shapes, sizes, and configurations from any variety of materials. Optionally, the lamp 470 may be fixed in place in both lamp mounts 110 and 130. Optionally the lamp may be fixed to only one of the lamp mounts, 110 or 130. In the illustrated embodiment, the lamp mount 130 may be configured with a passage 140 configured to allow a bonding agent to be applied therethrough. In the illustrated embodiment, the insulating member 162 may be bonded to the lamp passage 142 with epoxy. Optionally, the insulating member 160 may be bonded to the lamp passage 122 of the first lamp mount 110 with epoxy. Optionally the insulating members may be fastened or bonded to the lamp mounts 110 and/or 130 with other fastening devices or processes (not shown). Once the lamp is adjusted to an optimized location, it may be fixed in place by a locking device 139 (see FIG. 6). Exemplary locking devices 139 are threaded fasteners, nuts, locking nuts, locking washers, and the like.

A variety of methods can be employed to adjust the performance of the modular broadband light source 10 by ensuring that the lamp center 490 and the optical axis 220 of the thermal managing assembly 200 are substantially co-aligned. In one embodiment, at least one optical measurement device 600 (see FIG. 18) may be placed in optical communication with the protective fixture outlet port 222. Exemplary optical measurement devices may include optical power meters, optical power sensors, optical spectrum analyzers, photo-spectrometers and the like. In a process known as "active alignment" the lamp 470 may be energized during the assembly process of the thermal managing assembly 200 and the optical measurement device 600 may be used to monitor the optical characteristics of light exiting the protective fixture outlet port 222. Exemplary optical characteristics may include optical power, optical wavelength and spectrum, polarization, coherence, among others. Mechanical adjustment of the positions of the lamp 470 using the methods described in the foregoing paragraphs can result in variations in the optical output characteristics, at which point the positions the lamp 470 and protective fixture outlet port 222 may be fixed relative to each other. Other methods to optimize or otherwise selectively adjust the performance of the modular broadband light source 10 include, without limitation, mechanical fixturing of all adjustable components parts, the use of fiducial markings on various components, or the manufacturing of component parts to very tight tolerances, resulting in very repeatable positioning of mechanical components, possibly obviating the need for either active or passive alignment. Those skilled in the art will appreciate that optimization or variation of the optical output characteristics of the modular broadband light source 10 may be achieved by using alternate mechanical designs and alternate methods for optical measuring.

FIGS. 4A-C and 13-15 show various views of the various components of an embodiment of a modular broadband lamp system 10. In one embodiment, during operation, at least one hole 227 may be formed in the second protective fixture 210 that may allow light to escape into the body insert receiver 174 of the lamp housing 170. This light may be configured to be incident upon least one detector 173 (not shown) that may be mounted on the lamp housing 170. The detector 173 may be configured to measure the cumulative run time of the lamp, the lamp output power, lamp output wavelength spectrum or other optical characteristics of the lamp 470. Alternatively, the detector may be used as a part of a safety interconnect system that prevents the opening of the lamp housing during operation of the lamp.

FIGS. 3-6 and 9A and 9B show various views of the components positioned on or otherwise coupled to an embodiment of the thermal managing assembly 200 for use with the lamp body insert 20 in the modular broadband light source 10 disclosed herein. In one embodiment, the lamp 470 may comprise an arc lamp. Those skilled in the art will appreciate that any variety of arc lamps may be used in various embodiments of the lamp 470, including, without limitations, Xenon arc lamps, Mercury arc lamps, Xenon-Mercury arc lamps, Deuterium arc lamps, Sodium arc lamps, Metal-halide arc lamps and Carbon arc lamps. Arc lamps generally operate at high pressures and are fragile. Physical damage to them may result in an explosion that presents a danger to handlers, shippers, receivers, installers and operators of the modular broadband light source 10. Referring again to FIGS. 4A-C, at least one lamp protection device 610 may be configured to prevent foreign matter or debris from entering the chamber 550 of the thermal managing assembly 200 and damaging the lamp 470. In the illustrated embodiment, the lamp protection device 610 may be cap or cover that is coupled to the protective fixture outlet port 222. In an alternate embodiment, the lamp protection device 610 may be detachably coupled to the protective fixture outlet port 222. The lamp protection device 610 is configured to be removed before the lamp body insert 20 is coupled to the lamp housing 170. Operation of the lamp 470 may generate thermal energy (heat) during operation. The thermal managing assembly 200 may be configured to extract heat from the arc lamp 470, permitting the temperature of the lamp 470 to be selectively controlled. Referring to FIGS. 9A-B, 16 and 17, the heat generated by the lamp 470 may be conducted from at least one first electrode 472 toward at least one first contact 474 and to at least one heat dissipation device 510. The heat generated by the arc lamp 470 may also conducted from at least one second electrode 480 toward at least one second contact 482 to at least one heat dissipation device 510. The heat dissipation device 510 may be manufactured from a variety of materials, including aluminum, copper, copper-tungsten, bronze, steel, stainless steel, sintered metals, ceramics and composite materials including encapsulated graphite, carbon nanotubes, graphene and the like. The heat dissipation device 510 may also comprise alternate thermal management devices such as heat pipes, heat spreaders, heat exchangers, thermoelectric coolers or any variety of active heat sink technologies. Heat dissipation devices may also be liquid or gas cooled heat exchangers using a variety of refrigerant materials. Those skilled in the art will appreciate that the heat dissipation device 510 may be made from a wide variety of different materials or use a wide variety of heat management technologies. The heat dissipation device 510 may also comprise at least one lamp sensor device 512 to sense at least one operating parameter of the lamp 470. In one embodiment, the lamp sensor device 512 may comprise a temperature sensor. Exemplary temperature sensors include devices such as thermistors, thermocouples, pyroelectric materials and the like for detecting the operating temperature of the lamp 470. In another embodiment, the lamp sensor device 512 may measure the electrical current supplied to the lamp 470. In another embodiment, the lamp sensor device 512 may measure the electrical voltage across the lamp 470. In other embodiments, the lamp sensor device 512 may measure any other operating characteristic of the lamp 470.

Figure 10:
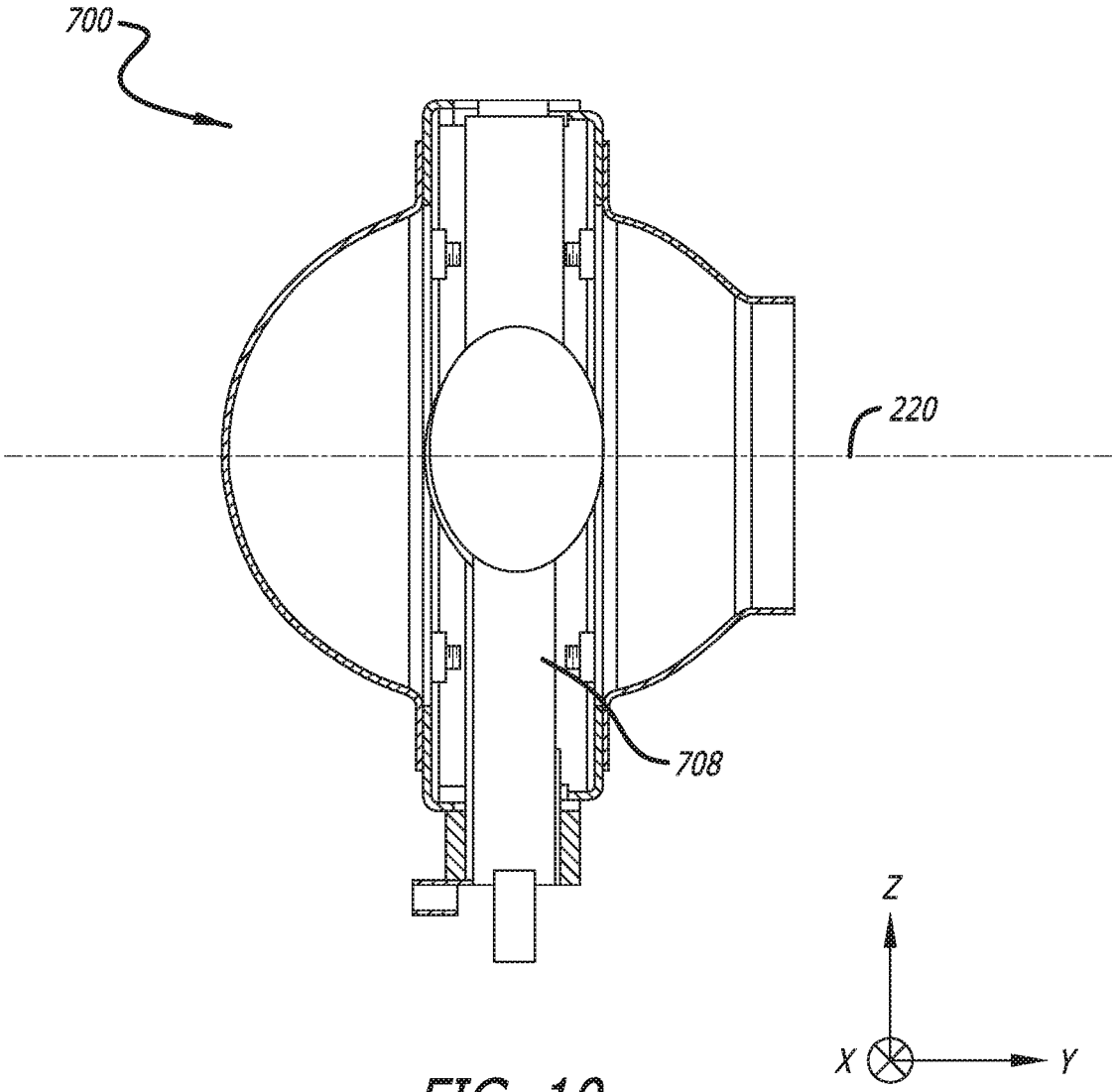
FIG. 10 shows a section view of an embodiment of an alternate thermal managing assembly with an incandescent lamp.
Figure 11:
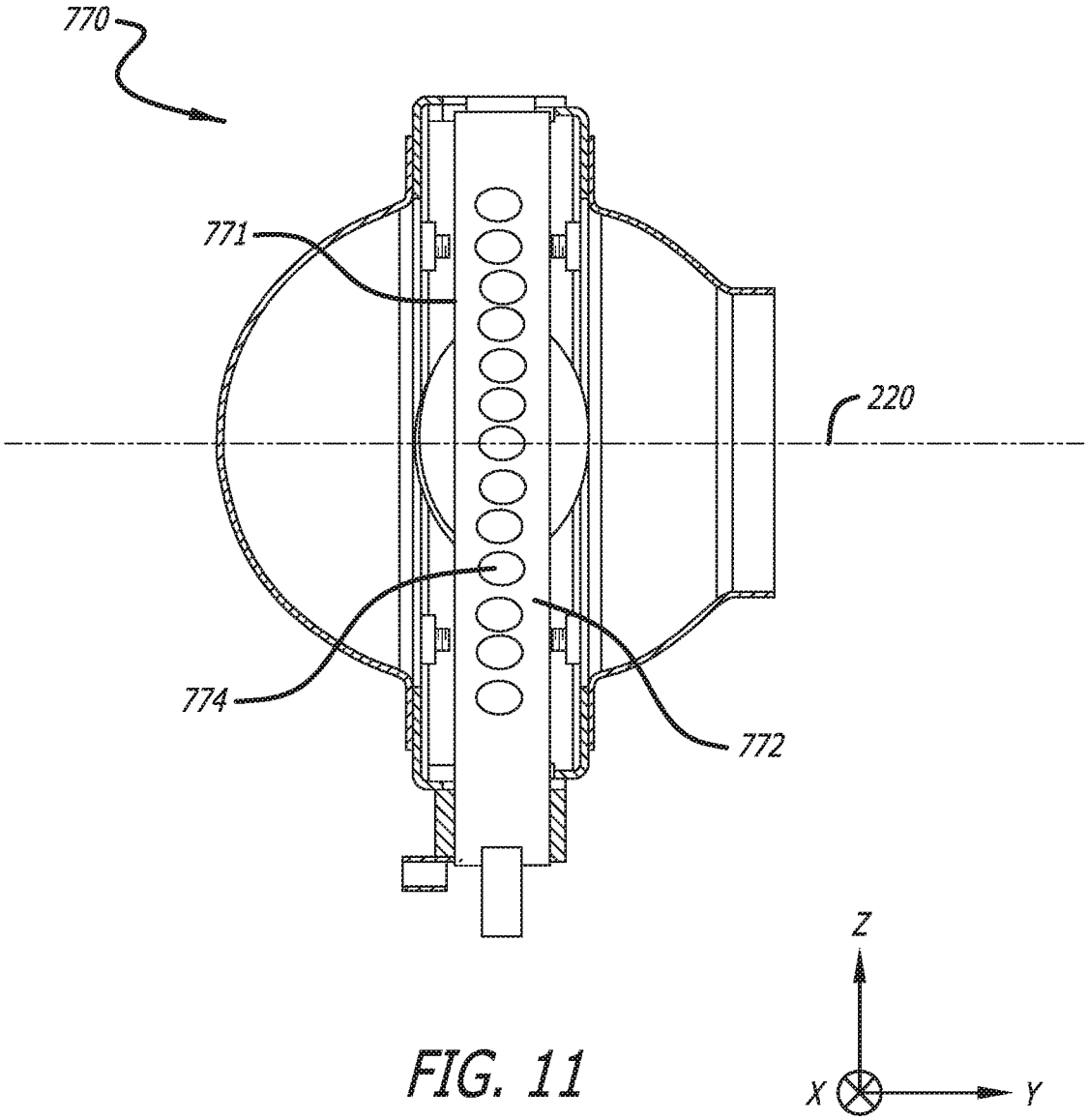
FIGS. 11 and 12 show section views of alternative embodiments of thermal managing assemblies with light emitting diodes.
Figure 12:
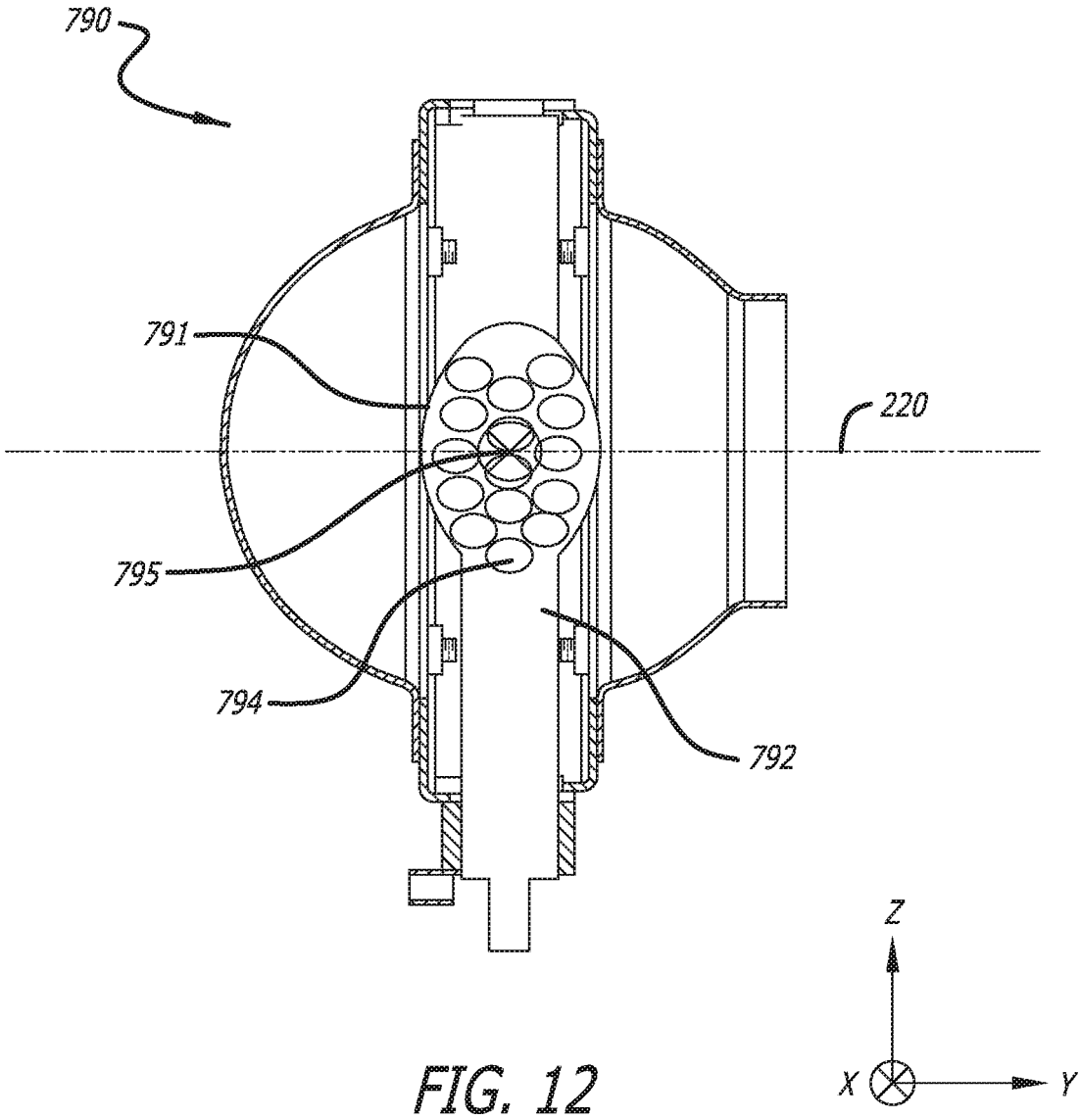

The modular broadband light source 10 shown in FIGS. 1A and 1B may include alternate illumination systems and devices in addition to arc lamps. For example, incandescent lamps such as Quartz-Tungsten Halogen (QTH) lamps are currently used in a variety of broadband light sources. LED lamps are also capable of useful broadband light generation. FIGS. 10-12 show various embodiments of alternate lamps for use in the modular broadband light source 10. FIG. 10 shows an alternate thermal managing assembly 700 that may be configured for use with at least one incandescent lamp 708. A significant portion of the lamp 708 may overlap the optical axis 220 of the thermal managing assembly 700. FIG. 11 shows an alternate thermal managing assembly 770 that may be used with at least one LED lamp 771 that may include at least one LED device 774 on at least one linear mount 772. At least one LED device of the LED lamp 771 may overlap the optical axis 220 of the thermal managing assembly 770. FIG. 12 shows an alternate thermal managing assembly 790 for use with at least one LED lamp 791 that may include at least one LED device 794 located in a generally oval pattern on at least one LED mount 792. The LED devices 794 may be positioned such that the aggregate light output is most intense at a point 795 that may overlap the optical axis 220. Optionally, the LED devices 794 may be located in many different ways in various geometries.

Figure 16:
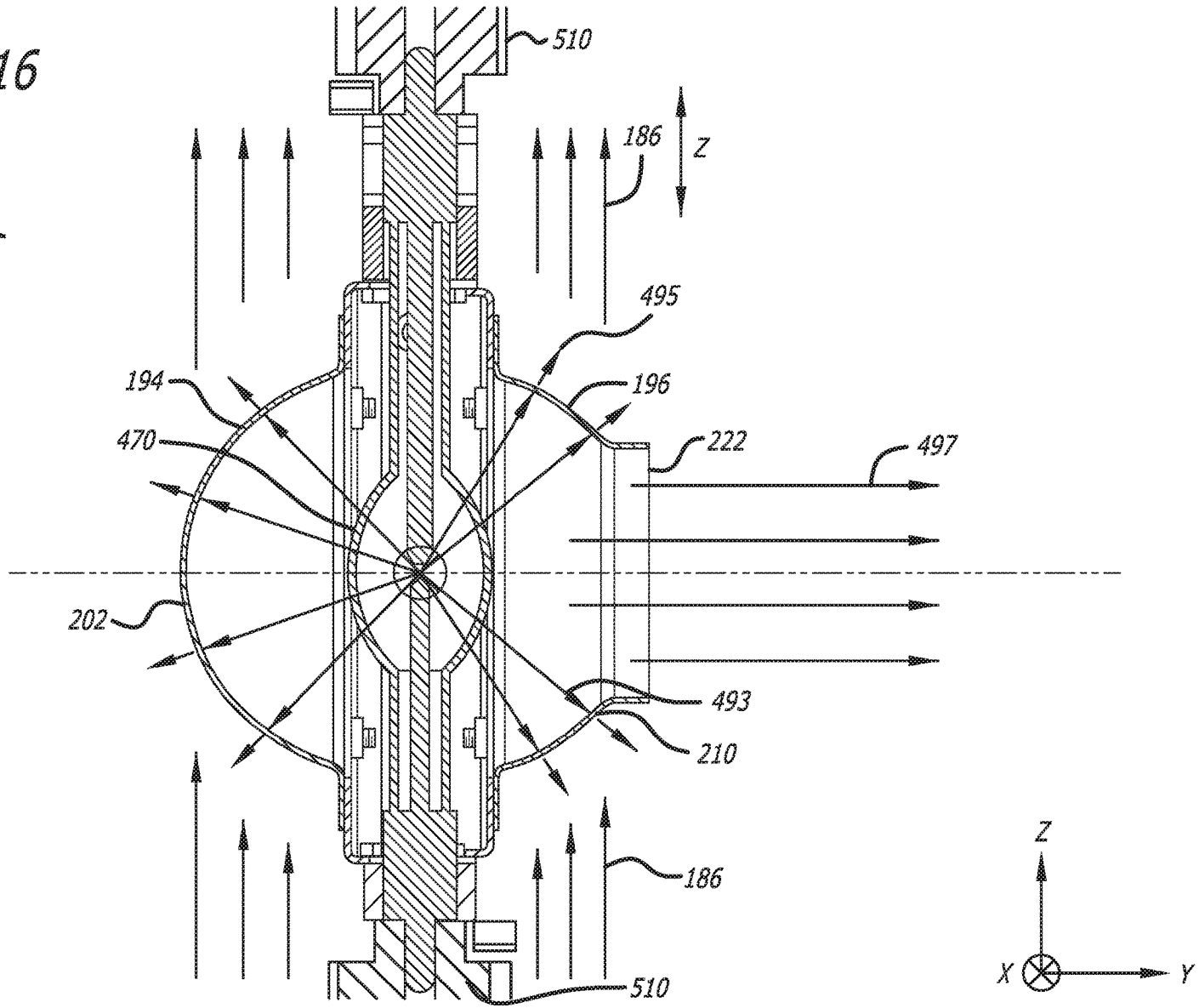
FIG. 16 shows a section view of the thermal managing assembly shown in FIGS. 3-8.
Figure 17:
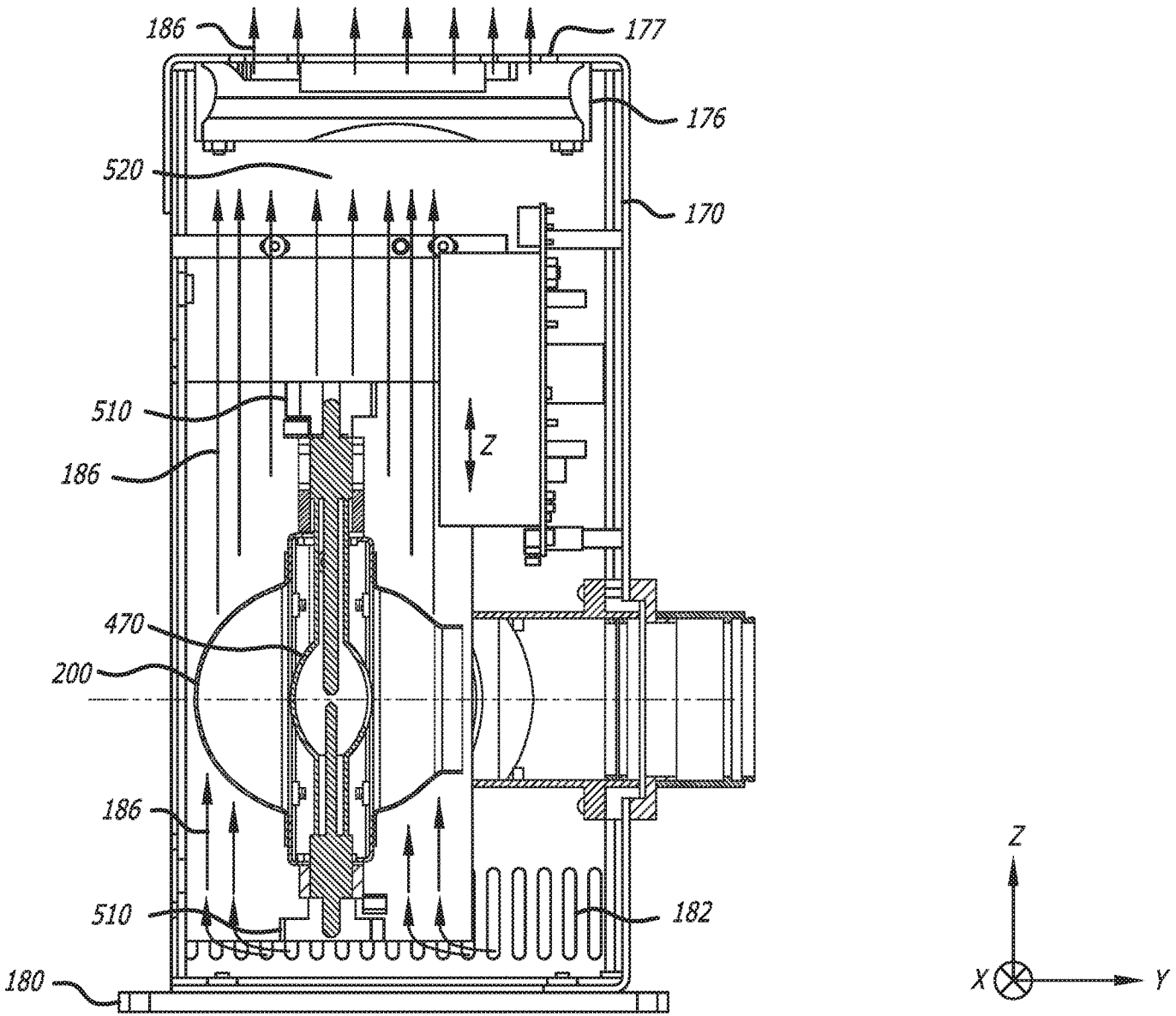
FIG. 17 shows a section view of an embodiment of a modular broadband light source with heat transfer visualized.

FIGS. 16 and 17 show various views of various components positioned on or otherwise coupled to the thermal managing assembly 200 or the lamp body insert 20 of the modular broadband light source 10. The thermal managing assembly 200 may be configured to provide removal of heat generated by the lamp 470 during use. Optical radiation 493 that may be generated by the arc lamp 470 may be incident on the inner surface of protective fixtures 202 and 210. A portion of the optical radiation 493 may be reflected by the protective fixtures 202, 210 and is directed out of the protective fixture outlet port 222 as reflected optical radiation 497. Some of the optical radiation 493 may be absorbed by the protective fixtures 202, 210 and then may re-radiate as heat 495 into the volume or compartment 520 that may surround the thermal managing assembly 200. At least one convection driver 176 may be configured to direct or evacuate at least one fluid 186 (for example, in the Z direction) around at least one of the outer surface 194 of the protective fixture 202 and the outer surface 196 of the protective fixture 210 of the thermal managing assembly 200. The fluid 186 located within the lamp housing 170 may absorb at least a portion of the heat 495 and may be directed through at least one convection port 177 that may be located at the top of the lamp housing 170 or through at least one convection port 182 that may be located proximate to at least one base 180. The fluid 186 may also flow over a heat dissipation device 510, possibly extracting additional heat generated by the arc lamp 470. Generally, the high intensity lamps that may be used with one or more embodiments of the thermal managing assembly 200 may benefit from precise temperature control to potentially extend the operating life of the lamps used in the lamp body insert 20. During use, the heat dissipation device 510 and/or the lamp sensor device 512 may transmit signals to one or more of the processor device 40, the controller/drive unit 178, the convection driver 176 or an external controller/processor. In one embodiment, the lamp sensor device 512 may send a signal that causes the convection drive 176 to turn on or off or operate at a variety of speeds to control the operating temperature of the lamps 470, 708, 771, 791 or any other configuration or type of lamp used in the. Optionally, other temperature control architecture may be used. As such, the thermal managing assembly 200 may be configured to act as a heat transfer device, possibly allowing the arc lamp 470 to be operated at high power without reducing its lifetime. In the illustrated embodiment, the fluid 186 may be ambient air. Optionally, the fluid 186 may be laboratory-grade "clean dry air" or an inert gas such as argon or helium. In the illustrated embodiment, the convection driver 176 may be a fan. Optionally, the convection driver 176 may be a vacuum generator. Optionally, the fluid 186 may be directed through the volume or compartment 520 from an externally-driven source. Optionally, the heat 495 may be transferred by natural convection or radiation.

Figure 18:
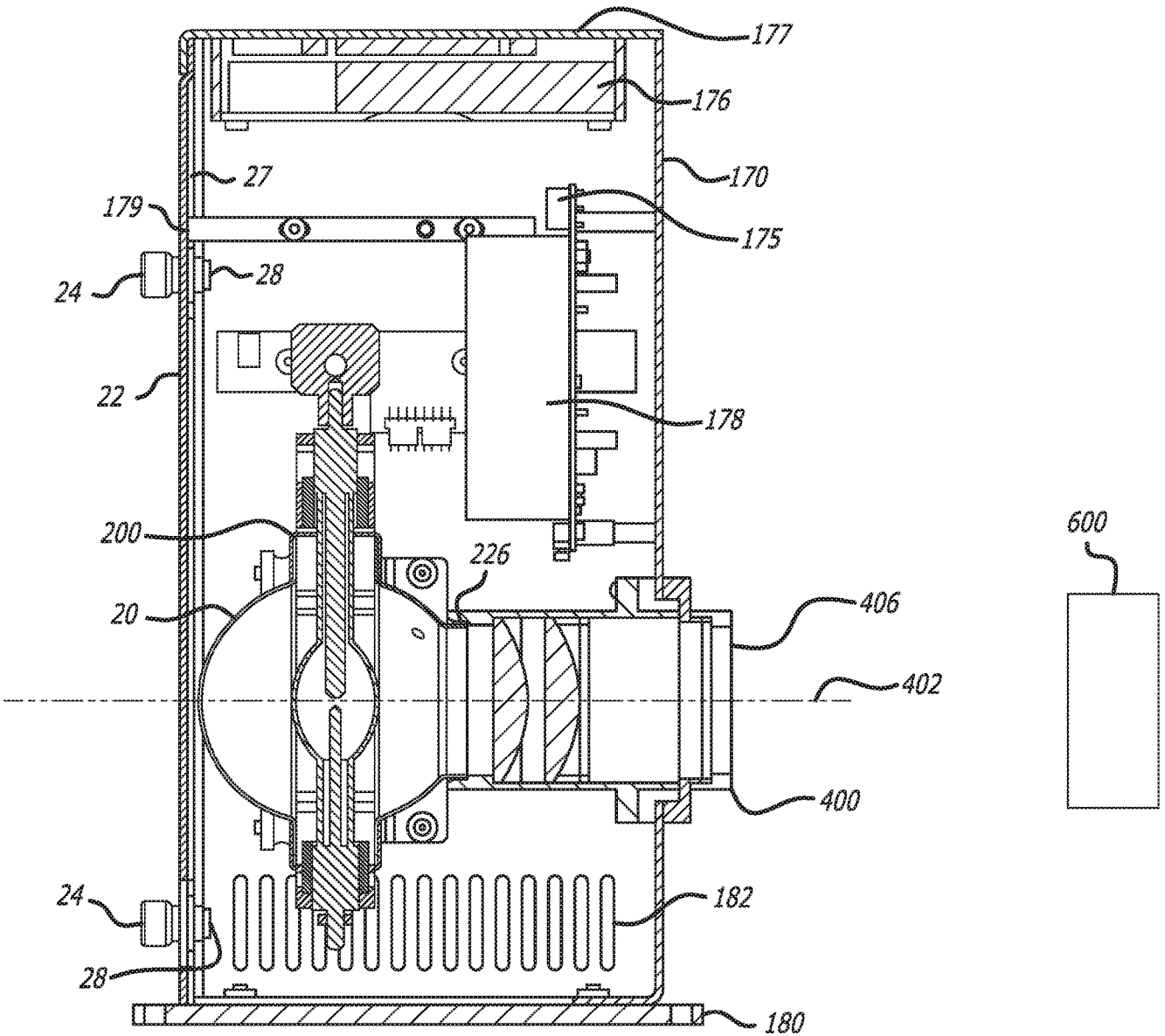
FIG. 18 shows a section view of an embodiment of a modular broadband light source.

FIGS. 13-15 and 17-18 show various views of the various components positioned on or otherwise coupled to an embodiment of a modular broadband light source 10. In the illustrated embodiment, the lamp body insert 20 may be fully inserted into and may be retained in the body insert receiver 174. At least one panel body 22 may be installed to fully enclose the modular broadband light source 10. The panel body 22 may be configured with fasteners 24 that engage the fastener receiving ports 28 that may be formed in the lamp housing 170. When the panel is installed, the fasteners 24 may be tightened to detachably couple the panel body 22 to the lamp housing 170. At least one surface 27 of the panel body 22 may engage at least one safety device 179 which may contact at least one safety sensor 175. In the illustrated embodiment, the safety sensor 175 may allow operation of at least one controller/drive unit 178. The controller/drive unit 178 may provide electrical energy for some or all of the operating functions of the modular broadband light source 10. When the panel 22 is detached from the body insert receiver 174, the safety device 179 may disengage from the panel body 22 and break contact with the safety sensor 175. If contact with the safety device 179 is broken, electrical power to the lamp body insert 20 may be terminated. As such, the safety device 179 and the safety sensor 175 may act as a safety interlock that reduces the chance of damage or injury to personnel that operate the modular broadband light source 10. Those skilled in the art will appreciate that other types of safety devices and interlocks can be incorporated into the functions of the modular broadband light source 10. FIG. 18 shows a sectional view of the lamp body insert 20 engaged within the body insert receiver 174 of the lamp housing 170. The first flange surface 226 of the protective fixture 210 may engage with the aligning surface 424 of the optical system 400, allowing the optical axis 220 of the lamp body insert 20 and the optical axis 402 of the output port 406 to be substantially co-aligned. Optionally, the optical axis 220 and 402 may not be co-aligned. Optical output from the lamp 470 may be transmitted through the optical system 400 and exit the outlet port 406.

Figure 19:
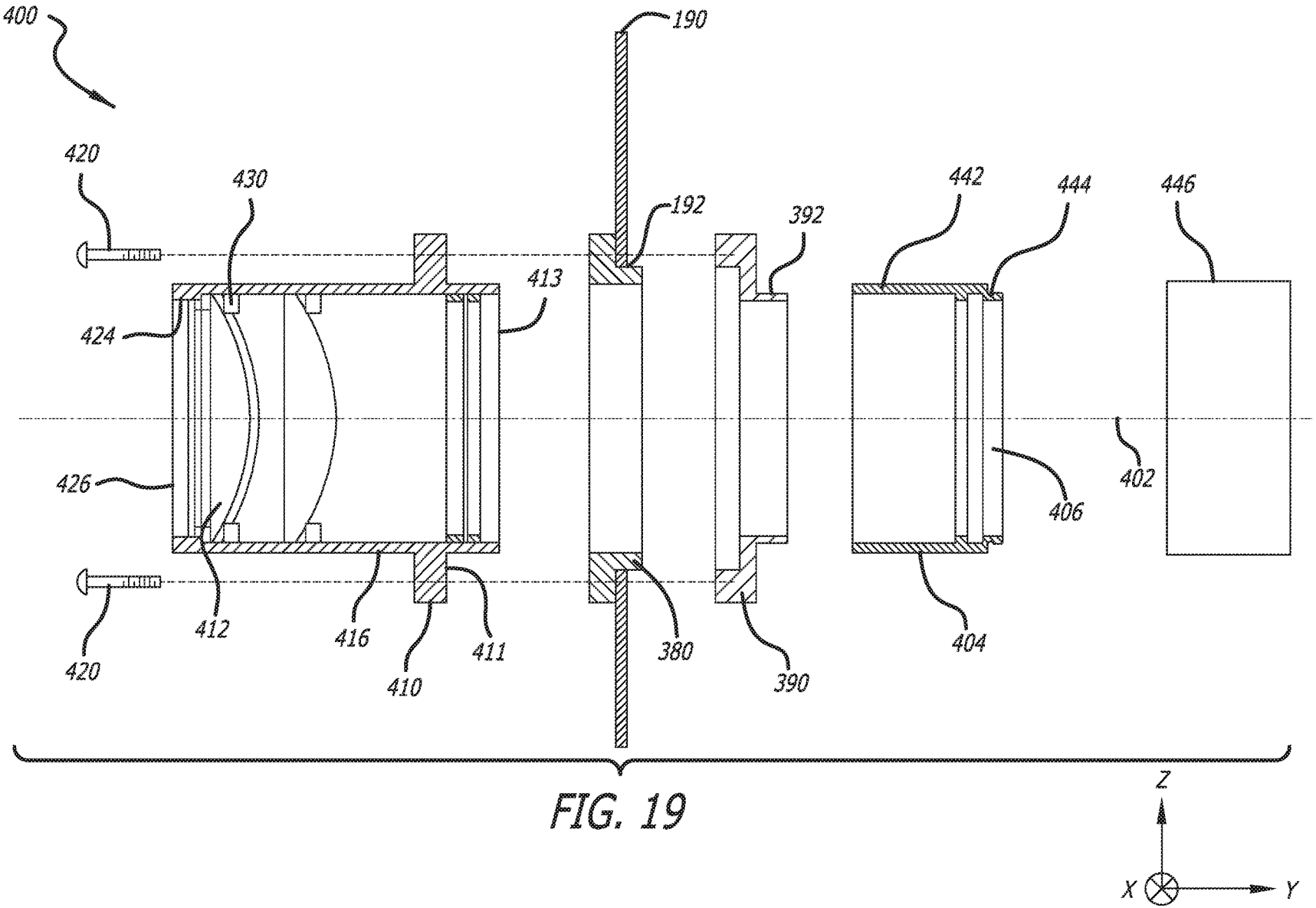
FIGS. 19 and 20 show section views of an embodiment of an optical system.
Figure 20:
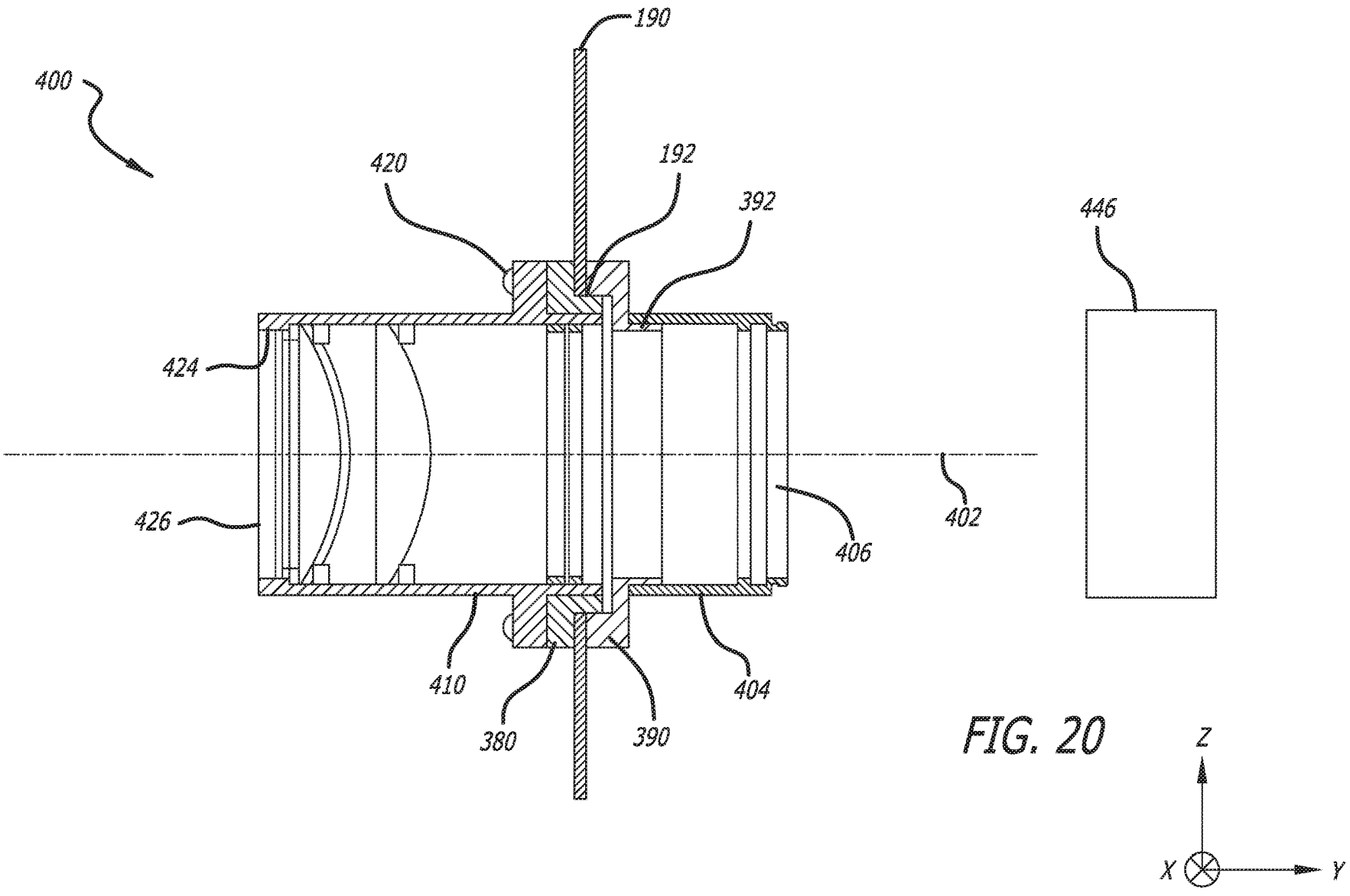

FIGS. 18-20 show various views of various components positioned on or otherwise coupled to an embodiment of an optical system 400 for use with the modular broadband light source 10 shown in FIGS. 1A and 1B. In one embodiment, the optical system 400 may be coupled to the lamp housing 170 and may be in communication with the body insert receiver 174 via at least one receiving port 192 that may be formed in at least one housing panel 190. The optical system 400 may be configured to modify and/or condition the reflected optical radiation 497 that may be emitted from the thermal managing assembly 200. In the illustrated embodiment, the optical system 400 may include at least one optical subsystem 410 defining an optical axis 402. The optical subsystem 410 may be configured with at least one port 426 and at least one surface 424 that may engage coaxially with the first flange surface 226 of the outlet port flange 224 of the protective fixture 210 such that the optical axis 220 of the protective fixture 210 may substantially overlap optical axis 402 of the optical system 400. The optical subsystem 410 may be configured with at least one optical element 412 disposed therein and retained by at least one retaining device 430. As shown in FIGS. 18 and 19, at least one internal adapting device 380 may traverse through the port 192 of the housing panel 190. The subsystem 410 may traverse through the internal adapting device 380. At least one coupling body 420 may traverse through at least one flange 411 of the optical subsystem 410 and may engage with at least one external adapting device 390 to detachably couple the optical subsystem 410 to the housing panel 190. Optionally, the optical subsystem 410 may include one or more internal and/or external threads that may engage with mating threads of the internal adapting device 380, the external adapting device 390 and/or at least one system adapting device 404. As shown in FIGS. 14 through 19, the optical system 400 may be fixed relative to the housing panel 190 of the housing 170 and relative to the thermal managing assembly 200. Optionally, the optical system 400 may be configured to move relative to the housing 170 and the thermal managing assembly 200. The optical subsystem 410 may be configured to be detachably coupled to the housing panel 190 from the interior of the housing 170. Optionally, the optical subsystem 410 may be configured to be detachably coupled to the housing panel 190 from the exterior of housing 170.

Referring again to FIGS. 18-20, the system adapting device 404 may be used to connect the broadband light source 10 to at least one external optical system 446. In the illustrated embodiment, at least one interior surface 442 of system adapting device 404 may mate with at least one exterior surface 392 of the external adapting device 390. Those skilled in the art will appreciate that the interior surface 446 of system adapting device 404 may be coupled to the exterior surface 392 of external adapting device 390 in a variety of ways, including threads, friction fits and the like. At least one adapting surface 444 of the system adapting device 404 may be configured to detachably couple to the external optical system 446 in optical and mechanical communication with the modular broadband light source 10. Exemplary external optical systems 446 are light tubes, light shields, spacers, optical mounts, optical cage systems, optical couplers, beam turning mirrors, shutters, apertures, irises, lenses, filters, and the like. The optical subsystem 410 may be configured with at least one sleeve 416 defining at least one outlet port 413 and at least one optical axis 402 with one or more optical elements 412 disposed therein. Exemplary types of optical elements 412 include, without limitations, lenses, filters, waveplates, mirrors, and the like. Exemplary lenses include, without limitations, plano-convex lenses, biconvex lenses, plano-concave lenses, biconcave lenses, aspheric lenses, meniscus lenses, cylindrical lenses, Fresnel lenses, gradient index lenses, axicon lenses, superlenses and any combinations thereof. The optical elements 412 may be retained by one or more retaining members 430. Those skilled in the art will appreciate that multiple combinations of the optical elements 412 described herein may comprise the optical subsystem 410. In the illustrated embodiment, the optical elements 412 may not move relative to each other. Optionally, the optical subsystem 410 may comprise multiple sleeves and mechanisms that allow multiple optical elements to move relative to each other and/or relative to the thermal managing assembly 200.

Figure 21:
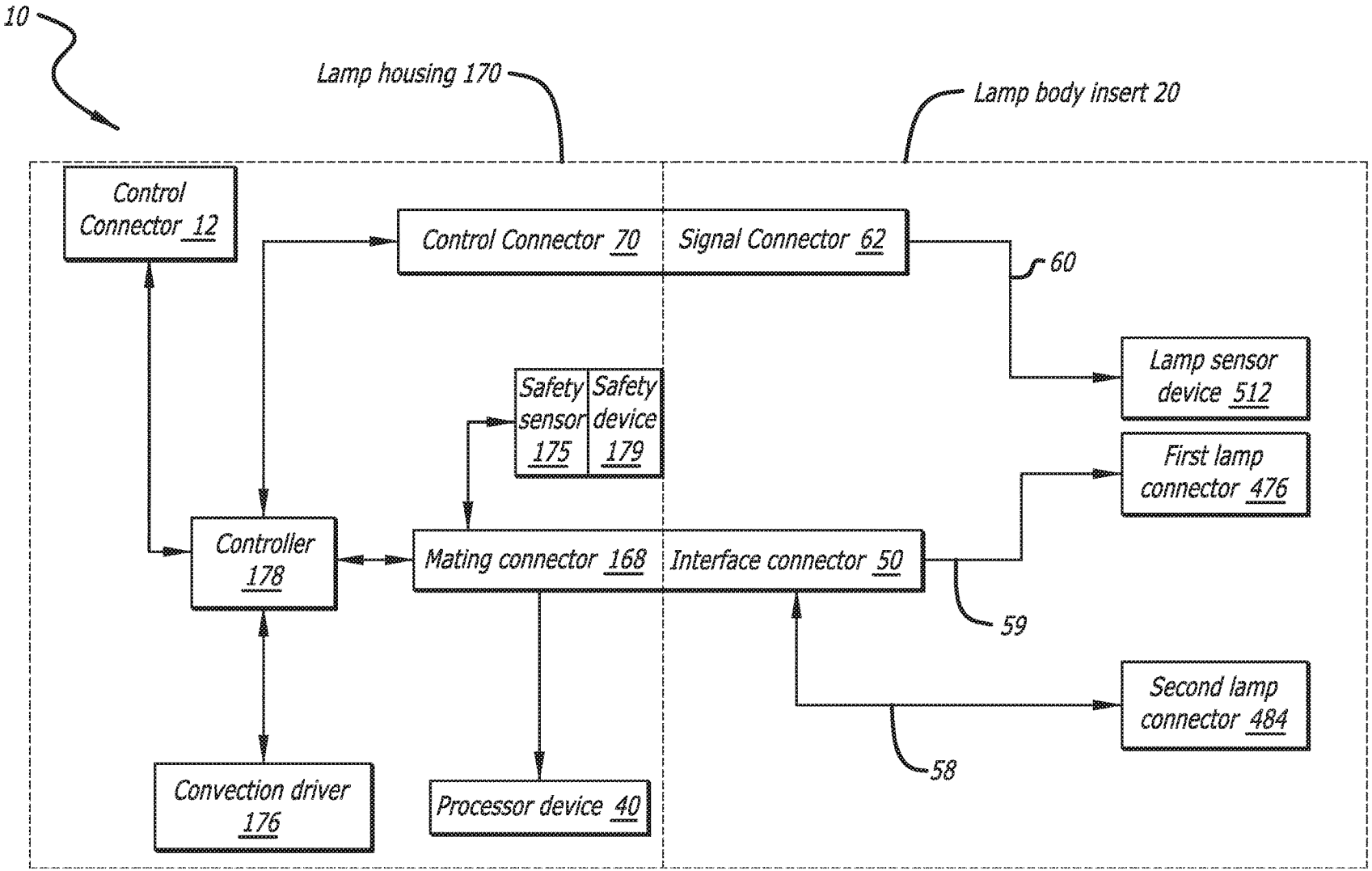
FIG. 21 shows a control schematic of an embodiment of the modular broadband light source.

FIG. 21 shows a control schematic of an embodiment of a modular broadband light source 10. As shown, certain components may be located on the lamp housing 170 or the lamp body insert 20. In the illustrated embodiment, at least one interface connector 50 may be in communication with at least one of the first lamp connector 476 and/or at least one second lamp connector 484. Further, at least one lamp sensor device 512 may be in communication with at least one signal connector 62 or the interface connector 50 by at least one interface cable 60. In the illustrated embodiment, the interface connector 50 and the signal connector 62 of the lamp body insert 20 or connected to at least one control connector 70 and/or at least one mating connector 168, respectively, may be located on the lamp housing 170. Alternatively, all interface cables 58, 59, 60 of the lamp body insert 20 may be in communication with the interface connector 50 only. In the illustrated embodiment, in the lamp housing 170, at least one of the control connector 70 and at least one mating connector 168 may be in communication with at least one of the control connector 12, the processor device 40, the controller 178, and/or the convection driver 176. Alternatively, the control connector 12, the processor device 40, the controller 178 and the convection driver 176 may be in communication with the lamp body insert 20 via the mating connector 168 only. Also shown are at least one safety device 179 and at least one safety sensor 175, the function thereof is described in the paragraphs above. The control connector 12 may be in communication with an external device (not shown) that provides one or more power signals and/or one or more control signals. Those skilled in the art will appreciate that there are many configurations of schematics that might be employed for use with the modular broadband light source 10.

The embodiments described above are illustrative of a modularity scheme for the design of a modular broadband light source 10. Like the embodiments shown above, the embodiments disclosed below for a modular broadband light source 1010 illustrate an alternate modularity scheme that may provide features and benefits suited to different applications and performance requirements. While similarly named elements perform similar functions, the various systems and sub-systems described below provide for differing levels and configurations of modularity that may be employed by the user of the modular broadband light source 1010.

Figure 22:
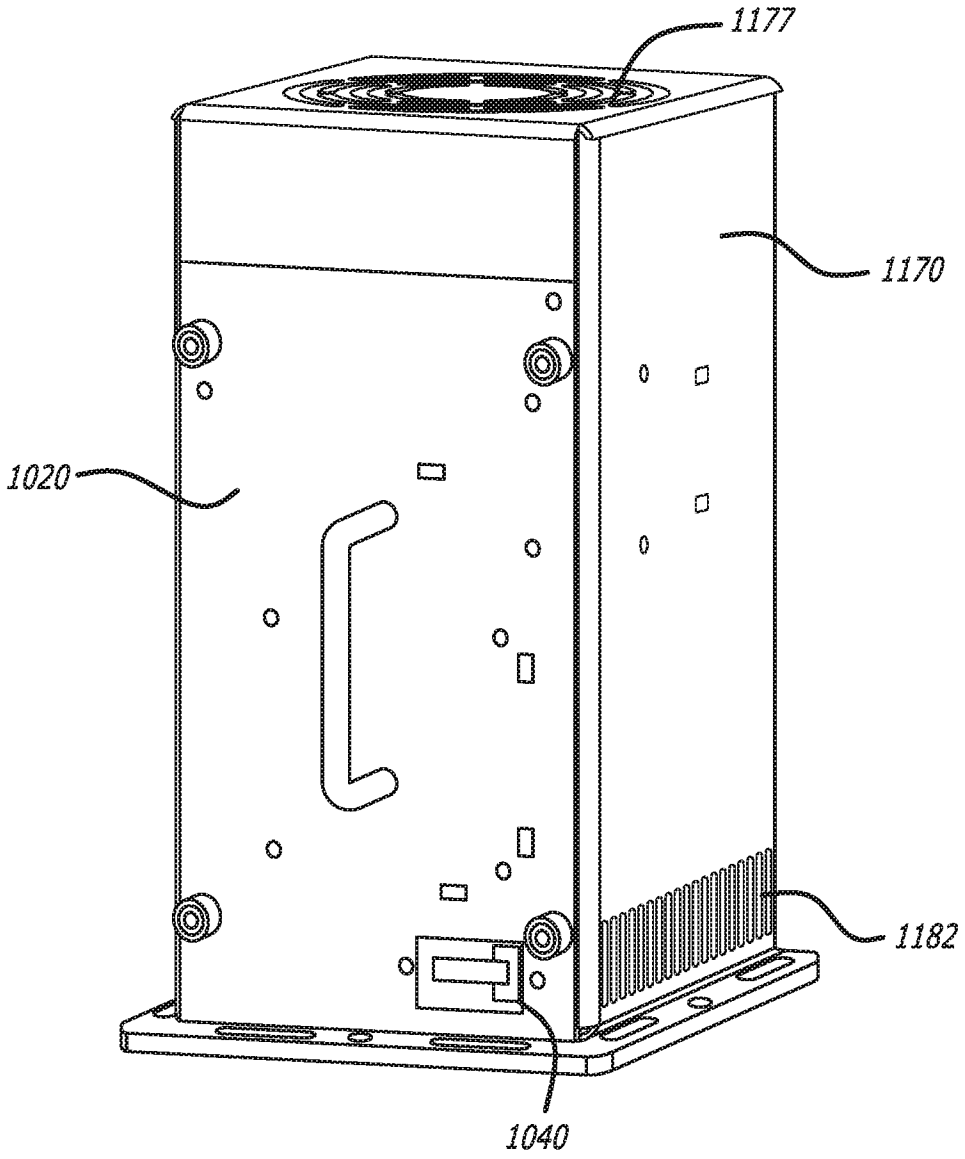
FIG. 22 shows an elevated perspective view of an embodiment of a modular broadband light source.
Figure 23:
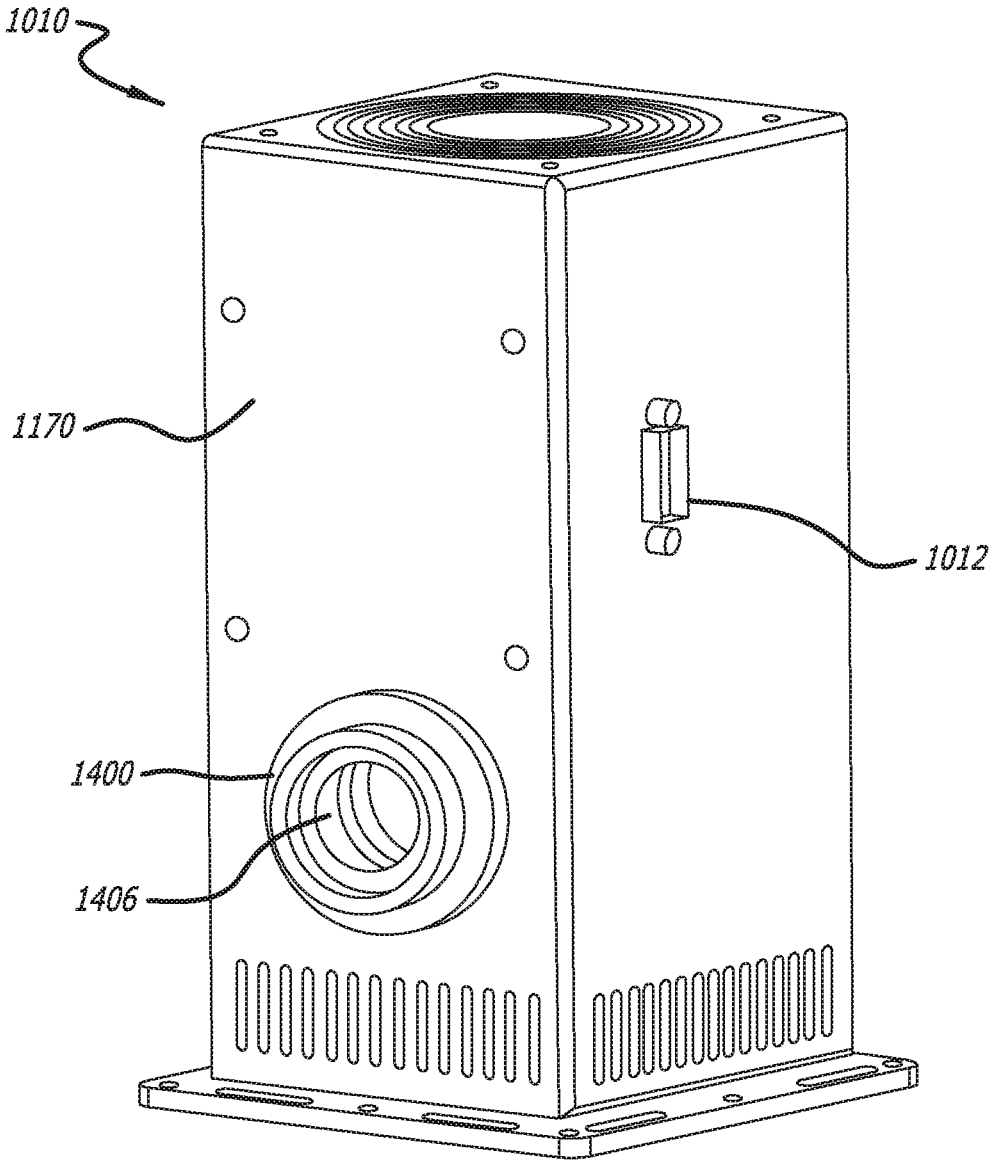
FIG. 23 shows an elevated perspective view of an embodiment of a modular broadband light source.

FIGS. 22 and 23 show various views of an embodiment of a novel modular broadband light source 1010. As shown, the modular broadband light source 1010 may include at least one lamp body insert 1020 positionable within at least one lamp housing 1170. The lamp housing 1170 may include at least one optical system 1400 coupled thereto or in communication therewith. In the illustrated embodiment, a single lamp body insert 1020 may be positioned within or otherwise coupled to the lamp housing 1170. Optionally, any number of lamp body inserts 1020 may be positioned within or otherwise coupled to the lamp housing 1170. Further, any number of optical systems 1400 may be positioned within or otherwise coupled to the lamp housing 1170. Further, in the illustrated embodiment, the optical system 1400 may include at least one outlet port 1406, although those skilled in the art will appreciate that the optical system 1400 may include any number of outlet ports 1406. Further, the lamp housing 1170 may include at least one control connector 1012 thereon or in communication therewith. Optionally, any number of control connectors 1012 may be positioned on the lamp housing 1170. Exemplary control connectors 1012 include, for example, plugs, conduit connectors, electrical buses and the like. As such, the control connector 1012 may be configured to receive power, current, voltage, and/or control commands from an external control source (not shown). Optionally, the modular broadband light source 1010 may be configured to communicate with at least one external control unit wirelessly.

Figure 24:
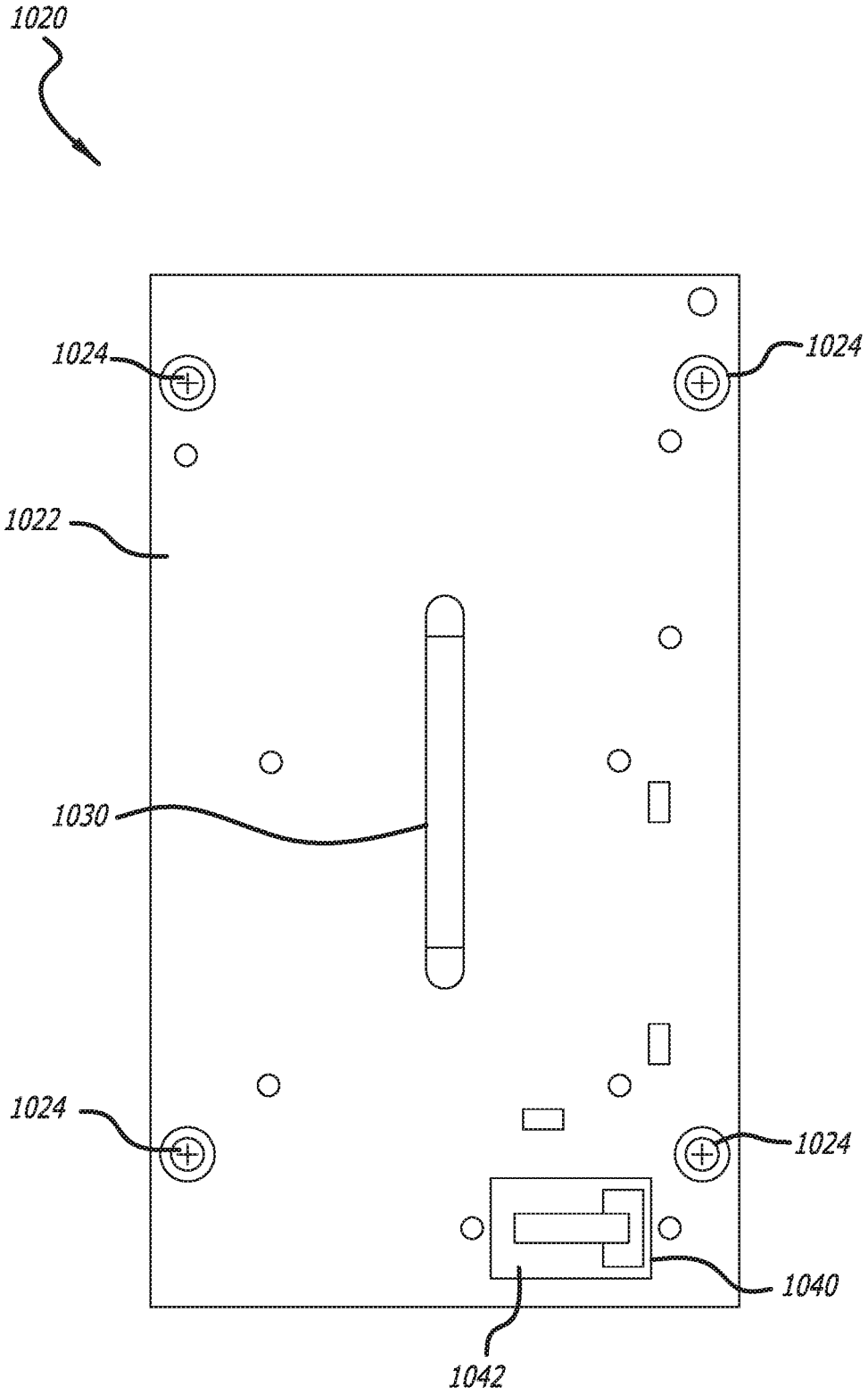
FIG. 24 shows a planar view of the lamp body insert of the modular broadband light source shown in FIG. 22.
Figure 25:
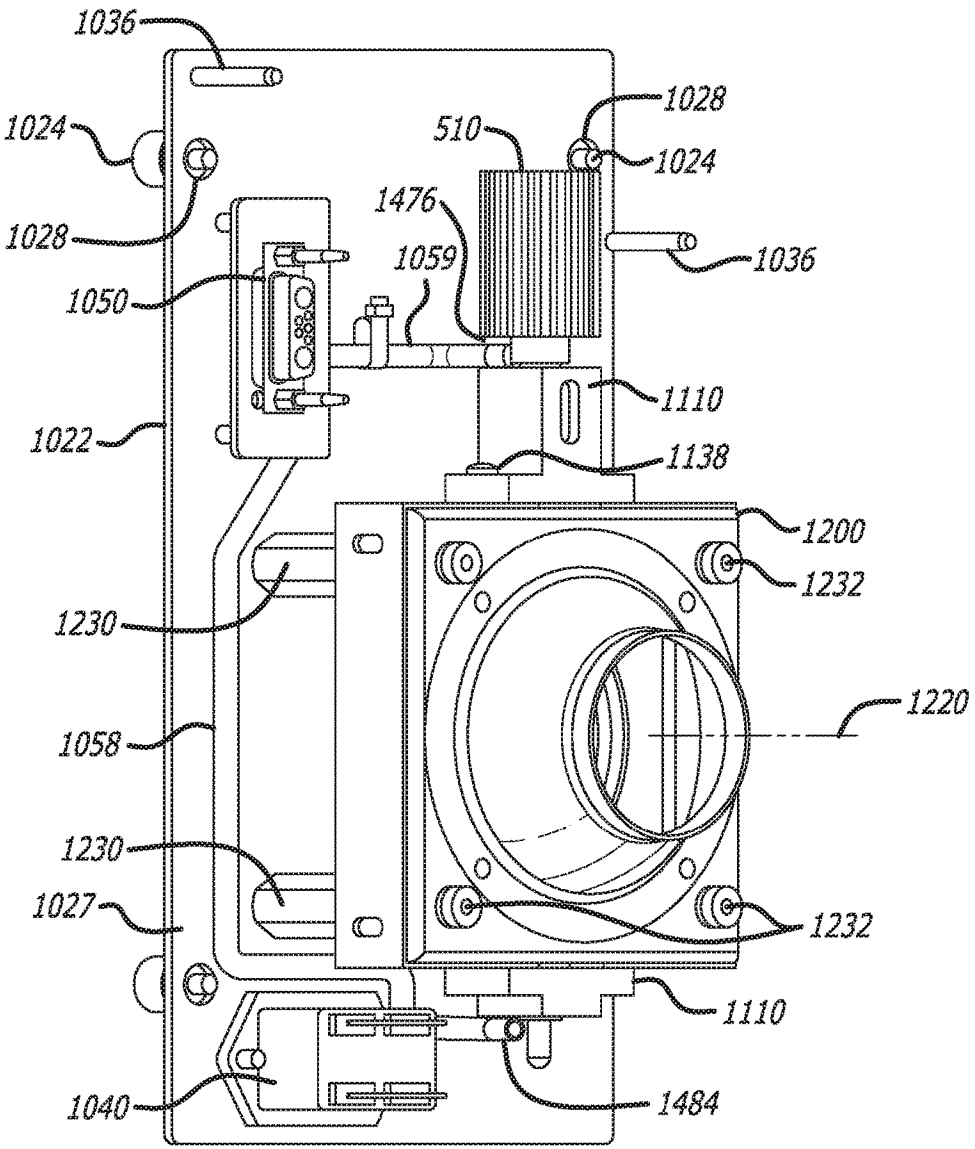
FIG. 25 shows a perspective view of an embodiment of a lamp body insert.

FIGS. 24-44 show various views of various components positioned on or otherwise coupled to an embodiment of a lamp body insert 1020 for use with the modular broadband light source 1010 shown in FIGS. 22 and 23. Optionally, the lamp body insert 1020 may be used with any variety of modular broadband light sources. As shown in FIG. 24, in one embodiment, the lamp body insert 1020 may include at least one panel body 1022 configured to be coupled to the lamp housing 1170 (See FIG. 22). For example, in the illustrated embodiment, the lamp body insert 1020 may be detachably coupled to the lamp housing 1170 with one or more insert fasteners 1024 configured to engage one or more cartridge mounting ports 1172 formed on the lamp housing 1170 (See FIGS. 43 and 44). In one embodiment, the insert fasteners 1024 may be captive fasteners. In another embodiment, the insert fasteners 1024 need not be captive fasteners. Optionally, the insert fasteners 1024 may be screws, bolts, quarter-turn fasteners, friction-fit devices, magnetic couplers, and the like.

Referring again to FIGS. 24-44, at least one handle or other grippable body 1030 may be positioned on or coupled to the panel body 1022 of the lamp body insert 1020. Any variety of handles 1030 configured to enable the user to easily insert and remove the lamp body insert 1020 from the lamp housing 1170 may be coupled to the panel body 1022. Further, one or more fastener ports or passages 1028 sized to receive one or more fasteners 1024 therein (See FIGS. 27-28) may be formed in the panel body 1022. For example, the handle 1030 may be coupled to the panel body 1022 of the lamp body insert 1020 using one or more fasteners 1032 positioned within one or more fastener ports 1034 formed on the panel body 1022. In addition, at least one user interface device, display, and/or processor 1040 may positioned on the panel body 1022. In the illustrated embodiment, the processor 1040 is shown in the lower right-hand corner of panel body 1022. Optionally, the processor 1040 may be located anywhere on the panel body 1022. In one embodiment, the processor 1040 is configured to measure the cumulative run time of the modular broadband light source 1010. As such, the processor device 1040 may include at least one information display or user interface 1042. In another embodiment, the information display 1042 may show the optical power emitted by the lamp 1470. In another embodiment, the information display 1042 may show the operating temperature of the lamp 1470. In another embodiment, the information display 1042 may show the output radiation wavelength spectrum of the lamp 1470. Optionally, the processor 1040 may include one or more connectors configured to couple the processor device 1040 to at least one external processor, power supply, network, sensor, adjoining lamp, analyzing device, controller, and the like. In another embodiment, the processor device 1040 may be configured to communicate with at least one external processor, controller, and/or network wirelessly.

FIGS. 25-28 and 43-44 show various views of various components positioned on or otherwise coupled to an embodiment of the lamp body insert 1020 for use with the modular broadband light source 1010 disclosed herein. As shown, one or more alignment pins or guide members 1036 may be positioned on at least one surface 1027 of the lamp body insert 1020. In one embodiment, the alignment pins 1036 are configured to engage at least a portion of the lamp housing 1170. More specifically, in one embodiment, the alignment pins 1036 may be configured to ensure that at least a portion of the lamp 1470 positioned within the thermal managing reflector body 1200 of the lamp body insert 1020 is substantially co-axially aligned with the optical system 1400 coupled to the lamp housing 1170. Optionally, the alignment pins 1036 may be used to further couple the lamp body insert 1020 to the lamp housing 1170.

Referring again to FIGS. 25-28, at least one processor receiver 1044 may be formed in a portion of the panel body 1022 of the lamp body insert 1020. In the illustrated embodiment, a single processor receiver 1044 may be formed in the lower right hand corner of the panel body 1022. Optionally, any number of processor receivers 1044 may be formed at any location on the panel body 1022. Further, the panel body 1022 may be manufactured without a processor receiver 1044 formed therein. In the illustrated embodiment, the processor 1040 is inserted through and coupled to the internal surface 1027 of the panel body 1022. In one embodiment, the processor 1040 may be detachably coupled to the panel body 1022. Optionally, the processor 1040 may be non-detachably coupled to the panel body 1022. At least one interface connector 1050 may be fastened to panel body 1022 using one or more fasteners 1026. In one embodiment, the interface connector 1050 is configured to permit the lamp body insert 1020 to be electrically and/or mechanically coupled to the lamp housing 1170 quickly. Exemplary interface connectors 1050 include, for example, plugs, conduit connectors, electrical buses, and the like. As such, the components positioned on the panel body 1022 may be configured to receive power, current, voltage, analog, digital, radio frequency, and/or control commands from the lamp housing 1170. Optionally, the panel body 1022 may not include an interface connector 1050, instead utilizing a dedicated power/command and control system located on the lamp body insert 1020.

FIGS. 25-28 and 50 show various views of the various components positioned on or otherwise coupled to an embodiment of the lamp body insert 1020 for use with the modular broadband light source 1010. In the illustrated embodiment, at least one interface cable 1058 may carry at least one electrical signal between the interface connector 1050 and the processor device 1040. The interface cable 1058 may also carry at least one electrical signal between the interface connector 1050 and at least one second lamp connector 1484. At least one interface cable 1059 may carry at least one electrical signal between the interface connector 1050 and at least one first lamp connector 1476. The interface cable 1059 may also carry at least one electrical signal between the interface connector 1050 and at least one lamp sensor device 1512. As such, the interface cable 1058 and the interface cable 1059 may be configured to carry electrical signals such as power, current and voltage, analog, digital, radio frequency and/or control commands between the interface connector 1050, the first lamp connector 1476, the second lamp connector 1484, and the lamp sensor device 1512. Optionally, the interface cable 1059 may carry electrical signals between the interface connector 1050 and any other type of electrical device.

Referring again to FIGS. 25-28 and 39 show various views of the various components positioned on or otherwise coupled to an embodiment of a thermal managing body 1200 for use with a lamp body insert 1020. In one embodiment, at least one thermal managing reflector body 1200 may be coupled to the internal surface 1027 of the panel body 1022 of the lamp body insert 1020. As shown, at least one coupling body 1230 may be used to couple the thermal managing reflector body 1200 to the panel body 1022. In the illustrated embodiment, at least one fastener 1206 may traverse through ports 1306 and 1358 in the thermal managing reflector body 1200 and engage the coupling bodies 1230, thereby detachably coupling the thermal managing reflector body 1200 to the panel body 1022. Optionally, the coupling bodies 1230 may be used to position the thermal managing reflector body 1200 relative to the panel body 1022. In one embodiment, at least one coupling body 1230 may be coupled to at least one panel body 1022 and the thermal managing reflector body 1200 using one or more fasteners 1026. In another embodiment, at least one coupling body 1230 may be integral to at least one of the panel body 1022 and the thermal managing reflector body 1200.

FIGS. 29-31 and 37-42 show various views of various components positioned on or otherwise coupled to an embodiment of a frame assembly 1240 for use with the thermal managing body 1200. As shown, at least one lamp 1470 may be positioned in at least one lamp receiving area 1280 cooperatively formed by the first frame 1300 and the second frame 1350. The first frame 1300 may include a frame surface 1302 having at least one opening 1301 formed therein. At least one flange 1310 may extend from the frame surface 1302, the flange 1310 having at least one fastener port 1312 formed therein. Optionally, there may be any number of flanges 1310 and any number of fastener ports 1312 formed therein. In the illustrated embodiment, the fastener ports 1312 are oval or slotted. Optionally, the fastener ports 1312 can be circular, rectangular, square or other shapes. Further, at least one flange opening 1322 may be formed on at least one flange 1310 formed on the first frame 1300. In the illustrated embodiment, the flange opening 1322 may be sized to receive at least a portion of the lamp 1470 there through. At least one fastener port 1305 may be formed on the frame surface 1302. Optionally, any number of fastener ports 1305 may be formed in the frame surface 1302. As shown, the fastener ports 1305 may be configured to receive at least one face frame fastener 1314 therein (see FIG. 39), the face frame fasteners 1314 configured to couple the first reflector 1202 to the first frame 1300. At least one fastener passage 1306 (see FIG. 39) may be formed in frame surface 1304 of the frame 1300. In the illustrated embodiment, four fastener passages 1306 are formed in the frame surface 1304. Optionally, any number of fastener passages 1306 may be formed in any position in the frame surface 1304.

Referring to FIGS. 29-31 and 37-42, a second frame 1350 may be positioned proximate to the first frame 1300 such that the first and second frames 1300 and 1350 cooperatively form at least one lamp receiving area 1280. The second frame 1350 may include at least one frame surface 1352 having at least one opening 1353 formed there through. At least one flange 1360 having one or more fastener ports 1362 formed therein may extend from the surface 1352. In the illustrated embodiment, at least one fastener port 1356 may be formed on the frame surface 1352. Optionally, any number of fastener ports 1356 may be formed in the frame surface 1352. As shown, the fastener ports 1356 may be configured to receive at least one face frame fastener 1314 therein (See FIG. 38), the face frame fasteners 1314 configured to couple the second reflector 1210 to the second frame 1350. In an alternative embodiment, the face frame fasteners 1314 may be configured to traverse through the fastener port 1356 formed on the second frame 1350 and be securely retained within the fastener ports 1305 formed on the first frame 1300, thereby detachably coupling the second frame 1350 to the first frame 1300. At least one flange 1370 may be formed having one or more one flange opening or feature 1372 formed therein may extend from the surface 1352. In one embodiment, the flange opening 1372 may be configured to receive at least a portion of the lamp assembly 1470 therein. At least one fastener passage 1358 (see FIGS. 29 and 38) may be formed in the frame surface 1352 of the second frame 1350. In the illustrated embodiment, four fastener passages 1358 are formed in frame surface 1352. Optionally, any number of fastener passages 1358 may be formed in any position on frame surface 1352.

FIGS. 25-28 and 38-39 show various views of various components positioned on or otherwise coupled to an embodiment of a thermal managing body 1200 for use in the lamp body insert 1020. In one embodiment, at least one fastener passage 1306 of the frame 1300 and the fastener passages 1358 of the frame 1350 are configured to be substantially coaxial to each other, allowing the fasteners 1232 to traverse through the fastener passages 1306 and 1358 and engage the coupling bodies 1230, thereby coupling the thermal managing reflector body 1200 to the panel body 1022 of the lamp body insert 1020.

FIGS. 27-31 and 37-41, show various views of various components positioned on or otherwise coupled to an embodiment of a frame assembly 1240 for use with the lamp body insert 1020. As shown, the frame assembly 1240 may be formed by coupling the first frame 1300 and the second frame 1350. For example, the first and second frames 1300, 1350 may be coupled together using one or more fasteners 1309 extending through the fastener ports 1312 of the first frame 1300 and engaging the fastener ports 1362 of the second frame 1350. In an alternative embodiment, the first and second frames 1300, 1350 may be coupled together using the fasteners 1232 extending through the ports 1306 and 1358 substantially coaxial to each other, allowing the fasteners 1232 to engage the coupling bodies 1230 (see FIG. 28), thereby detachably coupling the first and second frames 1300, 1350 and the thermal managing reflector body 1200 to the panel body 1022 of the lamp body insert 1020 (see FIGS. 25, 27 and 28). At least one lamp mount 1110 may be coupled to the first frame 1300 and/or the second frame 1350. The lamp mount 1110 may include a body 1112 having at least one flange 1114 formed thereon or coupled thereto. The flange 1114 may include at least one fastener passage 1116 formed thereon, the fastener passage 1116 sized to receive one or more fasteners 1138 therein or traversing therethrough. At least one lamp passage 1122 may be formed within the body 1112, the lamp passage 1122 sized to receive at least a portion of at least one lamp 1470 therein or traversing therethrough. The lamp passage 1122 may be configured to be positioned proximate to the flange opening 1322 wherein at least one lamp 1470 positioned within frame assembly 1240 may extend through the lamp receiving area 1280 and be coupled to the lamp mount 1110. At least one passage or slot 1126 may be formed in the lamp mount 1110 for the purpose of inserting at least one fastener to hold the lamp 1470 in place relative to the lamp mount 1110. Alternatively, the passage or slot 1126 may be used for the application of at least one bonding agent 1164 (see FIGS. 40-42) for the purposes of fixing the lamp in place relative to the lamp mount 1110. In one embodiment, the lamp mount 1110 may be made from PTFE (Teflon). Optionally, the lamp mount 1110 may be made from copper, brass, bronze, aluminum, steel, stainless steel, other metal alloys, thermoplastic polymers, thermoset polymers, sintered materials, composite materials, dielectric materials, insulating materials, and the like. Those skilled in the art will appreciate that the lamp mount 1110 may be made from any number of other materials.

FIGS. 31 and 37-42 show various views of various components positioned on or otherwise coupled to an embodiment of a frame assembly 1240 for use with an embodiment of the lamp body insert 1020. One embodiment of the frame assembly 1240 may define at least one lamp receiving area 1280 with the second frame 1350 positioned proximate to the first frame 1300 such that the flanges 1360 and 1370 of the second frame 1350 are positioned proximate to the flanges 1310 and 1320 of the first frame 1300. Optionally, other frame configurations may be employed to define at least one lamp receiving area 1280. Coupling members 1309 may traverse through ports 1312 and engage the fastener ports 1362 (see FIGS. 29 and 40) in the flanges 1360 and couple the first frame 1300 to the second frame 1350.

Referring to FIGS. 29-42, the first interface surface 1496 of lamp 1470 may traverse through lamp passage 1122 of the lamp mount 1110. The lamp mount 1110 may be mounted to the flanges 1320 of the frame 1300 using the fasteners 1138. In one embodiment, the flanges 1320 are positioned between one or more coupling bodies 1308 and the lamp mount 1110. Optionally, the lamp 1470 may be coupled to the flanges 1320 of frame 1300 without the coupling bodies 1308. Those skilled in the art will appreciate that any number of lamp mounting configurations may be used to position the lamp 1470 in the lamp receiving area 1280.

FIGS. 37-41 show various views of the thermal managing reflector body 1200. In the illustrated embodiment, the first reflector 1202 is configured with at least one flange 1206 and at least one reflecting surface 1204 that defines at least one focal point 1203 (see also FIG. 26). In the illustrated embodiment, the reflector 1202 comprises at least one spherical reflector. Optionally, the reflector 1202 may be an elliptical reflector, a planar reflector, a paraboloid reflector, a parabolic cylinder reflector or a retroreflector. Those skilled in the art will appreciate that other types of reflectors may be used in the thermal managing reflector body 1200. In the illustrated embodiment, the reflector 1202 may be made of polished aluminum. Optionally, the reflector 1202 may be made of brass, bronze, glass, Zerodur or other materials. The reflector 1202 may also be coated with gold, silver, thin film coatings, dielectric coatings, oxide coatings and the like. One or more reflector fastening ports 1208 may be formed in the flange 1206. Coupling members 1314 traverse through the reflector fastening ports 1208 and engage and are retained within the fastener ports 1305 (see FIG. 29), thereby positioning the reflector 1202 proximate to and/or coupled to the surface 1304 (see FIG. 39) of the frame assembly 1240.

Figure 26:
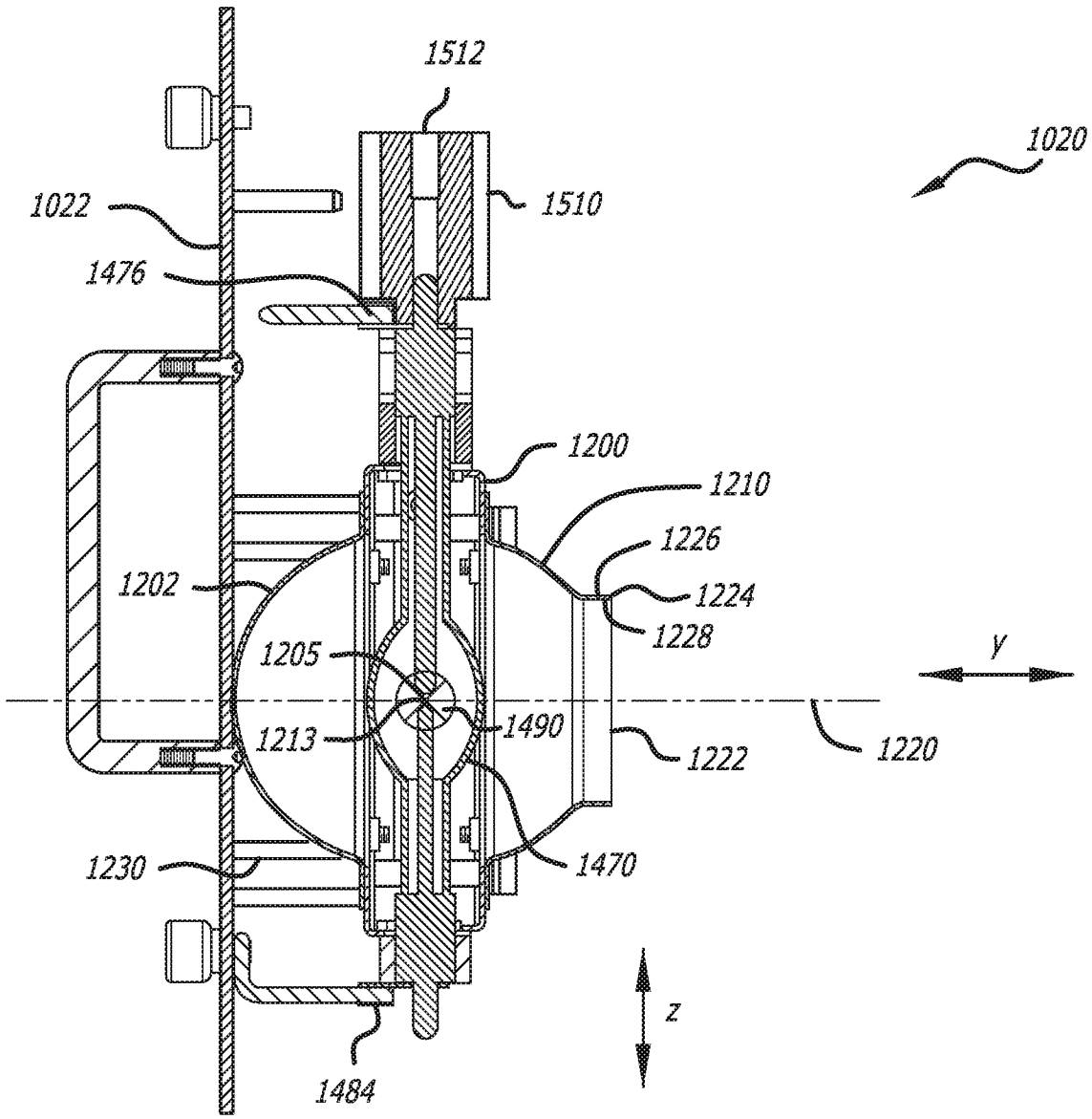
FIG. 26 shows a cross-section view of an embodiment of a lamp body insert.
Figure 27:
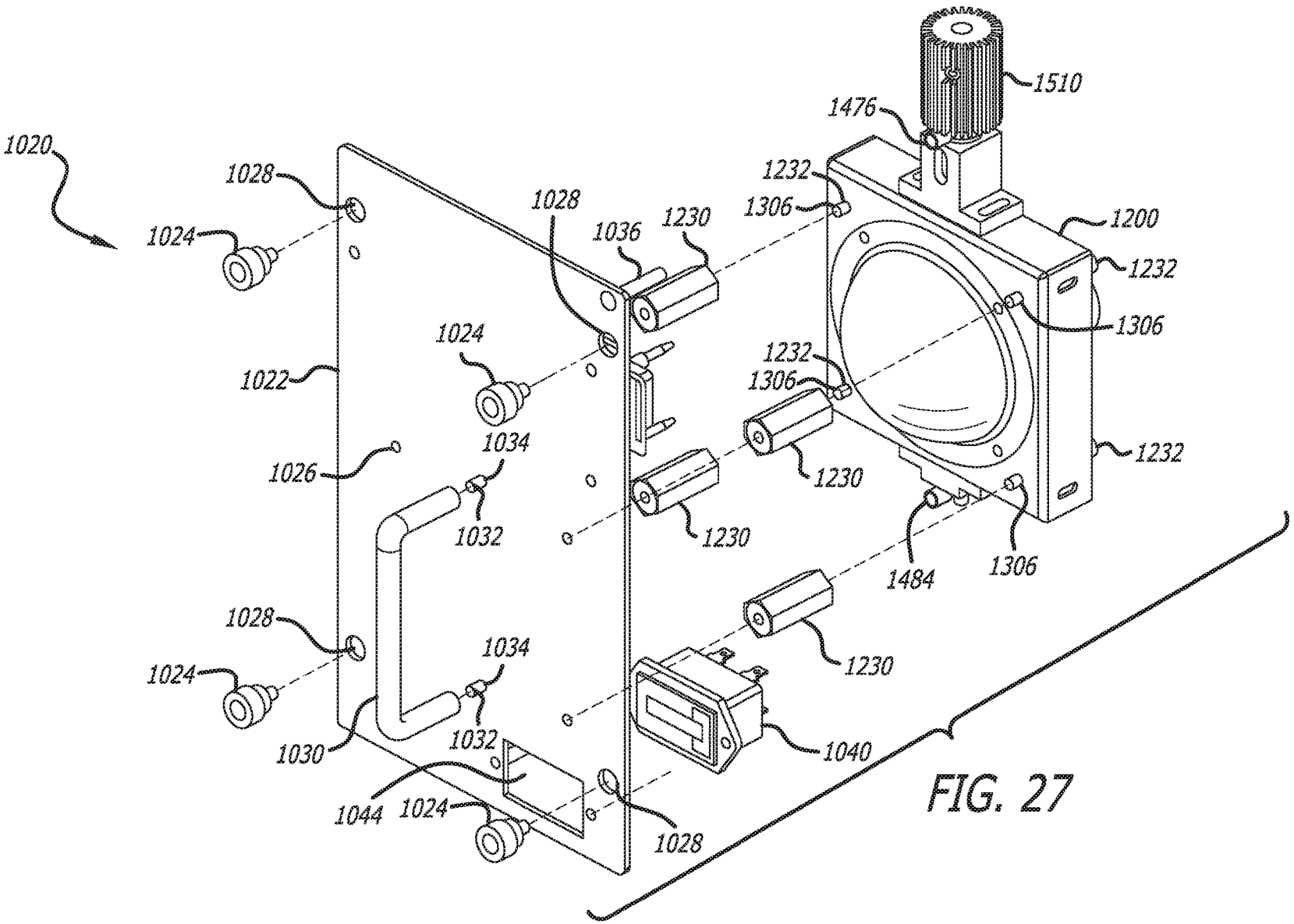
FIGS. 27 and 28 show exploded perspective views of the lamp body insert shown in FIG. 25.
Figure 28:
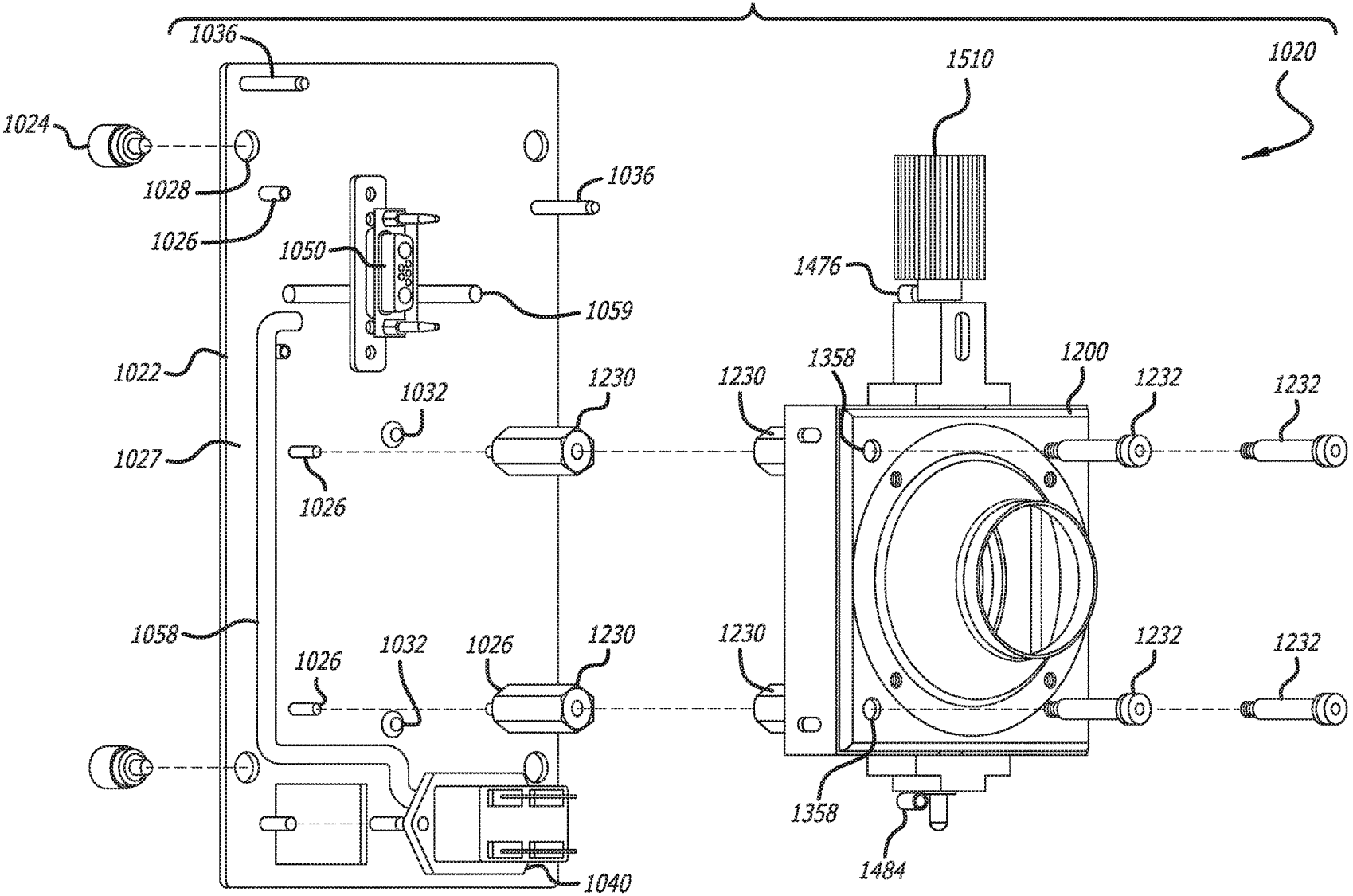
Figure 29:
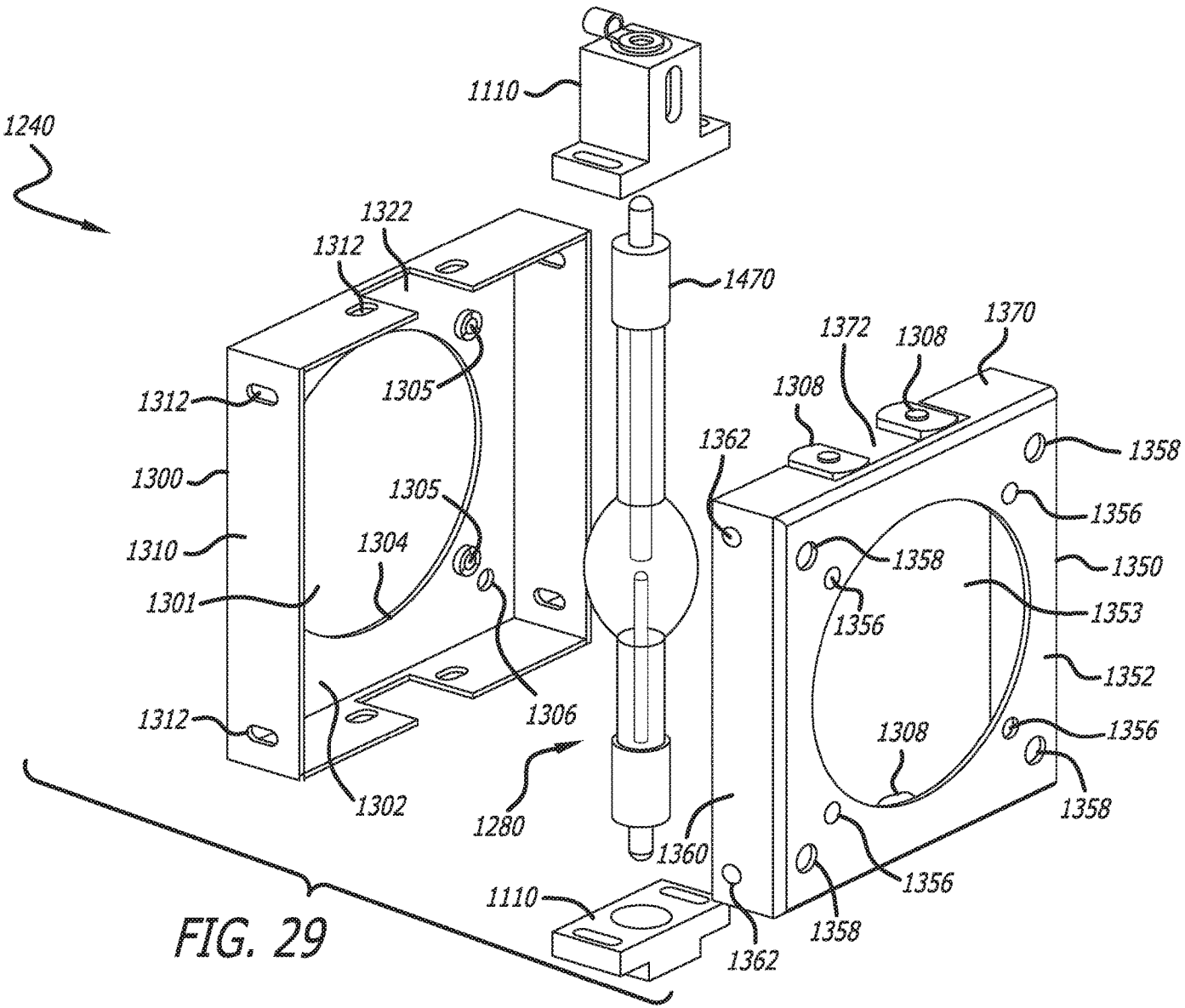
FIG. 29 shows an exploded perspective view of an embodiment of a frame assembly.
Figure 30:
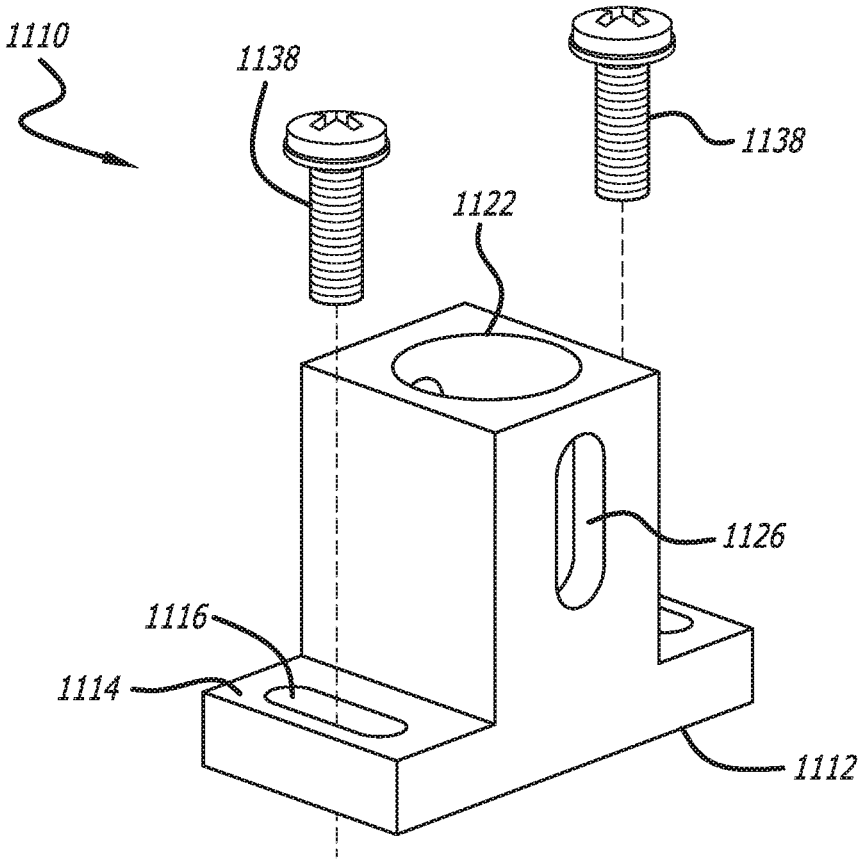
FIG. 30 shows an exploded perspective view of a lamp mount.
Figure 31:
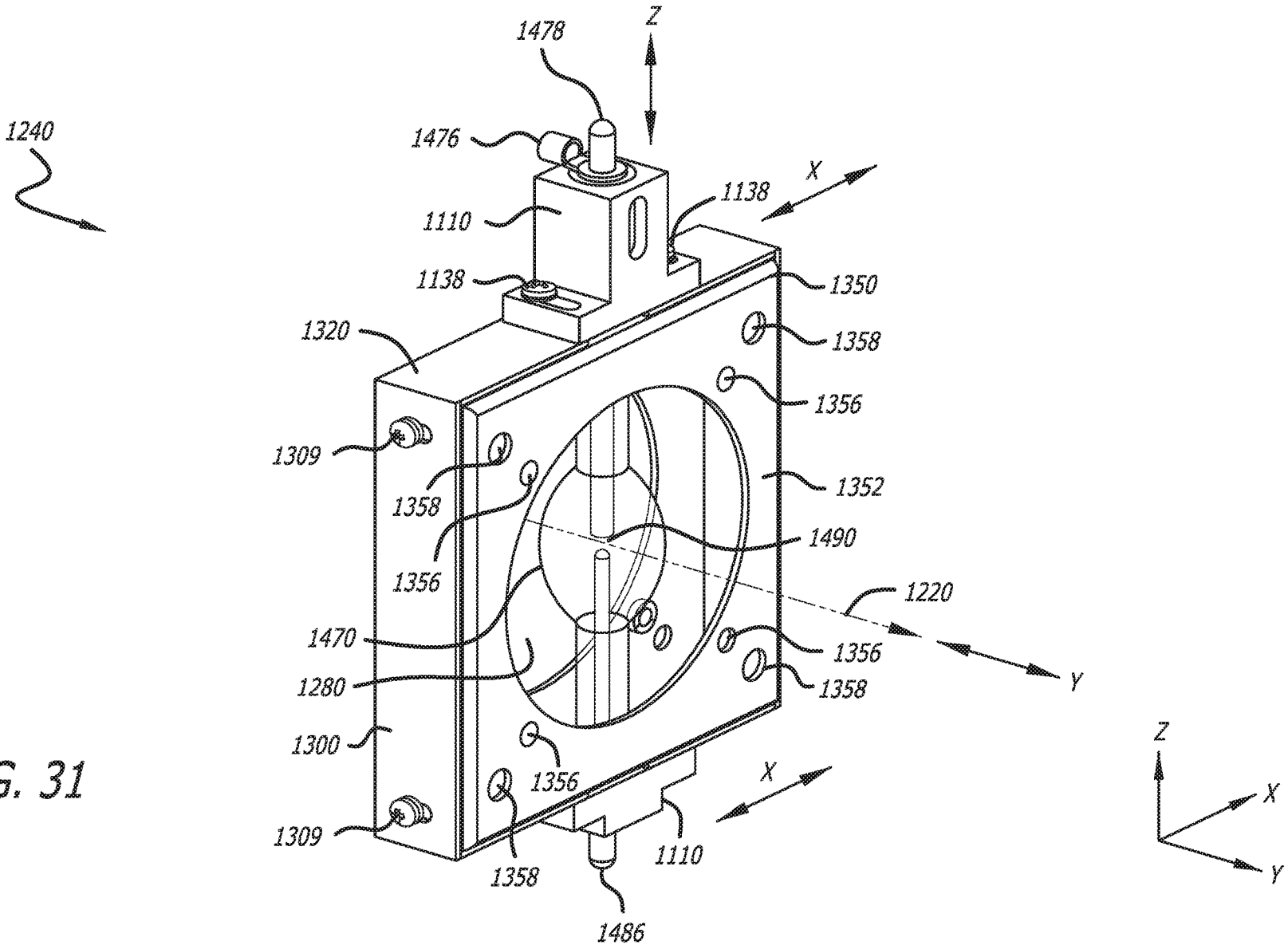
FIG. 31 shows a perspective view of the frame assembly shown in FIG. 29.

As shown in FIGS. 37-42, at least one second reflector 1210 may be coupled to or otherwise positioned proximate to the frame assembly 1240 used in an embodiment of the modular broadband light source 1010. In one embodiment, the second reflector 1210 includes at least one flange 1214 and at least one reflecting surface 1212 that defines at least one focal point 1213 (see also FIG. 26). One or more reflector fastening ports 1218 are formed on the flange 1214. The coupling members 1314 may traverse through the reflector fastening ports 1218 and engage and be retained within the fastener ports 1356 thereby positioning the reflector 1210 proximate to and/or coupled to the surface 1352 of the frame assembly 1240. In one embodiment, the second reflector 1210 comprises a spherical reflector. Optionally, the second reflector 1210 may be formed in any variety of shapes, configurations, transverse dimensions, and may have the same alternative shapes, alternative materials and alternative coatings in any combination, as reflector 1202 described above. The second reflector 1210 may have at least one reflector outlet port 1222 defined by at least one outlet port flange 1224 with at least a first flange surface 1226 and at least one second flange surface 1228. The reflector outlet port 1222 may be co-aligned with an optical axis 1220. The thermal managing reflector body 1200 may include at least one lamp receiving area 1280 formed therein, the lamp receiving area 1280 configurable to receive at least one lamp 1470 therein. In one embodiment, the thermal managing reflector body 1200 can be configured to adjust the performance of the modular broadband light source 1010 by ensuring that at least one focal point 1203 of reflector 1202 and the focal point 1213 of reflector 1210 are substantially located within the lamp center 1490 and the optical axis 1220. FIG. 26 shows a section view of an embodiment of the lamp body insert 1020 with the thermal managing reflector body 1200 coupled to the panel body 1022 with the coupling bodies 1230. In the illustrated embodiment, the optical axis 1220 and the focal points 1205 and 1213 are substantially aligned with the lamp center 1490 and the optical axis 1220. Optionally, the optical axis 1220, the focal points 1205 and 1213, and the lamp center 1490 may not be substantially aligned.

FIGS. 38-42 show various views of an embodiment of the thermal managing reflector body 1200. The coupling members 1309 may traverse through the ports 1312 of the frame 1300 and engage the fastener ports 1362 of the frame 1350. Once the coupling members 1309 are engaged with the fastener ports 1362, the frames 1300, 1350 can be selectively adjusted along at least one direction (e.g. X direction, Y direction) until the focal points 1203, 1213 are substantially positioned with the lamp center 1490 and the optical axis 1220 in at least one direction. Further, the thermal managing reflector body 1200 may be configured to allow the positions of the reflectors 1202 and 1210 in at least one of the X and/or Z directions to be selectively adjusted by loosening and tightening the fasteners 1314. Alternatively, the thermal managing reflector body may be configured to align the focal points 1205 and 1213 with the lamp center 1490 and optical axis 1220 in a number of different configurations. Also, the focal points 1205 and 1213 with the lamp center 1490 and optical axis 1220 may not be substantially co-aligned.

FIGS. 29-42 show various views of various components positioned on or otherwise attached to an embodiment of the frame assembly 1240 for use with, the thermal managing reflector body 1200 may be configured to enable the adjustment of the lamp center 1490 so that it substantially overlaps the focal points of reflectors 1202 and 1210. The positions of the lamp mounts 1110 may be adjusted in at least one of the X and Y directions via the fasteners 1138, resulting in a change in transverse dimension of the lamp center 1490 relative to the focal points 1203 and 1213 and the optical axis 1220 in the X and/or Y directions. In another embodiment, the thermal managing reflector body 1200 may be configured to enable the adjustment of the position of the lamp center 1490 so that it does not substantially overlaps the focal points of reflectors 1202 and 1210.

As shown in FIGS. 29-42, the thermal managing reflector body 1200 may be configured to enable the adjustment of the lamp center 1490 in the Z direction. For example, in one embodiment, the lamp center 1490 of the thermal managing reflector body 1200 may be selectively adjusted so that it substantially overlaps with at least one focal point 1203, 1213, and the optical axis 1220. Optionally, the lamp 1470 may be adjusted in the Z direction before being secured to the lamp mounts 1110. In the illustrated embodiment, at least one insulating member 1160 is disposed between interface surfaces 1496 and 1498, respectively, of the lamp 1470 and the lamp passages 1122 of the lamp mounts 1110. In the illustrated embodiment, the insulating members 1160 are cylindrical sleeves made from a dielectric material, although those skilled in the art will appreciate that the insulating member 1160 may be manufactured in any variety of shapes, sizes, and configurations from any variety of materials. Optionally, the lamp 1470 may be fixed in place in lamp mounts 1110. In one embodiment, the insulating member 1160 may be bonded to the lamp passage 1122 and the first interface surface 1496 of the lamp 1470 with at least one bonding agent 1164. Optionally, the lamp 1470 may be coupled to the insulating member 1160 and the lamp passage 1122 of the lamp mount 1110 with other fastening devices or processes (not shown).

A variety of methods can be employed to adjust the performance of the modular broadband light source 1010 by ensuring that the lamp center 1490, the focal points 1203, 1213 and the optical axis 1220 are substantially co-aligned within the thermal managing reflector body 1200. In one embodiment, at least one optical measurement device 1600 (see FIG. 41) may be placed in optical communication with the reflector outlet port 1222. Exemplary optical measurement devices include optical power meters, optical power sensors, optical spectrum analyzers, photo-spectrometers and the like. In a process known as "active alignment" the lamp 1470 may be energized during the assembly process of the thermal managing reflector body 1200 and the optical measurement device 1600 may be used to monitor the optical characteristics of light exiting the reflector outlet port 1222. Exemplary optical characteristics may include optical power, optical wavelength and spectrum, polarization, coherence, among others. Mechanical adjustment of the positions of the reflectors 1202, 1210 and the lamp 1470 using the methods described in the foregoing paragraphs may result in variations in the optical output characteristics, at which point the positions of the reflectors 1202, 1210 and the lamp 1470 may be fixed relative to each other. Other methods to optimize or otherwise selectively adjust the performance of the modular broadband light source 1010 include, without limitation, mechanical fixturing of all adjustable components parts, the use of fiducial markings on various components, or the manufacturing of component parts to very tight tolerances, resulting in very repeatable positioning of mechanical components, obviating the need for either active or passive alignment. Those skilled in the art will appreciate that optimization or variation of the optical output characteristics of the modular broadband light source 1010 may be achieved by using alternate mechanical designs and alternate methods for optical measuring.

As shown in FIG. 26, the lamp 1470 may comprise an arc lamp. Those skilled in the art will appreciate that any variety of arc lamps may be used in various embodiments of the lamp 1470, including, without limitations, Xenon arc lamps, Mercury arc lamps, Xenon-Mercury arc lamps, Deuterium arc lamps, Sodium arc lamps, Metal-halide arc lamps and Carbon arc lamps. Arc lamps generally operate at high pressures and are fragile. Physical damage to these types of lamps may result in explosions that present a danger to handlers, shippers, receivers, installers and operators of the modular broadband light source 1010. Referring again to FIG. 41, at least one lamp protection device 1610 is configured to prevent foreign matter or debris from entering the chamber 1550 of the thermal managing reflector body 1200 and damaging the lamp 1470. In the illustrated embodiment, the lamp protection device 1610 comprises a cap or cover that is coupled to the reflector outlet port 1222. In one embodiment, the lamp protection device 1610 is detachably coupled to the reflector outlet port 1222. Optionally, the lamp protection device 1610 is non-detachably coupled to the reflector outlet port 1222. The lamp protection device 1610 may be configured to be removed before the lamp body insert 1020 is coupled to the lamp housing 1170. The lamp protection device may be transparent, translucent, opaque or any other degree of light transmittance.

Figure 33:
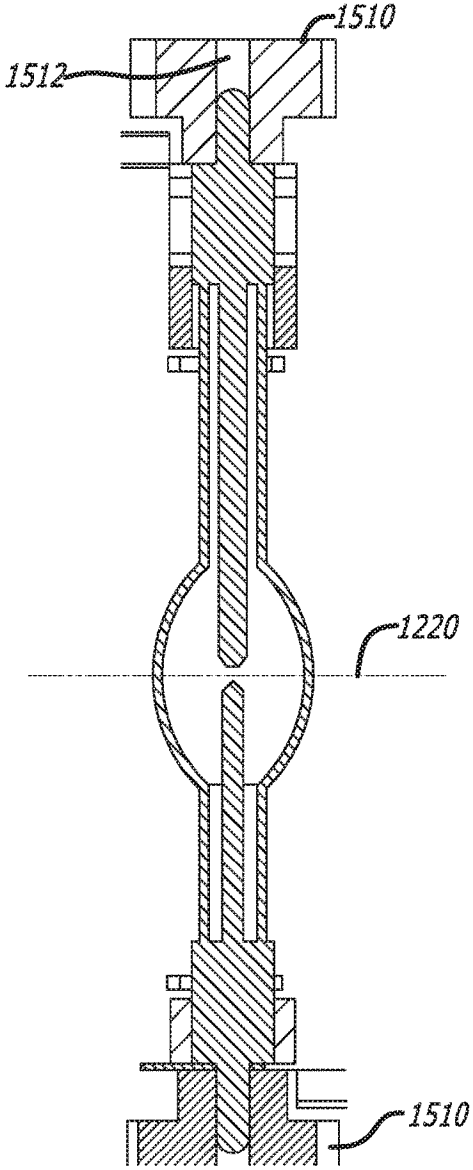
FIG. 33 shows a section view of an embodiment of an arc lamp assembly.
Figure 32:
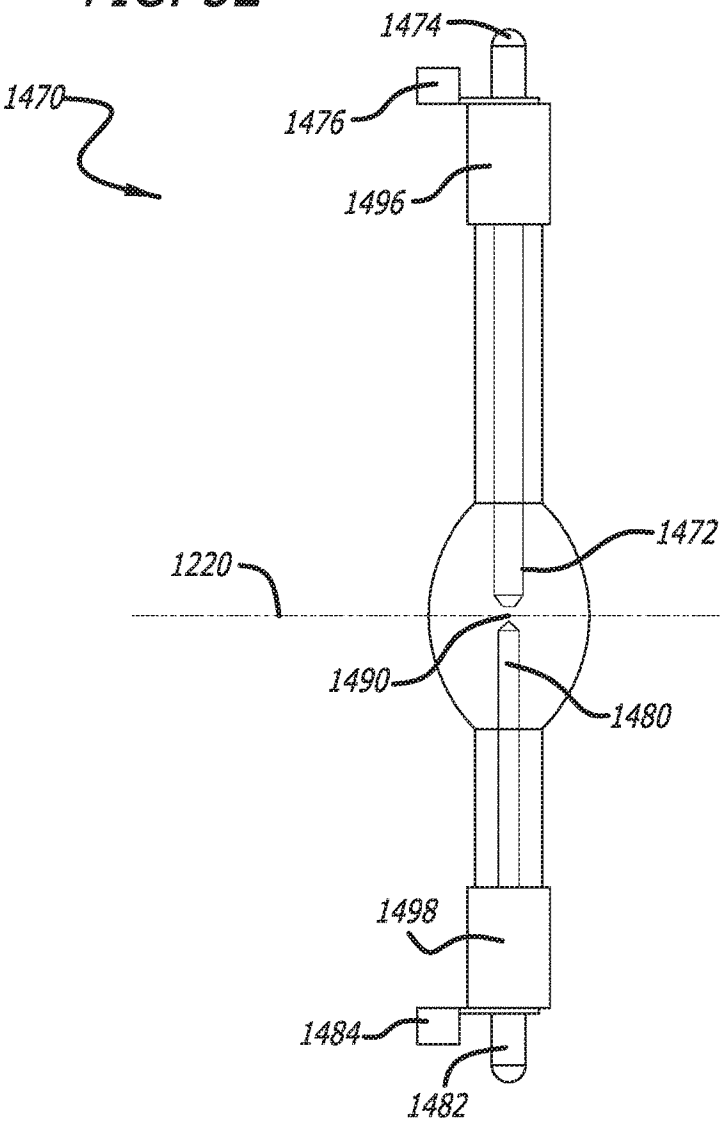
FIG. 32 shows an elevation view of an embodiment of an arc lamp assembly.

Operation of the arc lamp 1470 may generate significant thermal energy (heat) during operation. The thermal managing reflector body 1200 may be configured to extract heat from the arc lamp 1470, permitting the temperature of lamp 1470 may be selectively controlled. Referring to FIGS. 32-33, heat generated by the arc lamp 1470 may be conducted from at least one first electrode 1472 toward at least one first contact 1474 and to at least one heat dissipation device 1510. The heat generated by the arc lamp 1470 may also be conducted from at least one second electrode 1480 toward at least one second contact 1482 to another heat dissipation device 1510. The heat dissipation device 1510 may be manufactured from a variety of materials, including aluminum, copper, copper-tungsten, bronze, steel, stainless steel, sintered metals, ceramics and composite materials including encapsulated graphite, carbon nanotubes, graphene and the like. The heat dissipation device 1510 may also comprise alternate thermal management devices such as heat pipes, heat spreaders, heat exchangers, thermoelectric coolers or any variety of active heat sink technologies. Alternative heat dissipation devices 1510 may also be liquid or gas cooled heat exchangers using a variety of refrigerant materials. Those skilled in the art appreciate that the heat dissipation device 1510 may be made from a wide variety of different materials or employ a wide variety of heat management technologies.

The heat dissipation device 1510 may also comprise at least one lamp sensor device 1512 to sense at least one operating parameter of the lamp 1470. In one embodiment, the lamp sensor device 1512 may comprise a temperature sensor. Exemplary temperature sensors include devices such as thermistors, thermocouples, pyroelectric materials and the like for detecting the operating temperature of the lamp 1470. In another embodiment, the lamp sensor device 1512 may measure the electrical current supplied to the lamp 1470. In another embodiment, the lamp sensor device 1512 may measure the electrical voltage across the lamp 1470. In other embodiments, the lamp sensor device 1512 may measure any other operating characteristic of the lamp 1470.

Figure 34:
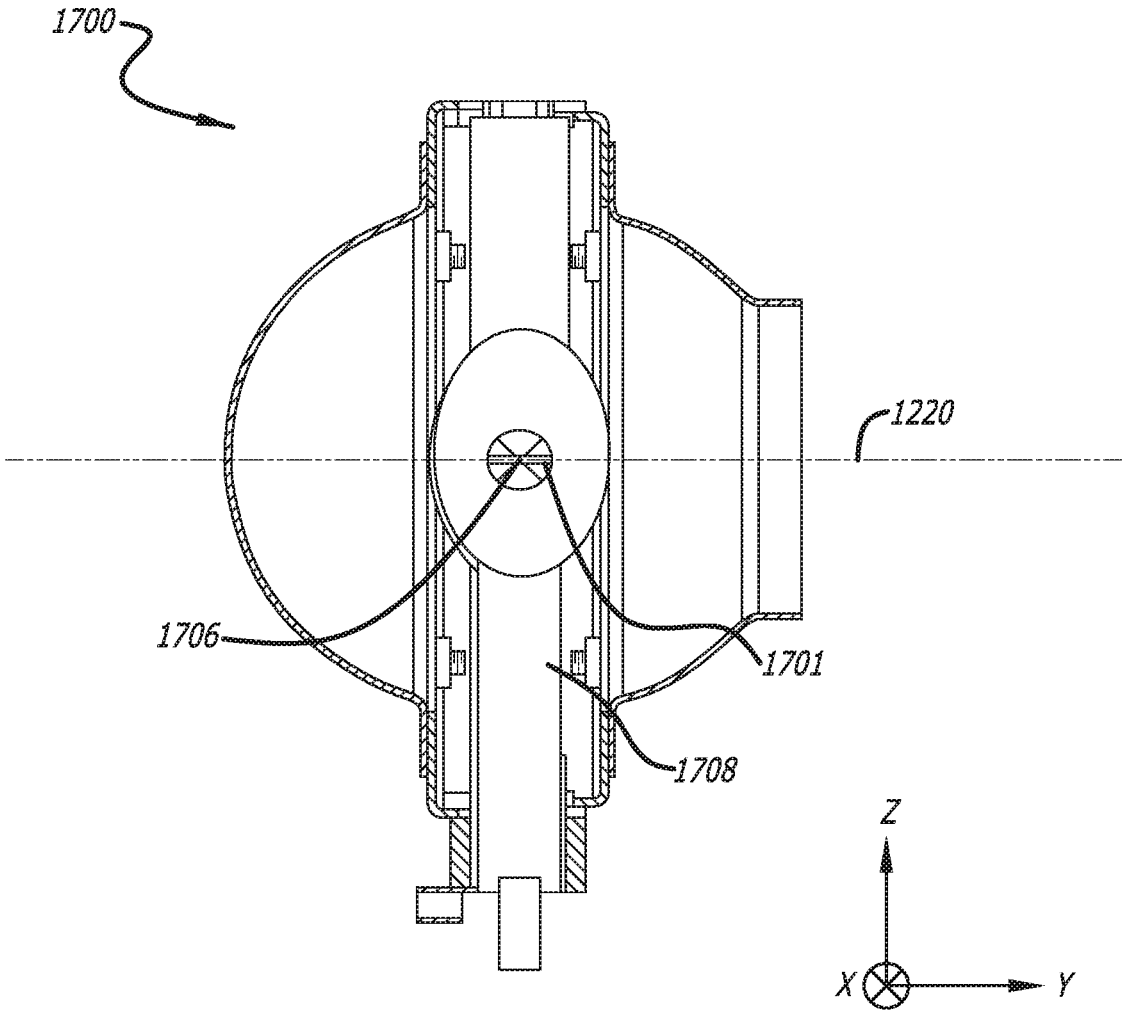
FIG. 34 shows a section view of an embodiment of an alternate thermal managing reflector body showing an incandescent lamp.
Figure 35:
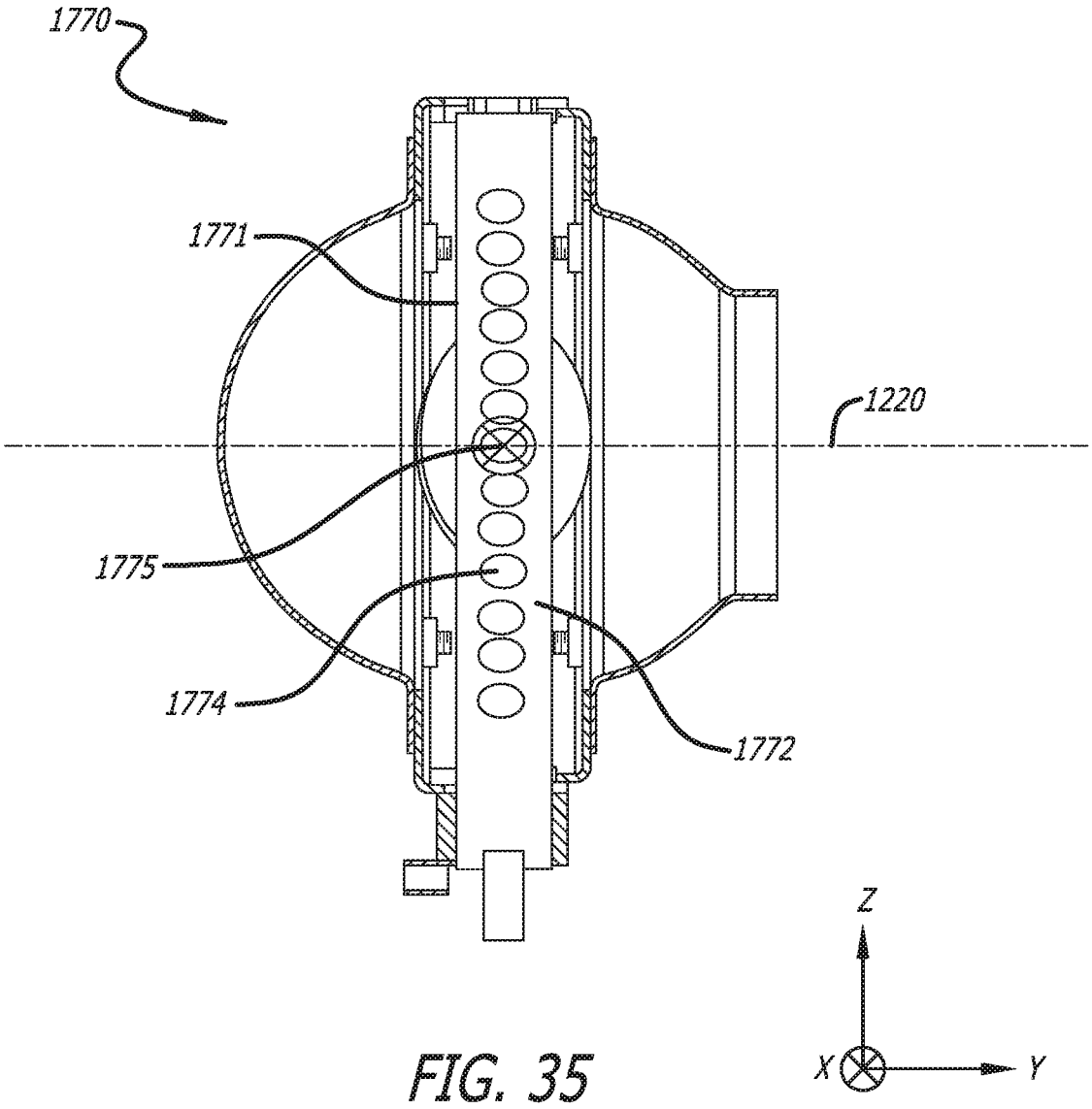
Figure 37:
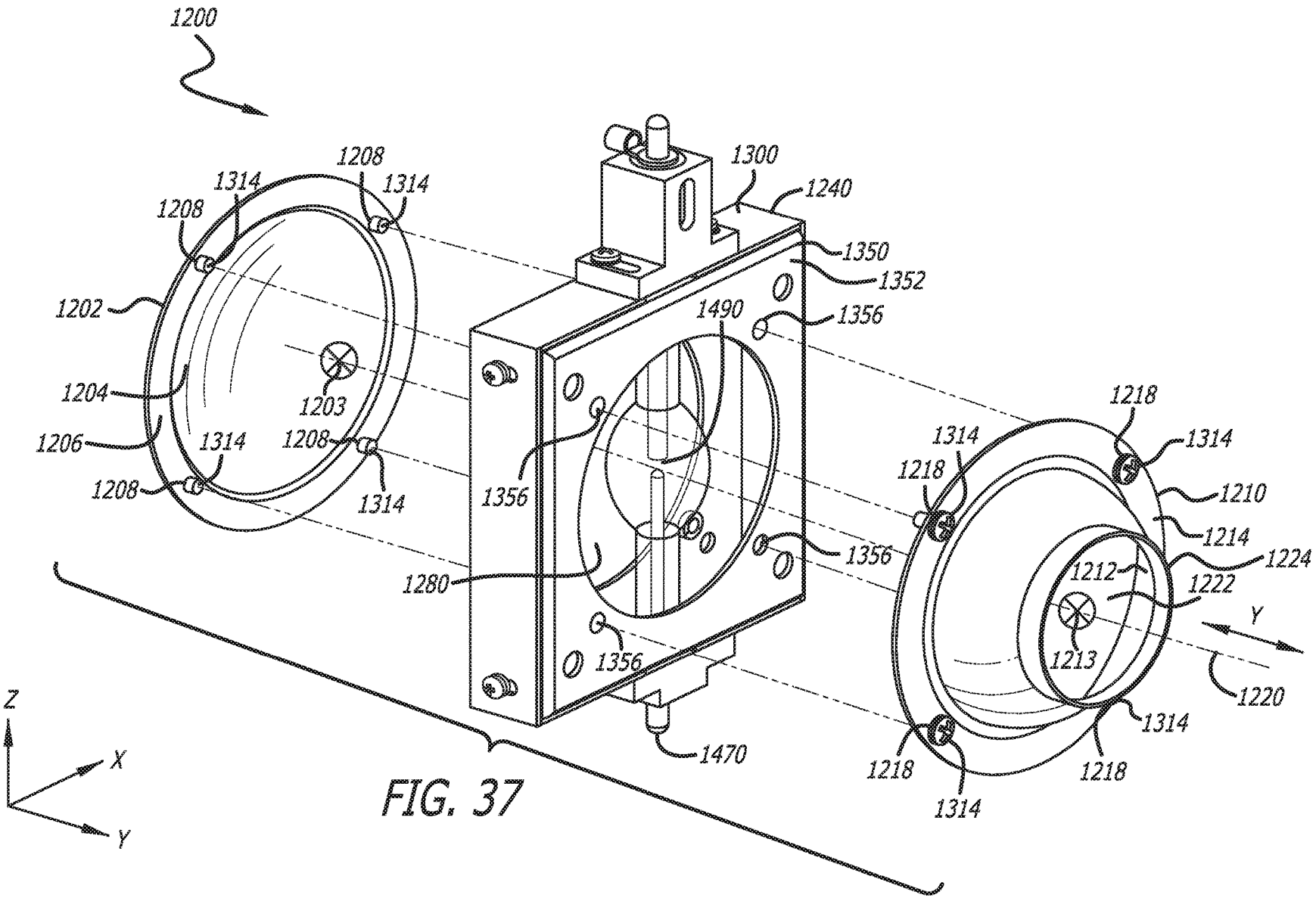
FIG. 37 shows an exploded perspective view of an embodiment of a thermal managing reflector body.
Figure 38:
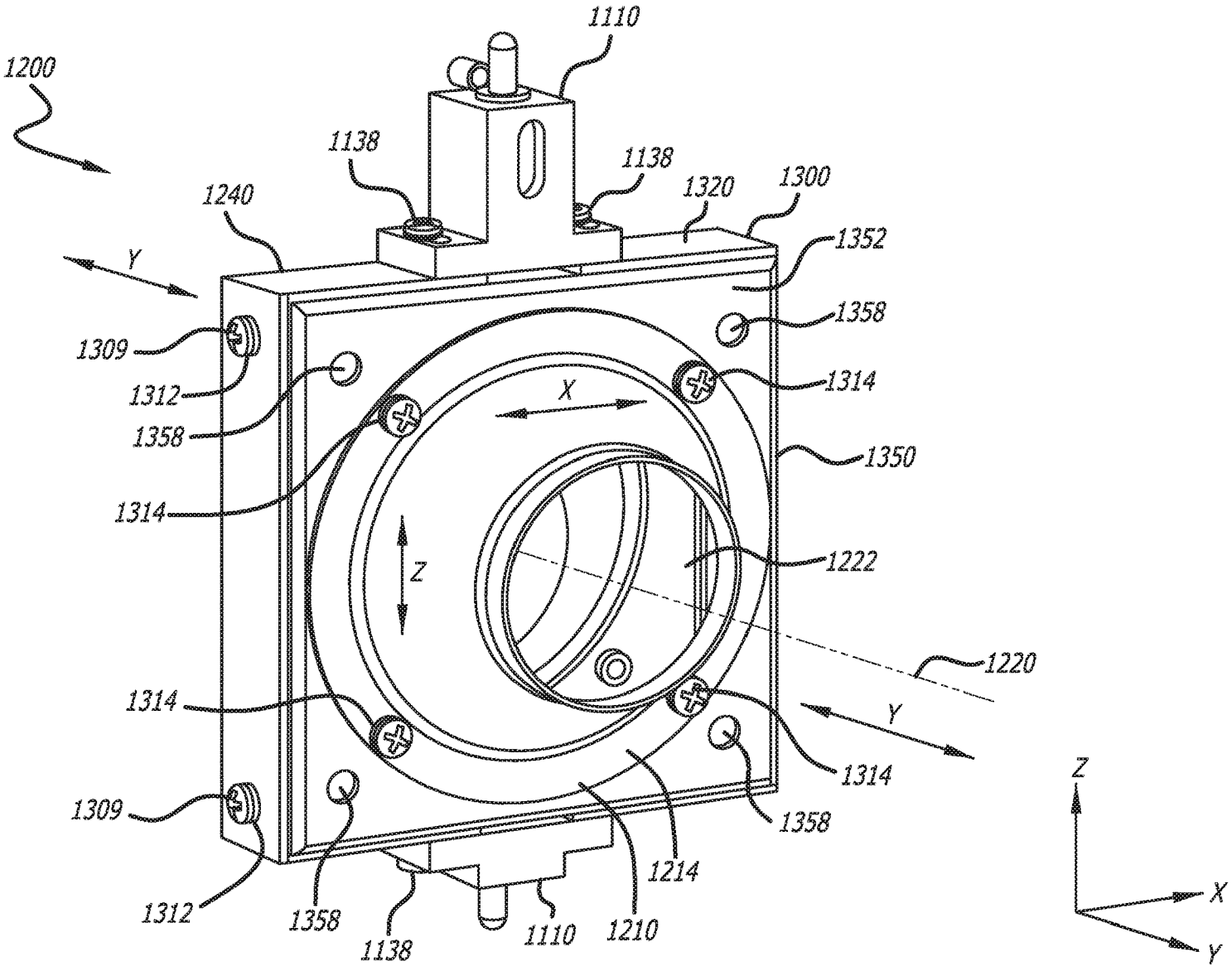
FIGS. 38 and 39 show perspective views of the thermal managing reflector body shown in FIG. 37.
Figure 39:
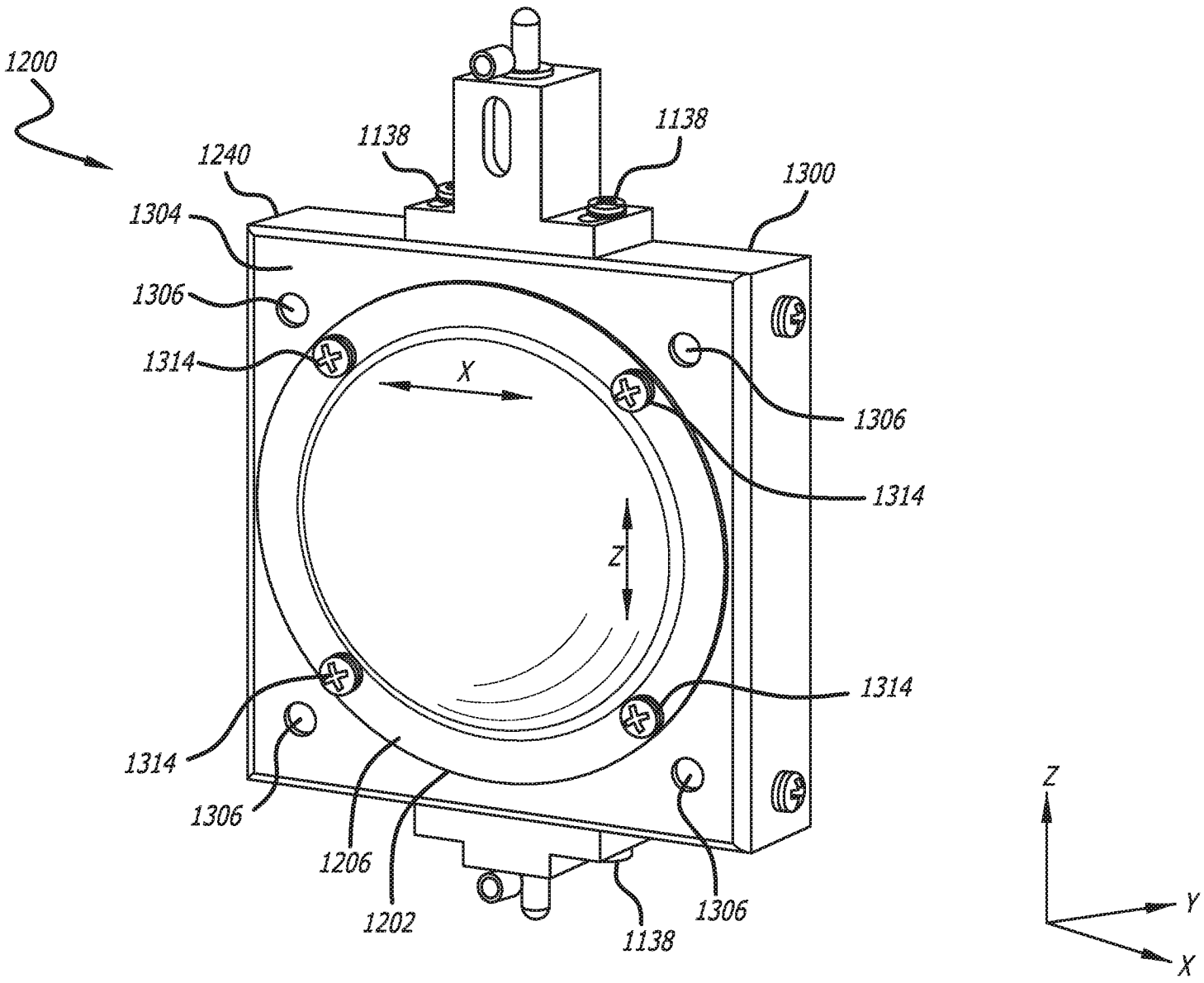
Figure 40:
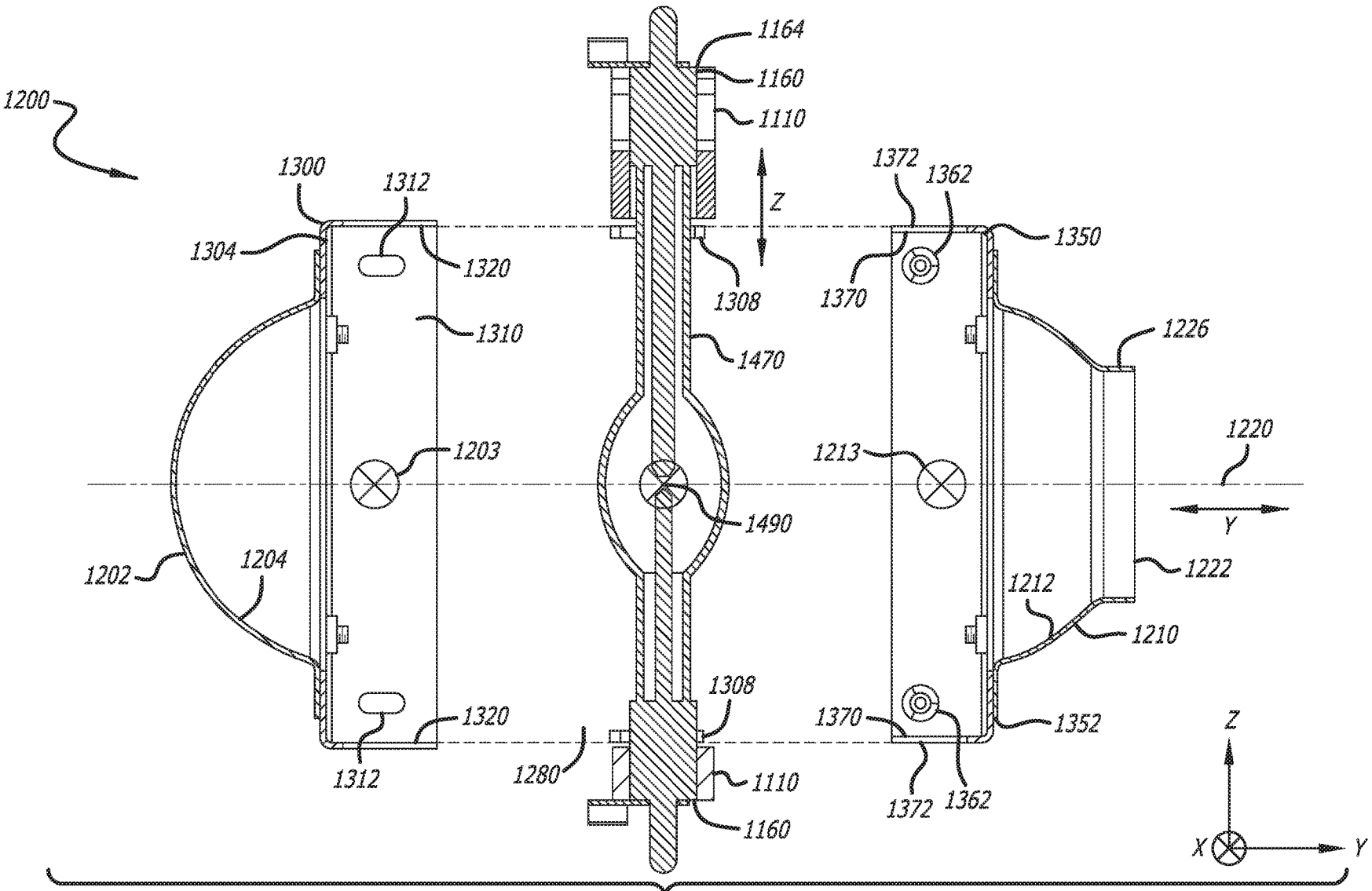
FIG. 40 shows an exploded view of the thermal managing reflector body shown in FIG. 37.
Figure 41:
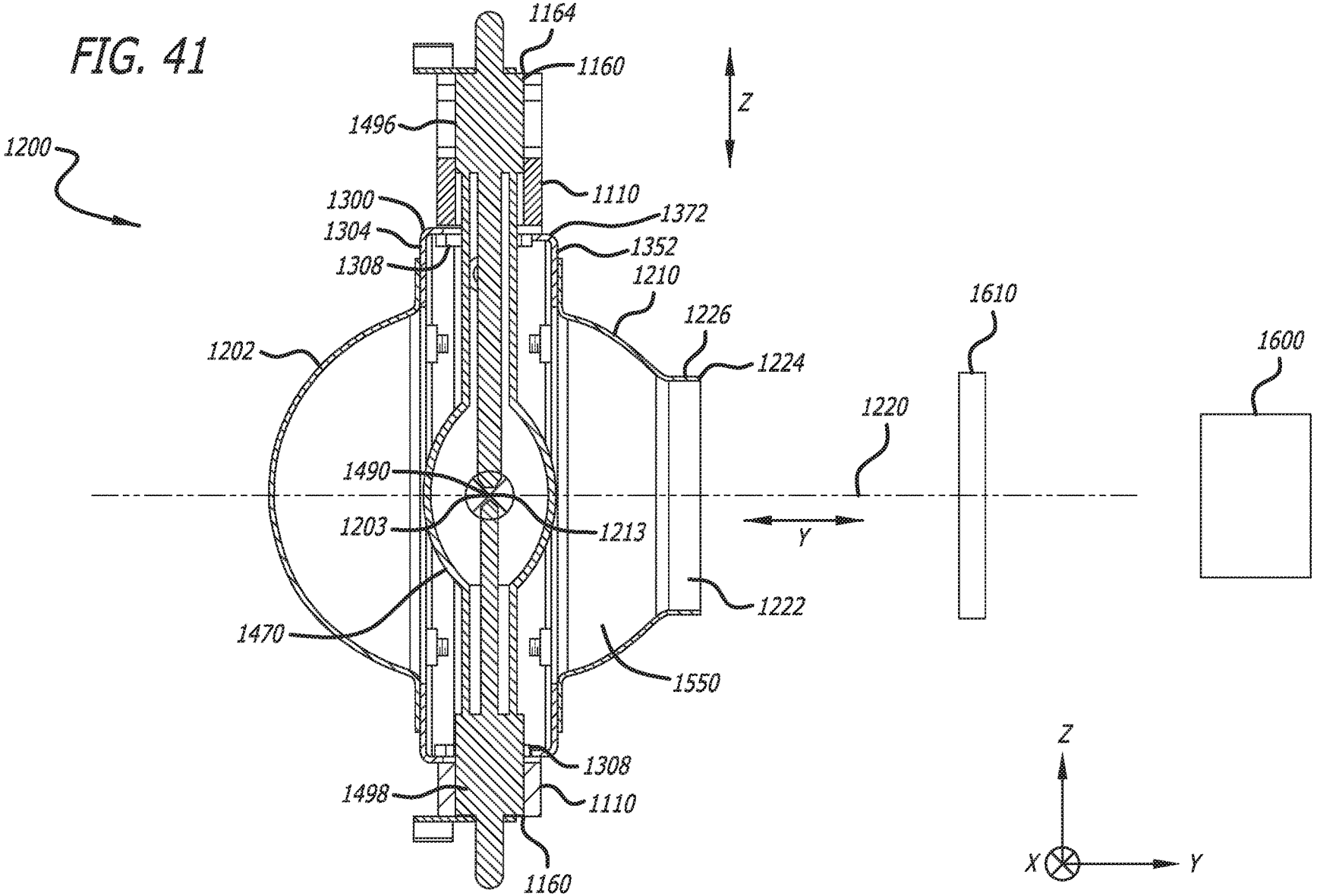
FIG. 41 shows a section view of the thermal managing reflector body shown in FIG. 37.
Figure 42:
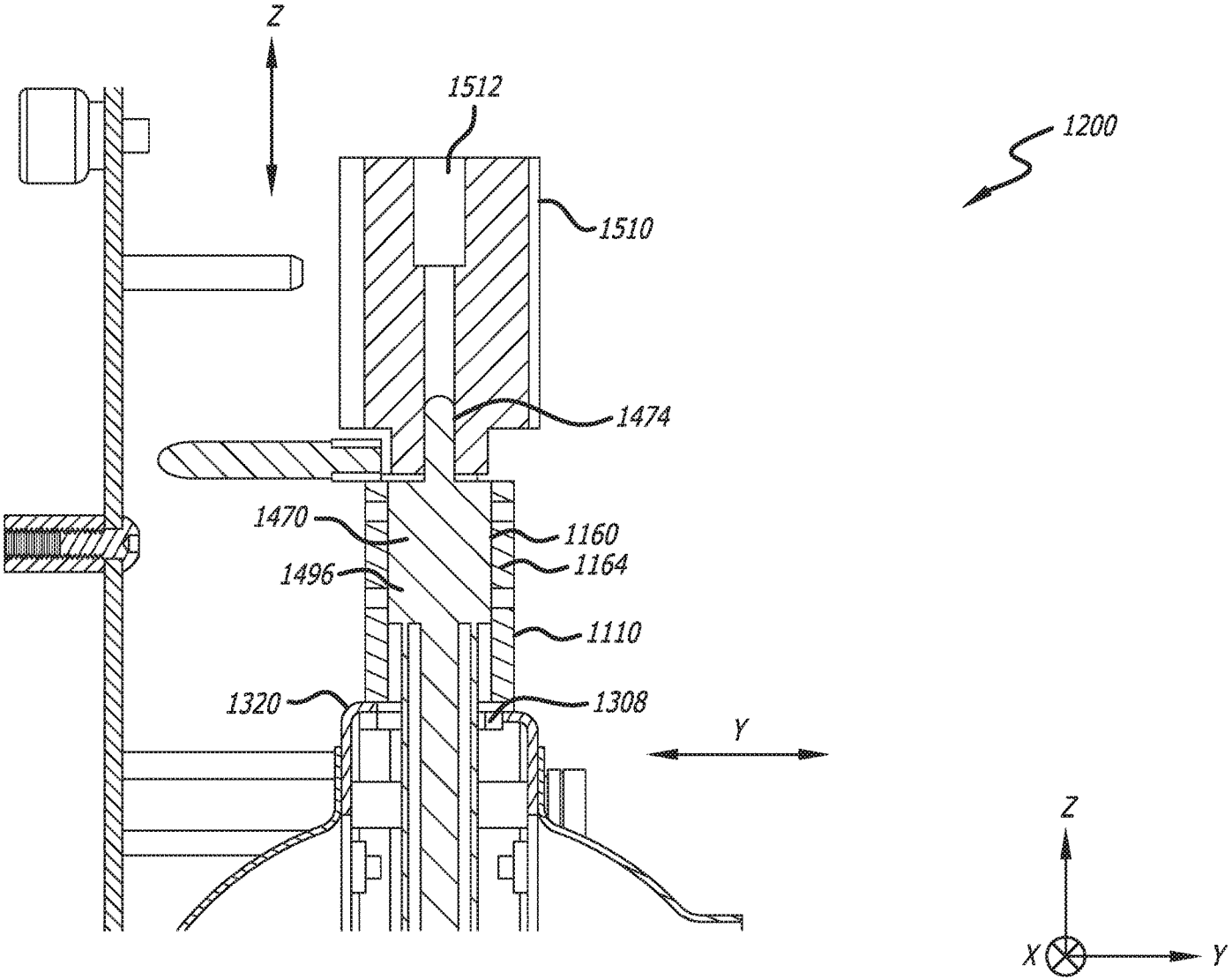
FIG. 42 shows a detail section view of the thermal managing reflector body shown in FIG. 37.

The modular broadband light source 1010 shown in FIG. 22 may include alternate illumination systems and devices in addition to arc lamps. For example, incandescent lamps such as Quartz-Tungsten Halogen (QTH) lamps are currently used in a variety of broadband light sources. LED lamps are also capable of useful broadband light generation. FIGS. 34-36 show various embodiments of alternate lamps for use in the modular broadband light source 1010. FIG. 34 shows an alternate thermal managing reflector body 1700 configured for use with at least one incandescent lamp 1708. At least one filament 1701 of the incandescent lamp 1708 may overlap the optical axis 1220 and the focal point 1706 of the reflectors of the thermal managing reflector body 1700. FIG. 35 shows an alternate thermal managing reflector body 1770 for use with at least one LED lamp 1771 comprising at least one LED device 1774 on at least one linear mount 1772. At least one LED device 1774 of the LED lamp 1771 may overlap the optical axis 1220 and the focal point 1775 of the reflectors of the thermal managing reflector body 1770. Alternatively, none of the LED devices 1774 may overlap the optical axis 1220. FIG. 36 shows an alternate thermal managing reflector body 1790 for use with at least one LED lamp 1791 with at least one LED device 1794. In one embodiment, one or more of the LED devices 1794 may be arrayed in a generally oval pattern on at least one LED mount 1792, proximate to a focus point 1795 of the thermal managing reflector body 1790. Optionally, the LED devices 1794 may be located in many different ways in various geometries on the LED lamp 1791.

Figure 45:
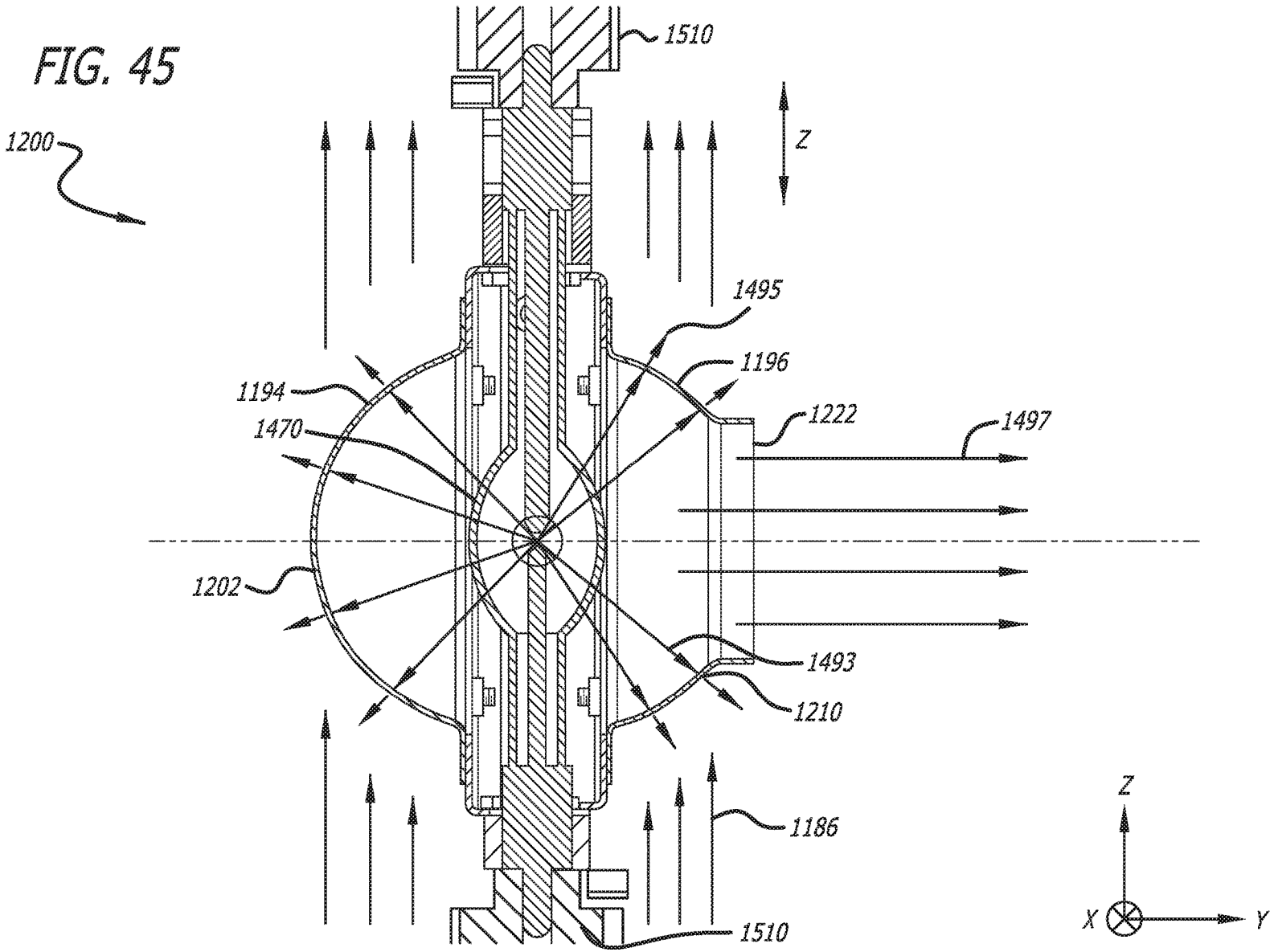
FIG. 45 shows a section view of the thermal managing reflector body shown in FIG. 37.
Figure 46:
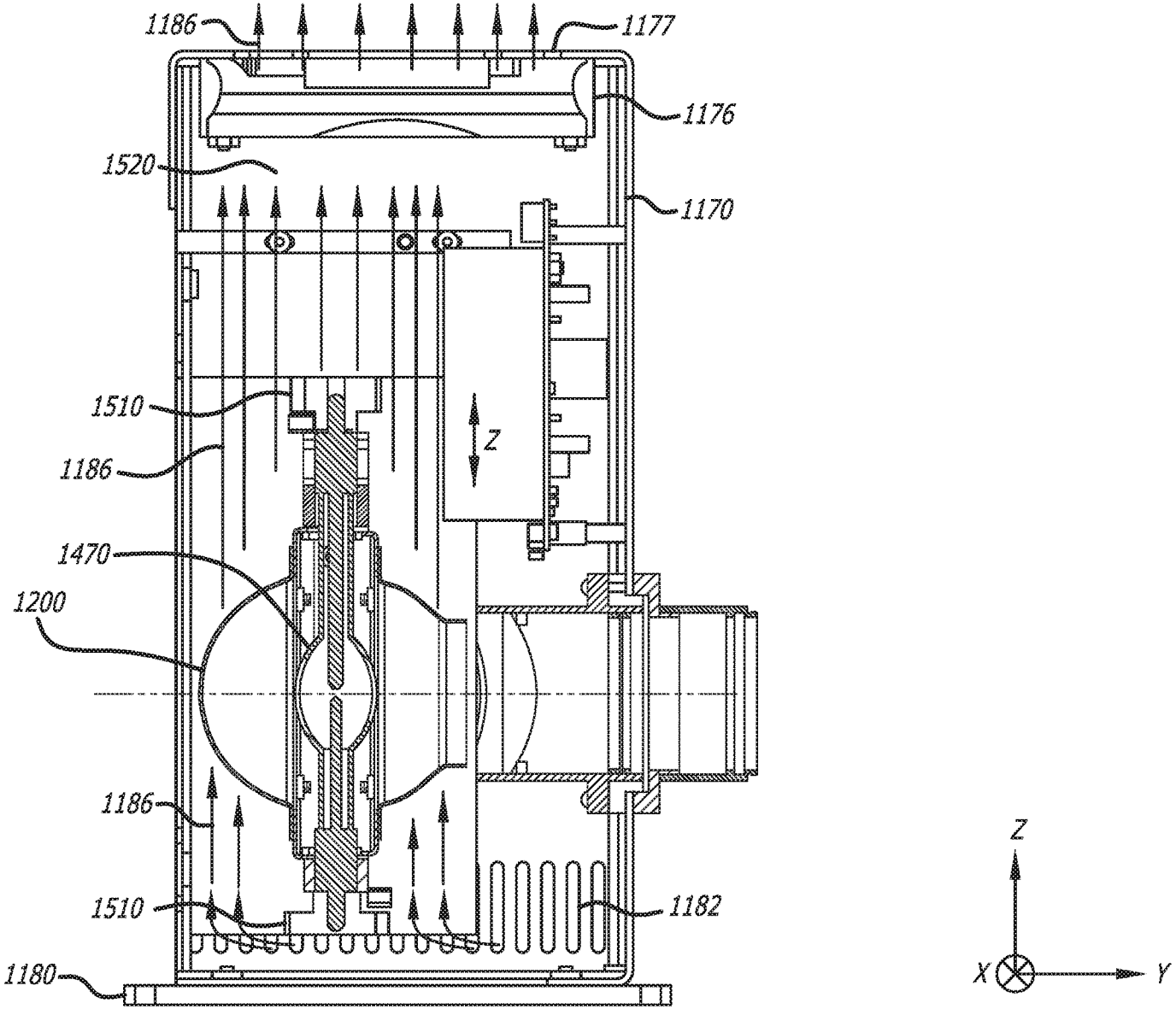
FIGS. 46 and 47 show section views of the modular broadband light source shown in FIG. 22.

FIGS. 45 and 46 show various views of various components positioned on or otherwise coupled to an embodiment of a thermal managing reflector body 1200 for use with the modular broadband light lamp source 1010. The thermal managing reflector body 1200 is configured to provide removal of heat generated by the lamp 1470 during use. Optical radiation 1493 that is generated by the arc lamp 1470 is incident on the reflectors 1202 and 1210. A portion of the optical radiation 1493 may be reflected by the reflectors 1202, 1210 may be directed out of the reflector outlet port 1222 as reflected optical radiation 1497. However, some of the optical radiation 1493 is absorbed by the reflectors 1202, 1210, which is re-radiated as heat 1495 into a volume or compartment 1520 surrounding the thermal managing reflector body 1200. In one embodiment, the volume 1520 overlaps the body insert receiver 1174. Optionally, the volume 1529 may not communicate with the body insert receiver 1174. One or more convection driver 1176 may be configured to direct or evacuate at least one fluid 1186 (for example, in the Z direction) around at least one outer surface 1194 of the reflector 1202 and/or around at least one outer surface 1196 of the reflector 1210 of the thermal managing reflector body 1200. The fluid 1186 located within the lamp housing 1170 may absorb a portion of the heat 1495 and may be directed out through at least one convection port 1177 of the lamp housing 1170 or out through at least one convection port 1182 located proximate to at least one base 1180. The fluid 1186 may also flow over the heat dissipation devices 1510, thereby extracting additional heat generated by the arc lamp 1470. Generally, the high intensity lamps that may be used with one or more embodiments of the thermal managing assembly 1200 may benefit from precise temperature control to potentially extend the operating life of the lamps used in the lamp body insert 1020. During use, the heat dissipation device 1510 and/or the lamp sensor device 1512 may transmit signals to one or more of the processor devices 1040, the controller/drive units 1178, the convection drivers 1176 or external controllers/processors. In one embodiment, the lamp sensor device 1512 may send a signal that causes the convection driver 1176 to turn on or off or operate at a variety of speeds to control the operating temperature of the lamps 1470, 1708, 1771, 1791 or any other configuration or type of lamp used in the. Optionally, other temperature control architecture may be used. As such, the thermal managing reflector body 1200 may be configured to act as a heat transfer device thereby allowing the arc lamp 1470 to be operated at high power without reducing its lifetime. In one embodiment, the fluid 1186 is ambient air. Optionally, the fluid 1186 may be laboratory-grade "clean dry air" or an inert gas such as argon or helium. In the illustrated embodiment, the convection driver 1176 is a fan. Optionally, the convection driver 1176 may be a vacuum generator. Optionally, the fluid 1186 may be directed through the volume or compartment 1520 from an externally-driven source. Optionally, the heat generated by the lamp 1470 may be transferred by free convection or radiation.

Figure 43:
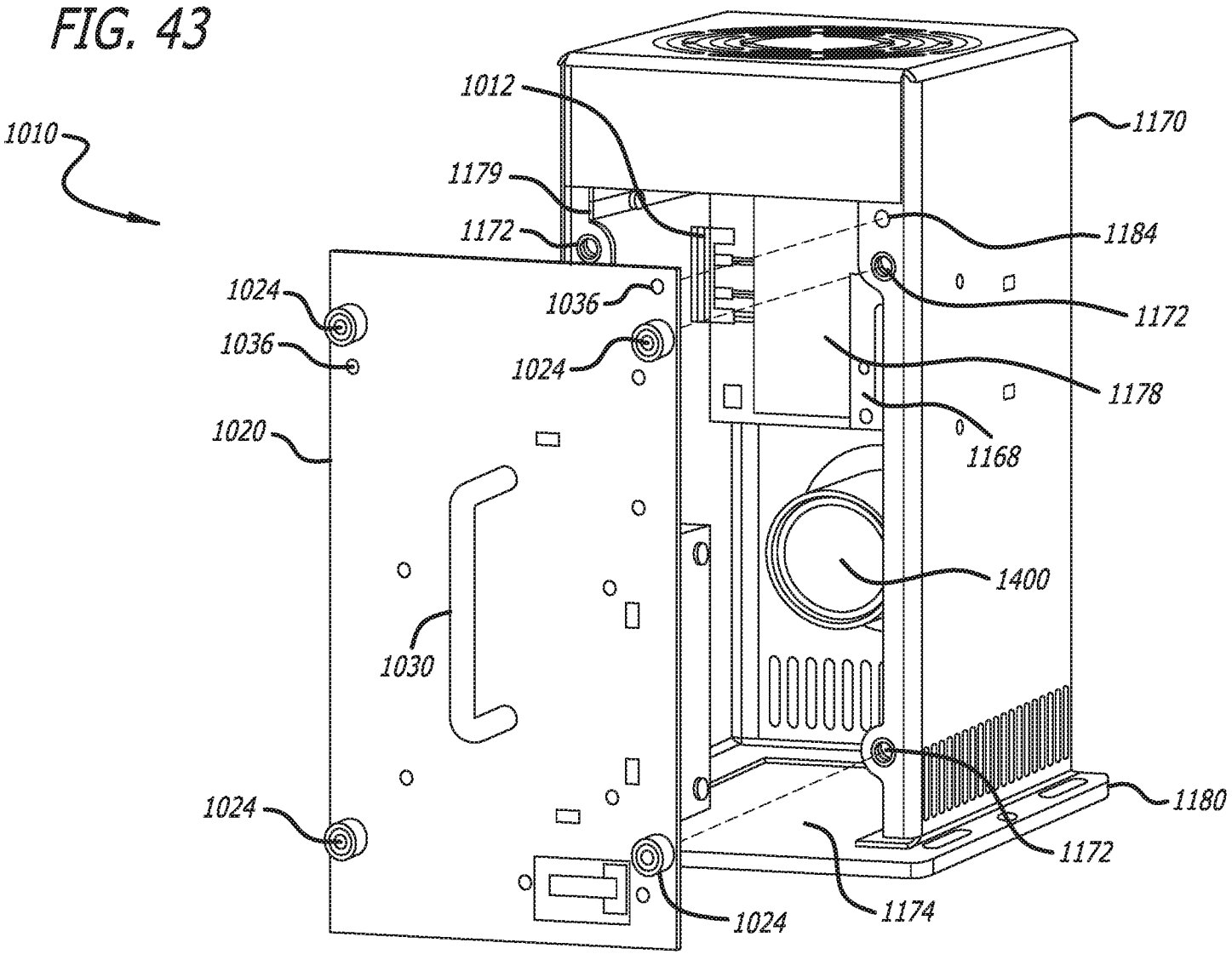
FIG. 43 shows a perspective view of an embodiment of a modular broadband light source with the lamp body insert and lamp housing separated.
Figure 44:
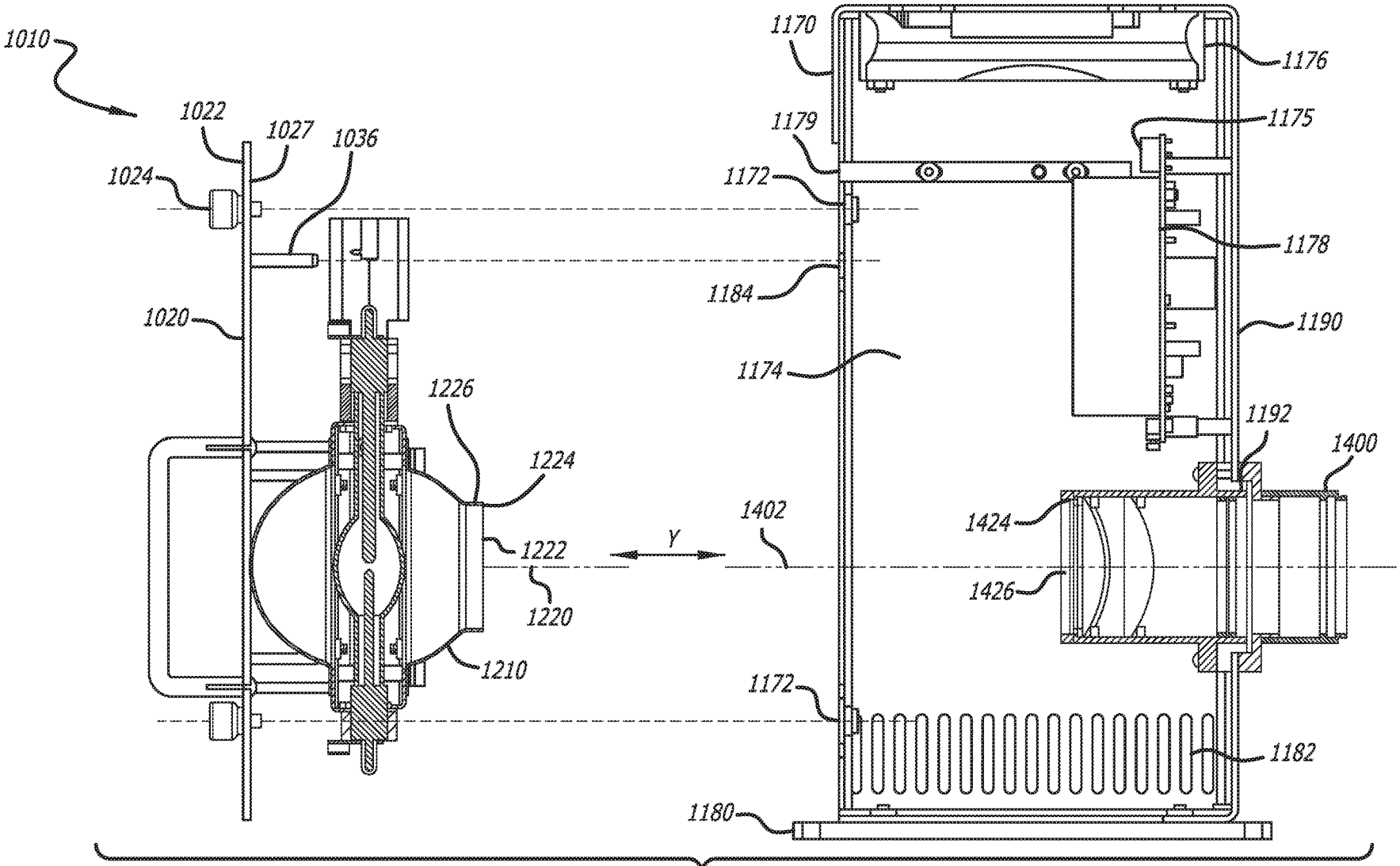
FIG. 44 shows section views of the lamp body insert and the lamp housing shown in FIG. 43.

FIGS. 43 and 44 show exploded views of the modular broadband light source 1010 with the lamp body insert 1020 and the body insert receiver 1174 formed within the lamp housing 1170. The lamp body insert 1020 may be detachably coupled with the lamp housing fasteners 1024 engaged with the fastener receiving ports 1172. At least one aligning pin 1036 (see FIG. 25) may engage with at least one alignment receiver 1184 to facilitate the engagement of the lamp body insert 1020 into the body insert receiver 1174. The first flange surface 1226 of the outlet port flange 1224 of the thermal managing reflector body 1200 may be configured to engage with the aligning surface 1424 of the optical system 1400 so that the optical axis 1220 of the thermal managing reflector body 1200 and the optical axis 1402 of the optical system 1400 are substantially coaxial. Alternatively, the optical axis 1220 of the thermal managing reflector body 1200 and the optical axis 1402 of the optical system 1400 may not be coaxial.

Referring again to FIGS. 43 and 44, when the lamp body insert 1020 is fully inserted into and is retained in the body insert receiver 1174, the surface 1027 of the panel body 1022 may engage at least one safety device 1179 which may contact at least one safety sensor 1175. In one embodiment, the safety sensor 1175 allows operation of at least one controller/drive unit 1178. The controller/drive unit 1178 may provide electrical energy for some or all of the operating functions of the modular broadband light source 1010. When the lamp body insert 1020 is detached from the body insert receiver 1174, the safety device 1179 may disengage from the surface 1027 of the panel body 1022 and break contact with the safety sensor 1175. If contact with the safety device 1179 is broken, electrical power to the lamp body insert 1020 may be terminated. As such, the safety device 1179 and the safety sensor 1175 may act as a safety interlock that reduces the chance of damage or injury to personnel that operate the modular broadband light source 1010. Those skilled in the art will appreciate that other type of safety devices and interlocks can be incorporated into the functions of the modular broadband light source 1010.

Figure 47:
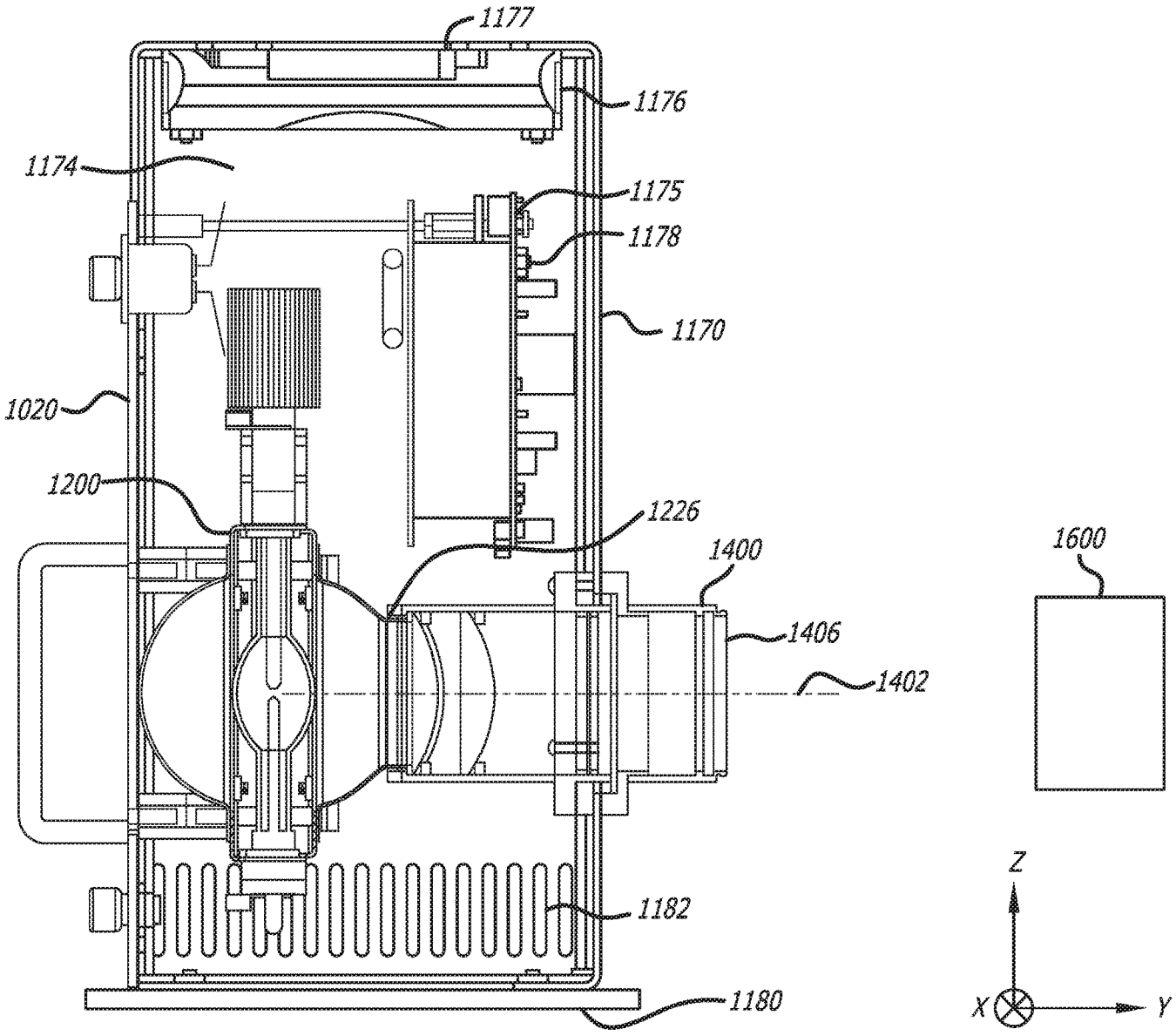

FIG. 47 shows a sectional view of the modular broadband light source. As shown, the lamp body insert 1020 may be located in the body insert receiver 1174 of the lamp housing 1170. The aligning surface 1226 of the thermal managing assembly 1200 may engage with the aligning surface 1424 of the optical system 1400. During operation, optical output from the lamp 1470 is reflected from the reflecting surfaces 1204 and 1212 and may be transmitted through the optical system 1400 and exit the outlet port 1406.

Figure 48:
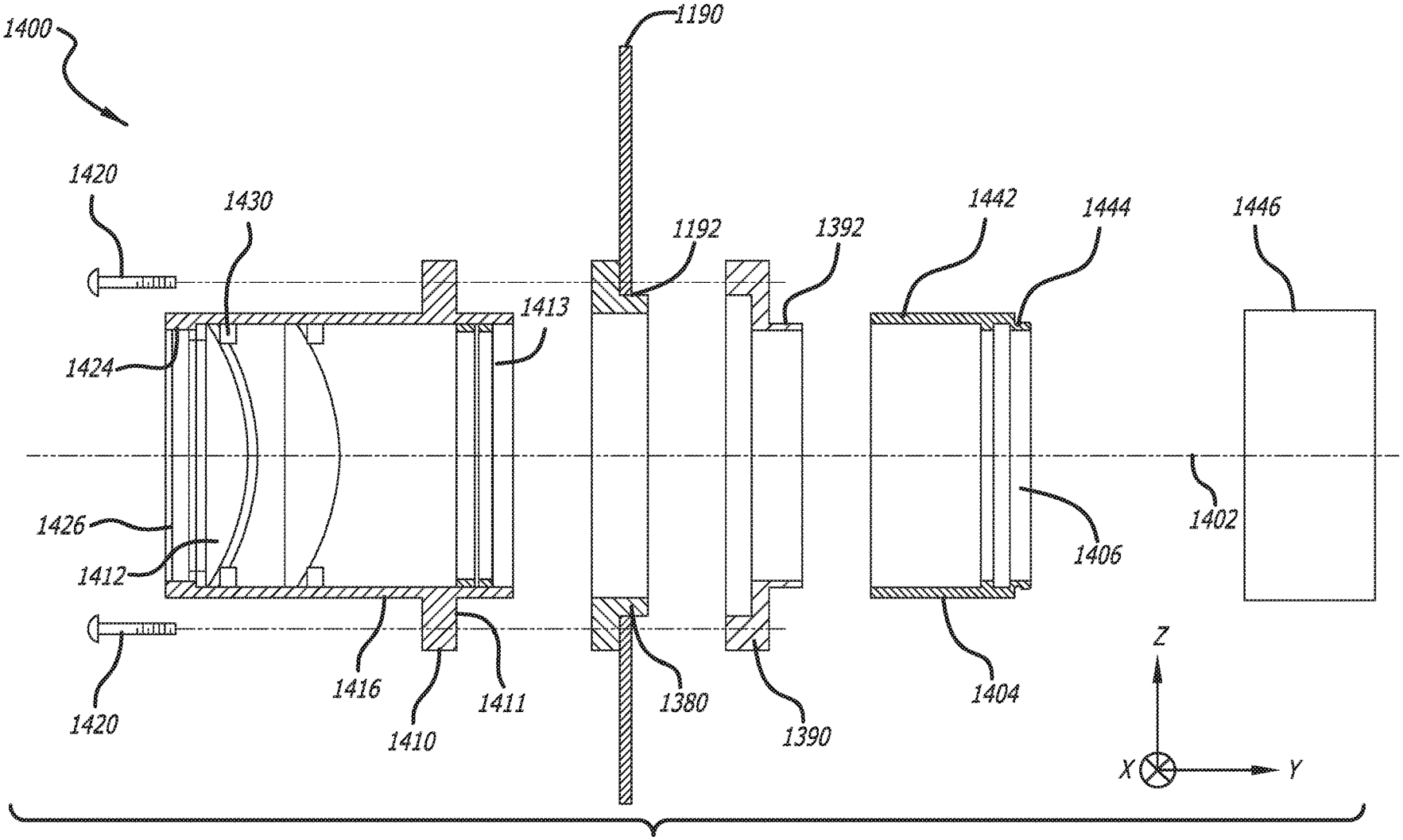
FIGS. 48 and 49 show section views of the optical system shown in FIG. 47.
Figure 49:
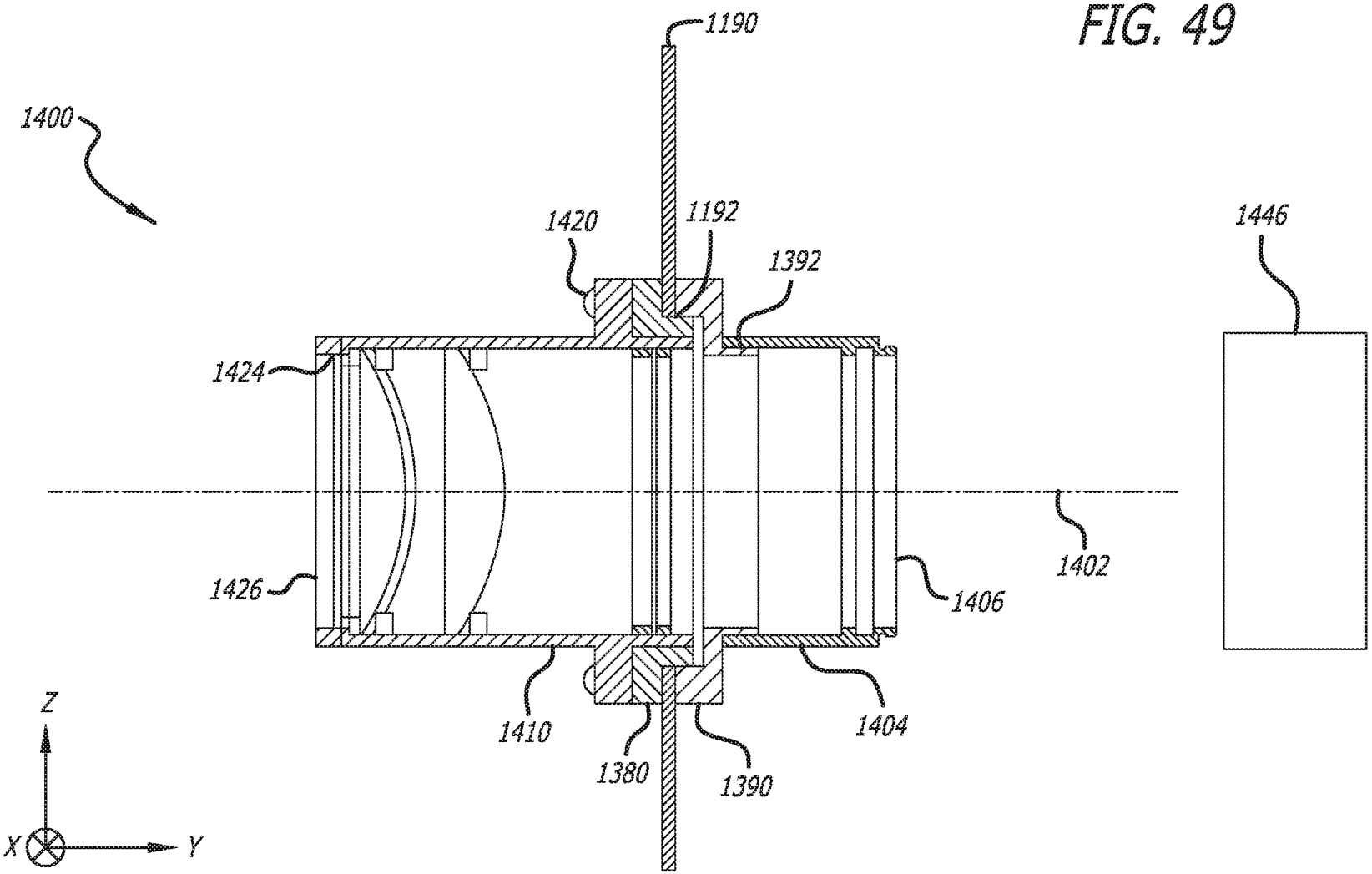

FIGS. 44-49 show various views of various components positioned on or otherwise coupled to an embodiment of an optical system 1400 for use with the modular broadband light source 1010 shown in FIG. 22. In one embodiment, the optical system 1400 may be coupled to the lamp housing 1170 and in communication with the body insert receiver 1174 via at least one receiving port 1192 formed in at least one housing panel 1190. The optical system 1400 may be configured to modify and/or condition the reflected optical radiation 1497 that may be emitted from the thermal managing reflector body 1200. Referring to FIG. 48, in the illustrated embodiment, the optical system 1400 may include at least one optical subsystem 1410 defining an optical axis 1402. The optical subsystem 1410 may be configured with at least one port 1426 and at least one surface 1424 that may engage coaxially with the first flange surface 1226 of the outlet port flange 1224 of the thermal managing reflector body 1200 such that the optical axis 1220 of reflector 1210 may overlap the optical axis 1402 of optical system 1400. The optical system 1400 may be configured to allow the use of a wide variety of optical devices in the modular broadband light source 1010. The optical subsystem 1410 may at least one optical axis 1402 with at least one optical element 1412 disposed therein and retained by at least one retaining device 1430. As shown in FIGS. 48 and 49, at least one internal adapting device 1380 may traverse through the port 1192 of the housing panel 1190 and the subsystem 1410 may traverse through the internal adapting device 1380. In one embodiment, at least one coupling body 1420 may traverse through at least one flange 1411 of the optical subsystem 1410 and engages with at least one external adapting device 1390 to detachably couple the optical subsystem 1410 to the housing panel 1190. Optionally, the optical subsystem 1410 may include one or more internal and/or external threads that may be engaged with mating threads of the internal adapting device 1380, the external adapting device 1390 and/or at least one system adapting device 1404. As shown in FIGS. 44 through 49, the optical system 1400 may be fixed relative to the housing panel 1190 of the housing 1170 and relative to the thermal managing reflector body 1200. Optionally, the optical system 1400 may be configured to move relative to the housing 1170 and the thermal managing reflector body 1200. In one embodiment, the optical subsystem 1410 may be configured to be detachably coupled to the housing panel 1190 from the interior of the housing 1170. Optionally, the optical subsystem 1410 may be configured to be detachably coupled to the housing panel 1190 from the exterior of housing 1170. The system adapting device 1404 may be used to connect the broadband light source 1010 to at least one external optical system 1446. In the illustrated embodiment, at least one interior surface 1442 of system adapting device 1404 may mate with at least one exterior surface 1392 of the external adapting device 1390. Those skilled in the art will appreciate that the interior surface 1442 of system adapting device 1404 may be coupled to the exterior surface 1392 of external adapting device 1390 in a variety of ways, including threads, friction fits and the like. At least one adapting surface 1444 of the system adapting device 1404 may be configured to detachably couple to the external optical system 1446 in optical and mechanical communication with the modular broadband light source 1010. Exemplary external optical systems 1446 are light tubes, light shields, spacers, optical mounts, optical cage systems, optical couplers, beam turning mirrors, shutters, apertures, irises, lenses, filters, and the like.

As shown in FIG. 48, the optical subsystem 1410 may be configured with at least one sleeve 1416 defining at least one outlet port 1413 and at least one optical axis 1402 with one or more optical elements 1412 disposed therein. Exemplary types of optical elements 1412 include, without limitations, lenses, filters, waveplates, mirrors, and the like. Exemplary lenses include, without limitations, plano-convex lenses, biconvex lenses, plano-concave lenses, biconcave lenses, aspheric lenses, meniscus lenses, cylindrical lenses, Fresnel lenses, gradient index lenses, axicon lenses, superlenses and any combinations thereof. The optical elements 1412 may be retained by one or more retaining members 1430. Those skilled in the art will appreciate that multiple combinations of the optical elements 1412 described herein may comprise the optical subsystem 1410. In one embodiment, the optical elements 1412 do not move relative to each other. Optionally, the optical subsystem 1410 may comprise multiple sleeves and mechanisms that allow multiple optical elements to move relative to each other and/or relative to the thermal managing reflector body 1200.

Figure 50:
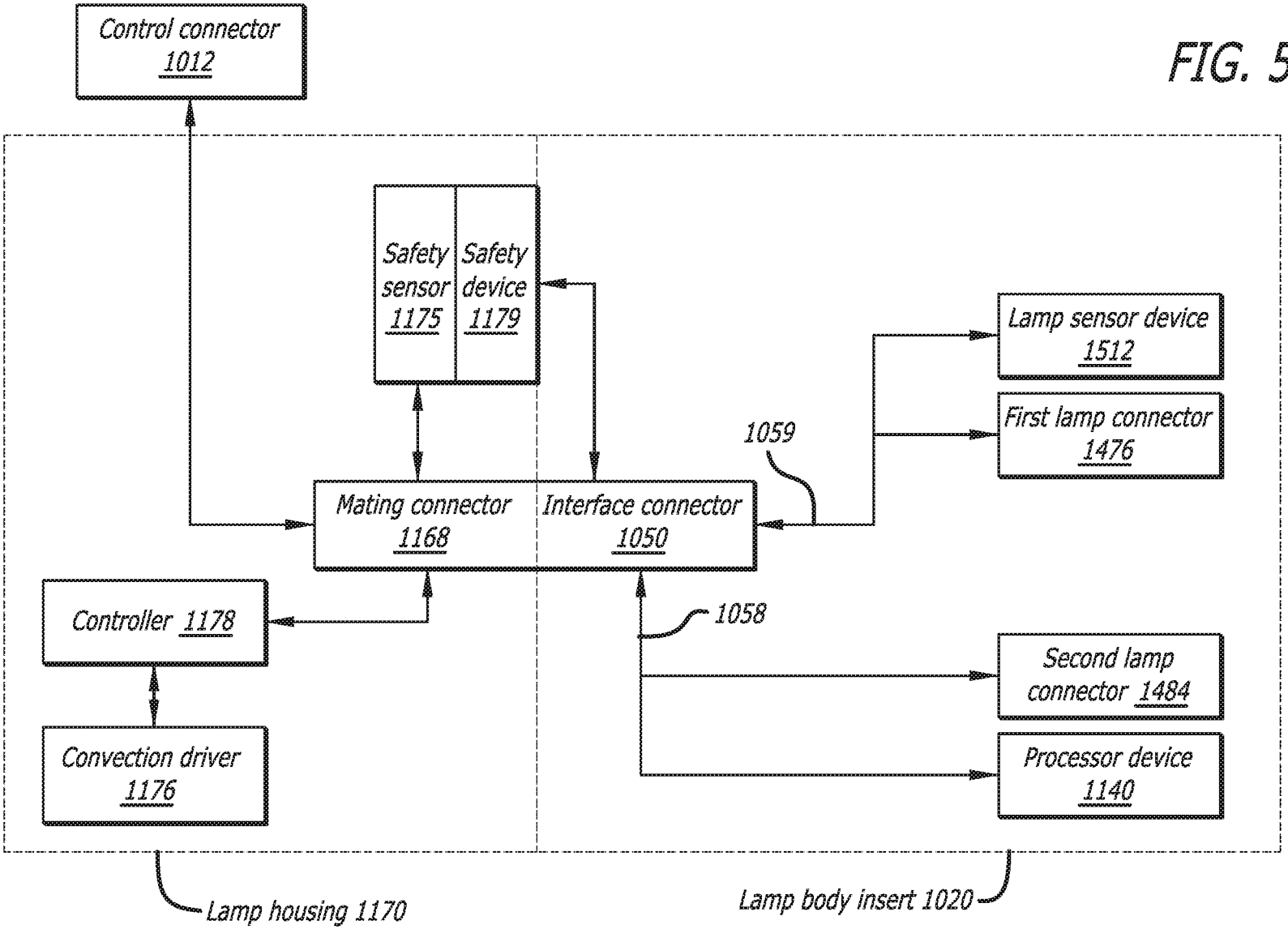
FIG. 50 shows a control schematic of the modular broadband light source shown in FIG. 22.

FIG. 50 shows a control schematic of an embodiment of a modular broadband light source 1010. As shown, certain components may be located on the lamp housing 1170 or the lamp body insert 1020. In one embodiment, the interface connector 1050 of the lamp body insert 1020 may be connected to the mating connector 1168 of the lamp housing 1170 to provide electrical power and control signals to the lamp body insert 1020. In the lamp body insert 1020, the interface cable 1059 may connect to the lamp sensor device 1512 and the first lamp connector 1476 to the interface connector 1050, and the interface cable 1058 may connect the processor device 1140 and the second lamp connector 1484 to the interface connector 1050. In the lamp housing 1178, the mating connector 1168 may connected to the controller 1178, the convection driver 1176 and the control connector 1012. Also shown are the safety device 1179 and the safety sensor 1175 that may be located on the lamp housing 1170 and operate as described in the paragraphs above. A control connector 1012 may enable the connection of the modular broadband light source to at least one external control device (not shown). Those skilled in the art will appreciate that there are many configurations of schematics that may be employed for use with the modular broadband light source 1010.

The embodiments disclosed herein are illustrative of the principles of the invention. Other modifications may be employed which are within the scope of the invention. Accordingly, the devices disclosed in the present application are not limited to those precisely as shown and described herein.

What is claimed is:

1. A broadband light source, comprising:

at least one lamp housing defining at least one body insert receiver therein, the at least one lamp housing having at least one outlet port formed thereon;

at least one lamp body insert configured to be positionable within the at least one body insert receiver, the at least one lamp body insert configured to detachably coupled to the at least one lamp housing;

at least one thermal managing assembly coupled to the at least one lamp body insert and defining at least one lamp receiving area, the at least one lamp body insert having at least one Xenon arc lamp positionable within the at least one lamp receiving area and in optical communication with the at least one outlet port formed on the at least one lamp housing;

at least one processor device coupled to at least one of the at least one lamp housing and the at least one lamp body insert, the at least one processor device in communication with the at least one Xenon arc lamp, the at least one processor device configured to measure at least one cumulative run time of the at least one Xenon arc lamp;

at least one heat dissipation device and at least one lamp sensor device in communication with the at least one Xenon arc lamp;

at least one interface connector in communication with at least one of the at least one Xenon arc lamp, the at least one heat dissipation device and the at least one lamp sensor device via at least one interface cable, the at least one interface cable configured to provide electrical power to the at least one Xenon arc lamp; and wherein the at least one thermal managing assembly further comprises at least one protective fixture with at least one protective fixture outlet port formed thereon, the at least one protective fixture outlet port in optical communication with the at least one outlet port formed on the at least one lamp housing, and wherein the at least one Xenon arc lamp is positioned substantially perpendicular to the at least one protective fixture outlet port.

2. The broadband light source of claim 1 wherein the at least one protective fixture has a spherical shape.

3. The broadband light source of claim 1 wherein the at least one protective fixture has a shape selected from a group consisting of elliptical, planar, paraboloid and parabolic cylindrical.

4. The broadband light source of claim 1 wherein the at least one processor device is configured to measure at least one characteristic of the at least one Xenon arc lamp.

5. The broadband light source of claim 4 wherein the at least one characteristic of the at least one Xenon arc lamp is selected from a group consisting of output optical power, output optical intensity, output spectrum, operating temperature, operating current and operating voltage of the at least one Xenon arc lamp.

6. The broadband light source of claim 1 wherein the at least one processor device is in communication with at least one external control source via at least one control connector.

7. A modular light source, comprising:

at least one lamp housing defining at least one body insert receiver therein, the at least one lamp housing having at least one outlet port formed thereon;

at least one lamp body insert configured to be positionable within the at least one body insert receiver, the at least one lamp body insert configured to detachably couple to the at least one lamp housing;

at least one thermal managing assembly coupled to the at least one lamp body insert and defining at least one lamp receiving area, the least one lamp body insert with at least one lamp positionable in the at least one lamp receiving area and in optical communication with the at least one outlet port formed on the at least one lamp housing;

at least one heat dissipation device and at least one lamp sensor device in communication with the at least one lamp;

at least one interface connector in communication with at least one of the at least one lamp, the at least one heat dissipation device and the at least one lamp sensor device via at least one interface cable, the at least one interface cable configured to provide electrical power to the at least one lamp;

at least one processor device coupled to at least one of the at least one lamp housing and the at least one lamp body insert, the at least one processor device in communication with the at least one lamp, the at least one lamp sensor device and the at least one heat dissipation device, the at least one processor device configured with at least one information display; and wherein the at least one thermal managing assembly further comprises at least one protective fixture with at least one protective fixture outlet port formed thereon, the at least one protective fixture outlet port in optical communication with the at least one outlet port formed on the at least one lamp housing, and wherein the at least one lamp is positioned substantially perpendicular to the at least one protective fixture outlet port.

8. The modular light source of claim 7 wherein the at least one protective fixture has a spherical shape.

9. The modular light source of claim 7 wherein the at least one protective fixture has a shape selected from a group consisting of elliptical, planar, paraboloid and parabolic cylindrical.

10. The modular light source of claim 7 wherein the at least one lamp comprises at least one arc lamp.

11. The modular light source of claim 10 wherein the at least one arc lamp is selected from a group consisting of Xenon arc lamps, Mercury-Xenon arc lamps, Mercury arc lamps, Deuterium arc lamps, Carbon arc lamps, Krypton arc lamps and Sodium gas-discharge lamps.

12. The modular light source of claim 7 wherein the at least one information display is configured to display at least one characteristic of the at least one lamp.

13. The modular light source of claim 12 wherein the at least one characteristic of the at least one lamp is cumulative run time.

14. The modular light source of claim 12 wherein the at least one characteristic of the at least one lamp is selected from a group consisting of output optical power, output optical intensity, output spectrum, operating temperature, operating current and operating voltage of the at least one arc lamp.

15. The modular light source of claim 7 further comprising at least one control connector configured to receive and transmit signals from the modular light source to at least one external control source configured to provide at least one of at least one power signal and at least one control signal to the modular light source.

16. A broadband light source module, comprising:

at least one lamp body insert comprising at least one thermal managing assembly defining at least one lamp receiving area therein, the at least one thermal managing assembly configured with at least one protective fixture defining at least one protective fixture outlet port formed thereon;

at least one broadband lamp positionable within the at least one lamp receiving area, the at least one broadband lamp positioned substantially perpendicular to the at least one protective fixture outlet port and in optical communication with the at least one protective fixture outlet port, and configured to emit optical radiation through the at least one protective fixture outlet port;

at least one heat dissipation device and at least one lamp sensor device in communication with the at least one broadband lamp;

at least one interface connector in communication with at least one of the at least one broadband lamp, the at least one heat dissipation device and the at least one lamp sensor device via at least one interface cable, the at least one interface cable configured to provide electrical power to the at least one broadband lamp; and wherein the at least one protective fixture has a spherical shape.

17. The broadband light source module of claim 16 wherein the at least one broadband lamp comprises at least one arc lamp.

18. The broadband light source of claim 17 wherein the at least one arc lamp is selected from a group consisting of Mercury-Xenon arc lamps, Mercury arc lamps, Deuterium lamps, Carbon arc lamps, Krypton arc lamps and Sodium gas-discharge arc lamps.

* * * * *